US012672712B2

(12) United States Patent
Kumar et al.

(10) Patent No.: US 12,672,712 B2
(45) Date of Patent: Jul. 7, 2026

(54) AUTONOMOUS VACUUM SWEEPING SYSTEM

(71) Applicant: Matic Robots, Inc., Mountain View, CA (US)

(72) Inventors: Anshuman Kumar, San Francisco, CA (US); Karthik Chandrashekaraiah, San Francisco, CA (US); Nathan Elio Madonia, Mountain View, CA (US); William George Plummer, London (GB); Tristan Pierre Gervais, Sunnyvale, CA (US); Kaiwen Liao, Sunnyvale, CA (US); Vishal Jain, Santa Clara, CA (US)

(73) Assignee: MATIC ROBOTS, INC., Mountain View, CA (US)

( * ) Notice: Subject to any disclaimer, the term of this patent is extended or adjusted under 35 U.S.C. 154(b) by 338 days.

(21) Appl. No.: 18/232,749

(22) Filed: Aug. 10, 2023

(65) Prior Publication Data

US 2024/0049928 A1 Feb. 15, 2024

Related U.S. Application Data

(60) Provisional application No. 63/396,887, filed on Aug. 10, 2022.

(51) Int. Cl.
*A46B 13/02* (2006.01)
*A46B 13/00* (2006.01)
(Continued)

(52) U.S. Cl.
CPC ..... *A46B 13/02* (2013.01); *A47L 7/0004* (2013.01); *A47L 9/248* (2013.01); *A47L 9/2821* (2013.01);
(Continued)

(58) Field of Classification Search
CPC ... A47L 9/00; A47L 9/24; A47L 9/248; A47L 9/2821; A47L 9/2842; A47L 9/2857;
(Continued)

(56) References Cited

U.S. PATENT DOCUMENTS 5,787,546 A * 8/1998 Bass ..... A47L 5/26 15/334
9,038,233 B2 5/2015 Jones et al.
(Continued)

FOREIGN PATENT DOCUMENTS

CN 1092636 A 9/1994
CN 109247864 A 1/2019
(Continued)

OTHER PUBLICATIONS

International Search Report and Written Opinion, Patent Cooperation Treaty Application No. PCT/US2023/029962, dated Oct. 27, 2023, 14 pages.
(Continued)

*Primary Examiner* — C. A. Rivera
(74) *Attorney, Agent, or Firm* — Fenwick & West LLP

(57) ABSTRACT

A cleaning system may have a brush roller that moves dust and debris towards a duct opening for collection. The cleaning system may be an autonomous vacuum robot or include an autonomous vacuum robot. The cleaning system may include guards that reduce the likelihood that fibrous debris wraps around rotating portions of the brush roller (e.g., around a drive pinion). Buffer zones in the brush roller may receive fibrous debris that would otherwise wrap around the brush roller and increase undesirable friction during operation. The brush roller is configured to be unlocked from a position contacting the inner surface of a cleaning head of the cleaning system. The fibrous debris stored in the buffer zones may be suctioned into a debris
(Continued)

collection compartment of the cleaning system after the brush roller is unlocked. The cleaning system includes a wedge to seal a cavity for ingesting debris within the cleaning head from the environment.

20 Claims, 37 Drawing Sheets

(51) Int. Cl.

| | |
|---|---|
| ***A47L 7/00*** | (2006.01) |
| ***A47L 9/04*** | (2006.01) |
| ***A47L 9/24*** | (2006.01) |
| ***A47L 9/28*** | (2006.01) |
| ***A47L 11/30*** | (2006.01) |
| ***A47L 11/40*** | (2006.01) |

(52) U.S. Cl.
CPC ..... *A47L 9/2831* (2013.01); *A47L 9/2842* (2013.01); *A47L 9/2857* (2013.01); *A47L 11/302* (2013.01); *A47L 11/4011* (2013.01); *A47L 11/4066* (2013.01); *A46B 13/001* (2013.01); *A47L 9/0455* (2013.01); *A47L 2201/00* (2013.01)

(58) Field of Classification Search
CPC . A47L 9/02; A47L 9/04; A47L 9/0461; A47L 9/0466; A47L 9/0477; A47L 11/00; A47L 11/29; A47L 11/30; A47L 11/302; A47L 11/40; A47L 7/00; A47L 7/0004; A47L 2201/00; A46B 13/00; A46B 13/02
See application file for complete search history.

(56) References Cited

U.S. PATENT DOCUMENTS

| | | | |
|---|---|---|---|
| 10,292,560 | B2 | 5/2019 | Doughty |
| 10,517,454 | B2 | 12/2019 | Jones et al. |
| 10,568,483 | B2 | 2/2020 | Lewis |
| 11,058,271 | B2 | 7/2021 | Blouin |
| 11,103,113 | B2 | 8/2021 | Schregardus et al. |
| 11,278,173 | B2 | 3/2022 | Jones et al. |
| 2002/0029436 | A1 | 3/2002 | Hawkins et al. |
| 2003/0229421 | A1 | 12/2003 | Chmura et al. |
| 2010/0256812 | A1 | 10/2010 | Tsusaka et al. |
| 2010/0332067 | A1 | 12/2010 | Abramson |
| 2012/0311813 | A1 | 12/2012 | Gilbert et al. |
| 2013/0312792 | A1 | 11/2013 | Hensel et al. |
| 2018/0184865 | A1 | 7/2018 | Lee et al. |
| 2019/0183307 | A1 | 6/2019 | Irfan et al. |
| 2019/0282055 | A1 | 9/2019 | Lee et al. |
| 2021/0121033 | A1 | 4/2021 | Kwak et al. |
| 2021/0378472 | A1 | 12/2021 | Kumar et al. |

FOREIGN PATENT DOCUMENTS

| | | | | | |
|---|---|---|---|---|---|
| CN | 210931160 | U | * | 7/2020 | |
| CN | 112137492 | A | | 12/2020 | |
| CN | 113520221 | A | | 10/2021 | |
| CN | 113842083 | A | | 12/2021 | |
| DK | 151928 | B | * | 1/1988 | ..... A47L 9/04 |
| EP | 1195127 | A2 | | 4/2002 | |
| JP | 2009-076799 | A | | 4/2009 | |
| WO | 2019/011233 | A1 | | 1/2019 | |

OTHER PUBLICATIONS

Patent Cooperation Treaty, International Search Report and Written Opinion, International Patent Application No. PCT/US2023/030002, dated Oct. 27, 2023, 17 pages.
United States Office Action, U.S. Appl. No. 18/232,726, Oct. 30, 2025, 30 pages.

* cited by examiner

2400

2420

AUTONOMOUS VACUUM SWEEPING SYSTEM

CROSS REFERENCE TO RELATED APPLICATIONS

This application claims priority to and the benefit of U.S. Provisional Application No. 63/396,887 filed on Aug. 10, 2022, which is incorporated by reference in its entirety.

TECHNICAL FIELD

This disclosure relates to autonomous cleaning systems. More particularly, this disclosure describes components of an autonomous cleaning system used for sweeping debris from an environment.

BACKGROUND

Conventional vacuum systems can use brush rollers to assist in moving dust and debris to be suctioned by the vacuum. However, brush rollers of conventional vacuum systems have various issues such as cleaning efficiency, noise, and power consumption. Hairs can wrap and accumulate around the outside of the brush roller, which worsens cleaning performance. Hairs can also jam or unseat rotating brush rollers, which completely stops cleaning performance until the brush roller is unjammed or reseated. Flaps of brush rollers can be noisy as they successively strike the ground during cleaning. Conventional vacuum systems may also expend additional power to rotate a brush roller against additional friction caused by hairs that accumulate around the brush roller and may wrap around a rotating portion of the brush roller (e.g., a drive pinion). Cleaning fibrous debris from conventional vacuum systems can be inconvenient for the user and is often challenging because removal or insertion of a vacuum's brush roller requires complex procedures, additional tools, or undue force, which may damage the vacuum or brush roller. Furthermore, large debris may be unable to be ingested into conventional vacuum systems due to insufficient room or because the large debris enters at edges of a brush roller.

Conventional vacuum systems may use a wedge to seal a cavity in which debris is ingested from a floor on which the vacuum travels. This conventional wedge can have a skirted leading edge, which causes an accumulation of debris at the base of the vacuum and dragged along the floor rather than encouraging movement of the debris into an opening to be suctioned from the environment. To move this accumulated debris, conventional cleaning systems may exert a greater airflow and brush roller rotational speed, which both create loud noise, consume excessive power, and require costly motor systems.

Finally, conventional vacuum systems may include a side brush for cleaning vertical surfaces (e.g., walls). To clean a wall, a vacuum closely follows the wall using the side brush. To determine a distance between the side brush and a wall, a conventional vacuum system may use laser-based sensors to detect a wall is within proximity of the vacuum and cause the vacuum to approach the detected wall. However, laser-based sensors may be adequate to accurately measure smaller distances (i.e., with a finer resolution) when the vacuum is closer to the wall.

SUMMARY

A cleaning system may include a brush roller that allows for movement of dust and debris towards a duct opening for collection. The cleaning system may be an autonomous vacuum robot or include an autonomous vacuum robot. Flaps of the brush roller are configured to contact debris and move debris towards the duct opening. The material and structure of the flaps may enable them to operate quieter and move debris more effectively than flaps of a conventional brush roller. The cleaning system includes guards that reduce the likelihood that fibrous debris wraps around rotating portions of the brush roller (e.g., around a drive pinion). Buffer zones in the brush roller may receive fibrous debris that would otherwise wrap around the brush roller and increase undesirable friction during operation. The brush roller is configured to be unlocked from a position contacting the inner surface of a cleaning head of the cleaning system without requiring application of excessive force or complex disassembly steps to be followed by a user. The brush roller may be unlocked without turning over the robot vacuum (e.g., without inverting the vacuum so that the brush roller is facing upwards). The fibrous debris stored in the buffer zones may be suctioned into a debris collection compartment of the cleaning system after the brush roller is unlocked.

In one embodiment, a brush roller includes an outer core, an inner core, and flaps connected to the outer core. The outer core may include a first tube. The inner core may be concentric with the outer core and configured to be located within the outer core. The inner core may include a second tube. The inner core may be configured to house a spring and a ball bearing. The spring may be configured to contact an inner surface of the cleaning head (e.g., an inner surface of the second tube). The ball bearing may be configured to contact the spring. The inner core may be configured to house at least part of a pin and an end tip. The pin may be configured to contact the ball bearing at a first side of the pin. The end tip may include a locking mechanism. The end tip may be connected to the pin at a second side of the pin. The locking mechanism may be configured to secure the end tip to the inner surface of the second tube. The pin and the end tip may be connected such that the pin and the end tip are stationary during rotation of the ball bearing and inner core.

The plurality of flaps may include an elastomer having one or more of a hardness within Shore A 40 to 80, a Bayshore rebound resilience within 5-50%, an elongation at break within 50-900%, and a tear strength within 75-250 kilonewtons per meter (kN/m). The flaps may be interleaving. A combined length of two or more of the flaps may extend along a total length of the outer core. A first flap of the flaps can overlap with a second flap of the flaps by an overlapping length of 5-50 mm. The brush roller may have 2-12 flaps. Each flap may include a trailing edge and a leading edge, where the trailing edge can be proximal to the center of the outer core. The outer core may include bases at opposite ends of the outer core. Each leading edge can form an angle within 1-60 degrees with one of the bases of the outer core.

A flap can have a length within 5-35 mm. A flap can include a root section and a tapered section. The root section may have a uniform thickness. The tapered section may have a tapered thickness. A ratio between the uniform thickness of the root section and a height of the flap may be within 1:5 to 1:25. The inner surface of the inner core can include a recession enabling a linear motion of the pin and the end tip within a range of 0.5-30 mm. The linear motion may be parallel with the central axis of the inner core. An outer radius of the outer core may be within 8-50 mm. A total length of the outer core may be within 50-500 mm. The outer core may further include air pathways configured to enable airflow along a length of the outer core.

The brush roller can further include one or more buffer zones. Each buffer zone can include a toroidal cavity configured to receive and store hair. The toroidal cavity may be located between an inner surface of the first tube and an outer surface of the second tube. The one or more buffer zones can be located proximal to an end of the brush roller. The inner core can further include a drive coupler configured to couple to a drive pinion. The drive pinion can be attached to a cleaning head configured to house the brush roller. The inner core may be attached to the outer core.

In one embodiment, a method includes providing a cleaning system, where the cleaning system includes a debris ingestion opening, a brush roller, flaps, one or more buffer zones, and a duct opening. Debris is received at the debris ingestion opening, where the debris includes hair. The hair is caused to travel into a buffer zone of the one or more buffer zones. The buffer zone may be located proximal to an end of the brush roller. Responsive to the end of the brush roller positioned proximal to the duct opening, the hair may be suctioned from the buffer zone.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

Figure 1:
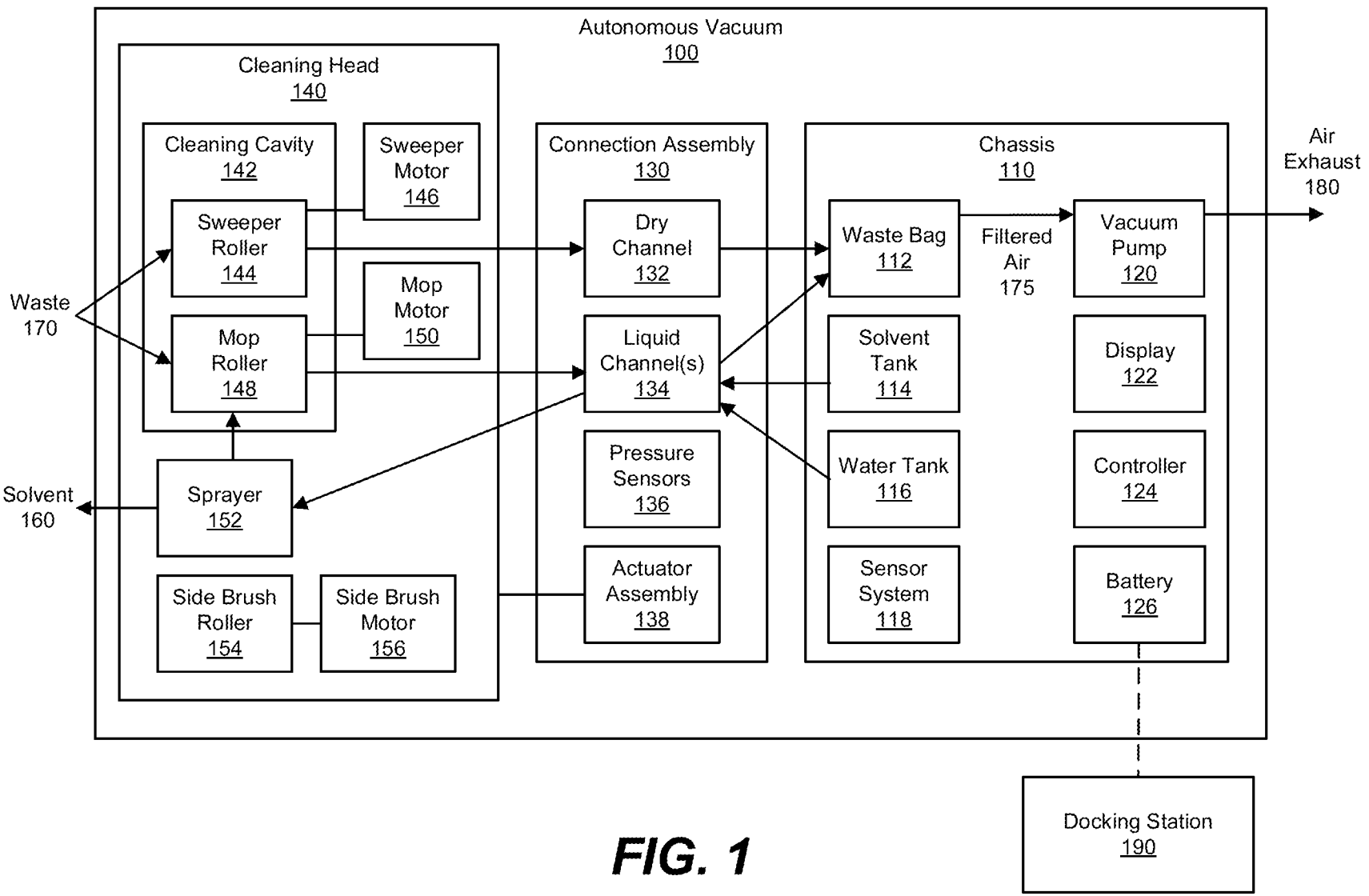
FIG. 1 is a block diagram of an autonomous vacuum, according to one example embodiment.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

The figures (FIGS.) and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

OVERVIEW

A cleaning system may include a brush roller that allows for movement of dust and debris towards a duct opening for collection. The cleaning system may be an autonomous vacuum robot or include an autonomous vacuum robot. Flaps of the brush roller are configured to contact debris and move debris towards the duct opening. The brush roller is configured to be unlocked from a position contacting the inner surface of a cleaning head of the cleaning system without requiring excessive force or disassembly by a user.

Furthermore, the cleaning system allows for avoiding increased friction caused by the intake of fibrous debris that wraps around the brush roller. In conventional cleaning systems having brush rollers, fibrous debris wraps around the brush roller and causes increased friction at one or more points of contact between the rotating brush roller and a stationary surface of the cleaning system. In particular, fibrous debris can bind around a rotating location of the brush roller and consequently, increase the likelihood that the brush roller is unseated or the rotation of the brush roller is jammed. The cleaning head can include one or more guards configured to prevent fibrous debris from contacting stationary surfaces of the cleaning system and consequently, prevents the increase of friction at one or more points of contact with the stationary surfaces. Additionally, the brush roller may include one or more buffer zones configured to receive and store fibrous debris that are prevented by the guards from contacting a stationary surface of the cleaning system.

Moreover, the cleaning head and the brush roller allow for removal of fibrous debris. For example, the cleaning head and brush roller are configured to enable fibrous debris to be suctioned from the one or more buffer zones into a duct opening for collection of debris. The brush roller can be unlocked from a cleaning orientation, enabling the fibrous debris at the one or more buffer zones to be exposed to a suctioning air flow into the duct opening for removal of debris (e.g., into a compartment of the cleaning system for debris storage).

A wedge of the cleaning system allows for debris to be led by the brush roller into the duct opening (e.g., rather than becoming accumulated in a space within the cleaning head contacting the surface to be cleaned). The wedge seals a debris ingestion cavity of the cleaning head (e.g., the space where the brush roller operates to move debris into a duct opening) from a surface being cleaned. The wedge has a leading edge that is pointed, where a leading edge is a frontmost portion of the cleaning system that contacts a surface to be cleaned. Conventional cleaning systems may have a leading edge that is prone to digging into carpets and angled improperly to slide over debris rather than encouraging debris from a surface to enter the duct opening of the cleaning head. Additionally, conventional cleaning systems may have wedges that cause debris to become accumulated and dragged against a surface as the cleaning system moves around an environment. To move this accumulated debris, conventional cleaning systems may exert a greater airflow and brush roller rotational speed, which both create loud noise, consume excessive power, and require costly motor systems. The wedge is shaped similar to a plough to avoid this debris accumulation. Furthermore, the wedge includes a strip of compliant material (e.g., fine bristles, foam strips, elastomeric structures, etc.) to reduce the likelihood of being damaged by coarsely textured floors (e.g., from carpets or small stones).

The cleaning system may include a side brush for cleaning vertical surfaces (e.g., walls) as the cleaning system moves around an environment. The cleaning system may perform a homing process to stop the side brush from rotating and conceal the side brush. Additionally, the cleaning system may perform a wall-following process to control a distance between the side brush and a vertical surface. For example, the cleaning system may use laser-based sensors to determine a first distance from a vertical surface. In response to determining that the first distance is within a threshold range of distances corresponding to a proximity of the side brush to the vertical surface, the cleaning system may use a measure of the torque associated with the side brush to determine a second distance from the side brush to the vertical surface, where the second distance is smaller than the first distance. In this way, the wall-following process of the cleaning system involves multiple granularities of distance measurement, where the second distance measurement can improve the measurement of closeness at which the cleaning system follows a vertical surface (e.g., as compared to using laser-based sensors without torque measurement).

System Architecture

FIG. 1 is a block diagram of an autonomous vacuum 100, according to one example embodiment. The autonomous vacuum 100 in this example may include a chassis 110, a connection assembly 130, and a cleaning head 140. The components of the autonomous vacuum 100 allow the autonomous vacuum 100 to intelligently clean as the autonomous vacuum 100 traverses an area within an environment.

As an overview, the chassis 110 is a rigid body that serves as a base frame for the autonomous vacuum. The chassis 110 includes a plurality of motorized wheels for driving the autonomous vacuum 100. The chassis 110 hosts a suite of other components for navigating the autonomous vacuum 100, communicating with external devices, providing notifications, among other operations. The connection assembly 130 serves as a connection point between the cleaning head 140 and the chassis 110. The connection assembly 130 comprises at least a plurality of channels used to direct solvent, water, waste, or some combination thereof between the cleaning head 140 and the chassis 110. The connection assembly 130 also comprises an actuator assembly 138 that controls movement of the cleaning head 140. The cleaning head 140 may include the one or more brush rollers used to perform cleaning operations. In some embodiments, the architecture of the autonomous vacuum 100 includes more components for autonomous cleaning purposes. Some examples include a mop roller, a solvent spray system, a waste container, and multiple solvent containers for different types of cleaning solvents. The autonomous vacuum 100 may support a variety of cleaning functions, for example, vacuuming, sweeping, dusting, mopping, and/or deep cleaning.

The chassis 110 is a rigid base frame for the autonomous vacuum 100. In one or more embodiments, the chassis 110 may include at least a waste bag 112, a solvent tank 114, a water tank 116, a sensor system 118, a vacuum pump 120, a display 122, a controller 124, and a battery 126. In other embodiments, the chassis 110 may include additional, fewer, or different components than those listed herein. For example, one embodiment of the chassis 110 omits the display 122. Another embodiment includes an additional output device, such as a speaker. Still another embodiment may combine the solvent tank 114 and the water tank 116 into a single tank.

The waste bag 112 collects the waste that is accumulated from performing cleaning routines. The waste bag 112 may be configured to collect solid and/or liquid waste. In one or more embodiments, there may be two separate waste bags 112, one for solid waste and one for liquid waste. The waste bag 112 may be removably secured within the chassis 110. As the waste bag 112 is filled, the autonomous vacuum 100 may alert the user to empty the waste bag 112 and/or replace the waste bag 112. In other embodiments, the waste bag 112 can remain in the chassis 110 when emptied. In such embodiments, the chassis 110 may further comprise a drainage channel connected to the waste bag 112 to drain the collected waste. The waste bag 112 may further comprise an absorbent material that soaks up liquid, e.g., to prevent the liquid from sloshing out of the bag during operation of the autonomous vacuum 100.

The solvent tank 114 comprises solvent used for cleaning. The solvent tank 114 may include at least a chamber and one or more valves for dispensing from the chamber. The solvent is a chemical formulation used for cleaning. Example solvents include dish detergent, soap, bleach, other organic and/or nonorganic solvents. In some embodiments, the solvent tank 114 comprises dry solvent that is mixed with water from the water tank 116 to create a cleaning solution. The solvent tank may be removable, allowing a user to refill the solvent tank 114 when the solvent tank 114 is empty.

The water tank 116 stores water used for cleaning. The water tank 116 may include at least a chamber and one or more valves for dispensing from the chamber. The water tank 116 may be removable, allowing a user to refill the water tank 116 when the water tank 116 is empty. In one or more embodiments, the water tank 116 may include a valve located on the bottom of the water tank 116, when the water tank 116 is secured in the chassis 110. The weight of the water applies a downward force due to gravity, a spring mechanism, or some combination thereof, to keep the valve closed. To open the valve, some protrusion on the chassis 110 applies a counteracting upward force that opens the valve, e.g., by pushing the valve towards an interior of the chamber revealing an outlet permitting water to escape the water tank 116.

The sensor system 118 comprises a suite of sensors for guiding operation of the autonomous vacuum 100. The sensor system 118 uses the sensor data to map the environment and determine and execute cleaning tasks to handle a variety of messes. The sensor system 118 is further described in FIG. 3.

The vacuum pump 120 generates a vacuum force that aids ingestion of waste by the cleaning head 140. In one or more embodiments, to generate the vacuum force, the vacuum pump 120 may include one or more fans that rotate to rapidly move air. The vacuum force flows through the waste bag 112, through the connection assembly 130, and to the cleaning head 140.

The display 122 is an electronic display that can present visual content. The display 122 may be positioned on a topside of the autonomous vacuum 100. The display may be configured to notify a user regarding operation of the autonomous vacuum 100. For example, notifications may describe an operation being performed by the autonomous vacuum 100, an error message, service needs, or the status of the autonomous vacuum 100, etc. The display 122 may be an output device that includes a driver and/or screen to drive presentation of (e.g., provides for display) and/or present visual information. The display 122 may include a user interface that allows users to interact with and control the autonomous vacuum. In some embodiments, the display may additionally or alternatively include physical interface buttons along with a touch sensitive interface. The display 122 receives data from the sensor system 118 and may display the data. The data may include renderings of a view (actual image or virtual) of a physical environment, a route of the autonomous vacuum 100 in the environment, obstacles in the environment, and messes encountered in the environment. The data may also include alerts, analytics, and statistics about cleaning performance of the autonomous vacuum 100 and messes and obstacles detected in the environment.

The controller 124 is a general computing device that controls operation of the autonomous vacuum 100. As a general computing device, the controller 124 comprises one or more processors and computer-readable storage media for storing instructions executable by the processors. Operations of the controller 124 include navigating the autonomous vacuum 100, simultaneous localization and mapping of the autonomous vacuum 100, controlling operation of the cleaning head 140, generating notifications to provide to the user via one or more output devices (e.g., the display 122, a speaker, or a notification transmittable to the user's client device, etc.), running quality checks on the various components of the autonomous vacuum 100, controlling docking at the docking station 190, etc.

The controller 124 may control movement of the autonomous vacuum 100. In various embodiments, the controller 124 also monitors and manages environment mapping, sensors, detection of items and users in an environment, task lists and assignments, navigation, surface detection, user interfaces, and other logic associated with operation of the autonomous vacuum 100. The controller 124 connects to one more motors connected to one or more wheels that may be used to move the autonomous vacuum 100 based on sensor data captured by the sensor system 118 (e.g., indicating a location of a mess to travel to). The controller 124 may cause the motors to rotate the wheels forward/backward or turn to move the autonomous vacuum 100 in the environment. Based on surface type detection by the sensor system 118, the controller 124 may modify or alter navigation of the autonomous vacuum 100.

The controller 124 of the actuator assembly 138 may also control cleaning operations. Cleaning operations may include a combination of rotation of the brush rollers, positioning or orienting the cleaning head 140 via the actuator assembly 138, controlling dispersion of solvent, activation of the vacuum pump 120, monitoring the sensor system 118, and other functions of the autonomous vacuum 100.

In controlling rotation of the brush rollers, the controller 124 may connect to one or more motors (e.g., the sweeper motor 146, the mop motor 150, and the side brush motor 156) positioned at the ends of the brush rollers. The ends of a brush roller may refer to the bases of the brush roller having a cylindrical shape. The controller 124 can toggle rotation of the brush rollers between rotating forward or backward or not rotating using the motors. In some embodiments, the brush rollers may be connected to an enclosure of the cleaning head 140 via rotation assemblies each comprising one or more of direct drive, geared, or belted drive assemblies that connect to the motors to control rotation of the brush rollers. The controller 124 may rotate the brush rollers based on a direction needed to clean a mess or move a component of the autonomous vacuum 100.

In some embodiments, the sensor system 118 determines an amount of pressure needed to clean a mess (e.g., more pressure for a stain than for a spill), and the controller 124 may alter the rotation of the brush rollers to match the determined pressure. The controller 124 may, in some instances, be coupled to a load cell at each brush roller that is used to detect pressure being applied by the brush roller. In another instance, the sensor system 118 may be able to determine an amount of current required to spin each brush roller at a set number of rotations per minute (RPM), which may be used to determine a pressure being exerted by the brush roller. The sensor system 118 may also determine whether the autonomous vacuum 100 is able to meet an expected movement (e.g., if a brush roller is jammed) and adjust the rotation via the controller 124 if not. Thus, the sensor system 118 may optimize a load being applied by each brush roller in a feedback control loop to improve cleaning efficacy and mobility in the environment. The controller 124 may additionally control dispersion of solvent during the cleaning operation by controlling a combination of the sprayer 152, the liquid channels 134, the solvent tank 114, the water tank 116, and turning on/off the vacuum pump 120.

The autonomous vacuum 100 is powered with an internal battery 126. The battery 126 stores and supplies electrical power for the autonomous vacuum 100. In some embodiments, the battery 126 consists of multiple smaller batteries that charge specific components of the autonomous vacuum 100. The battery 126 may implement a battery optimization scheme to efficiently distribute power across the various components. The battery 126 may be rechargeable and can be recharged when the autonomous vacuum 100 is docked at the docking station 190.

The docking station 190 may be connected to an external power source to provide power to the battery 126. External power sources may include a household power source and one or more solar panels. The docking station 190 also may include processing, memory, and communication computing components that may be used to communicate with the autonomous vacuum 100 and/or a cloud computing infrastructure (e.g., via wired or wireless communication). These computing components may be used for firmware updates and/or communicating maintenance status. The docking station 190 may also include other components, such as a cleaning station for the autonomous vacuum 100. In some embodiments, the cleaning station includes a solvent tray that the autonomous vacuum 100 may spray solvent into and roll the roller 144 or the side brush roller 154 in the solvent tray for cleaning. In other embodiments, the autonomous vacuum may eject the waste bag 112 into a container located at the docking station 190 for a user to remove.

The connection assembly 130 is a rigid body that connects the cleaning head 140 to the chassis 110. A four-bar linkage may join the cleaning head 140 to the connection assembly 130. In some embodiments, the connection assembly 130 comprises a dry channel 132, one or more liquid channels 134, one or more pressure sensors 136, and an actuator assembly 138. Channel refers generally to either a dry channel or a liquid channel. The connection assembly 130 may comprise additional, fewer, or different components than those listed herein. For example, one or more sensors of the sensor system 118 may be disposed on the connection assembly 130.

The dry channel 132 is a conduit for conveying dry waste from the cleaning head 140 to the waste bag 112. The dry channel 132 is substantially large in diameter to permit movement of most household waste.

The one or more liquid channels 134 are conduits for conveying liquids between the cleaning head 140 and the chassis 110. There is at least one liquid channel 134 (a liquid waste channel) that carries liquid waste from the cleaning head 140 to the waste bag 112. In some embodiments, the liquid channel 134 carrying liquid waste may be smaller in diameter than the dry channel 132. In such embodiments, the autonomous vacuum 100 sweeps (collecting dry waste) before mopping (collecting liquid waste). There is at least one other liquid channel 134 (a liquid solution channel) that carries water, solvent, and/or cleaning solution (combination of water and solvent) from the chassis 110 to the cleaning head 140 for dispersal to the cleaning environment.

The one or more pressure sensors 136 measure pressure in one or more of the channels. The pressure sensors 136 may be located at various positions along the connection assembly 130. The pressure sensors 136 provide pressure measurements to the controller 124 for processing.

The actuator assembly 138 controls movement and position of the cleaning head 140, relative to the chassis 110. The actuator assembly 138 comprises one or more actuators configured to generate linear and/or rotational movement of the cleaning head 140. Linear movement may include vertical height of the cleaning head 140. Rotational movement may include pitching the cleaning head 140 to varying angles, e.g., to switch between sweeping mode and mopping mode, or to adjust cleaning by the cleaning head 140 based on detected feedback signals. The actuator assembly 138 may include a series of joints that aid in providing the movement to the cleaning head 140.

The actuator assembly 138 includes one or more actuators (henceforth referred to as an actuator for simplicity) and one or more controllers and/or processors (henceforth referred to as a controller for simplicity) that operate in conjunction with the sensor system 118 to control movement of the cleaning head 140. The sensor system 118 collects and uses sensor data to determine an optimal height for the cleaning head 140 given a surface type, surface height, and mess type.

Mess types are the form of mess (or waste) in the environment. Examples of messes (or waste) may include dirt, debris, dust, smudges, stains, and spills. They also include the type of phase the mess embodies, such as liquid, solid, semi-solid, or a combination of liquid and solid. Some examples of waste include bits of paper, popcorn, leaves, and particulate dust. A mess typically has a size/form factor that is relatively small compared to obstacles in the environment. For example, spilled dry cereal may be a mess but the bowl it came in would be an obstacle. Spilled liquid may be a mess, but the glass that held it may be an obstacle. However, if the glass broke into smaller pieces, the glass shards would then be a mess rather than an obstacle. Further, if the sensor system 118 determines that the autonomous vacuum 100 cannot properly clean up the glass, the glass may again be considered an obstacle, and the sensor system 118 may send a notification to a user indicating that there is a mess that needs user cleaning. The mess may be visually defined in some embodiments, e.g., in terms of visual characteristics. In other embodiments a mess may be defined by particle size or make up. When defined by size, in some embodiments, a mess and an obstacle may coincide. For example, a small interlocking brick piece may be the size of both a mess and an obstacle.

The actuator assembly 138 automatically adjusts the height of the cleaning head 140 given the surface type, surface height, and mess type. Surface types may be the floorings used in the environment and may include surfaces of varying characteristics (e.g., texture, material, absorbency), for example, carpet, wood, tile, rug, laminate, marble, and vinyl. In particular, the actuator controls vertical movement and rotation tilt of the cleaning head 140. The actuator may vertically actuate the cleaning head 140 based on instructions from the sensor system 118. For example, the actuator may adjust the cleaning head 140 to a higher height if the sensor system 118 detects thick carpet in the environment and may adjust the cleaning head 140 to a lower height if the sensor system 118 detects thin carpet. Further, the actuator may adjust the cleaning head 140 to a higher height for a solid waste spill than for a liquid waste spill.

The autonomous vacuum 100 may detect the height of obstructions and/or obstacles, and if an obstruction or obstacle is over a threshold size, the autonomous vacuum 100 may use the collected visual data to determine whether to climb or circumvent the obstruction or obstacle by adjusting the cleaning head 140 height using the actuator assembly 138. In some embodiments, the actuator may set the height of the cleaning head 140 to push larger messes out of the path of the autonomous vacuum 100. For example, if the autonomous vacuum 100 is blocked by a pile of books, the sensor system 118 may detect the obstruction (i.e., the pile of books) and the actuator may move the cleaning head 140 to the height of the lowest book, and the autonomous vacuum 100 may move the books out of the way to continue cleaning an area.

The cleaning head 140 performs cleaning operations to clean an environment. The cleaning head 140 is a rigid body that forms a cleaning cavity 142, where a sweeper roller 144 and a mop roller 148 are disposed. The cleaning head 140 further comprises a sweeper motor 146, a mop motor 150, a sprayer 152, a side brush roller 154, and a side brush motor 156. The cleaning head 140 may be referred to as a "roller housing." Collectively, the sweeper roller 144, the mop roller 148, and the side brush roller 154 are referred to as the "brush rollers." Likewise, the "brush motors" include the sweeper motor 146, the mop motor 150, and the side brush motor 156. In some embodiments, each brush roller may be composed of different materials and operate at different times and/or speeds, depending on a cleaning task being executed by the autonomous vacuum 100. The cleaning head 140 may include additional, fewer, or different components than those listed herein.

The sweeper roller 144 sweeps dry waste into the autonomous vacuum 100. The sweeper roller 144 generally comprises one or more brushes attached to a cylindrical core. The sweeper roller 144 rotates to collect and clean messes. The sweeper roller 144 may be used to handle large particle messes, such as food spills or small items like plastic bottle caps. When the sweeper roller 144 is activated by the sweeper motor 146, the brushes act in concert to sweep dry waste towards a dry inlet connected to the dry channel 132. The brushes may be composed of a compliant material to sweep the most dry waste. In some embodiments, the sweeper roller 144 may be composed of multiple materials for collecting a variety of waste, including synthetic bristle material, microfiber, wool, or felt.

The mop roller 148 mops the cleaning environment and ingests liquid waste into the autonomous vacuum 100. The mop roller 148 generally comprises fabric bristles attached to a cylindrical core. With the aid of a cleaning solution, the fabric bristles work to scrub away dirt, grease, or other contaminants that may have stuck to the cleaning surface. The mop motor 150 provides rotational force to the mop roller 148. In some embodiments, the mop roller 148 may be composed of multiple materials for collecting a variety of waste, including synthetic bristle material, microfiber, wool, or felt.

In normal sweeping mode, as the air flows from the dry channel 132 and the dry inlet towards the vacuum pump 120, the sweeper roller 144 rotates to move dry waste from the cleaning environment towards the inlet, in order to deposit the dry waste in the waste bag 112. In normal mopping mode, the cleaning head 140 sprays the cleaning solution (water, solvent, or solvent mixed with water) onto the cleaning environment or on top of the mop roller 148 itself. The mop roller 148 contacts the sprayed surface to scrub the surface with the fabric bristles. The vacuum force sucks up or ingests the liquid waste to deposit the liquid waste into the waste bag 112.

The side brush roller 154 sweeps dirt near a side of the cleaning head 140. The side brush roller 154 may rotate along an axis that is orthogonal or perpendicular to the ground. The side brush is controlled by a side brush motor 156. The side brush roller 154 may be shaped like a disk or a radial arrangement of bristles that can push dirt into the path of the sweeper roller 144. In some embodiments, the side brush roller 154 is composed of different materials than the sweeper roller 144 to handle different types of waste and mess. The side brush roller 154 may be concealed to minimize a profile of the cleaning head 140 when the side brush roller 154 is not in use.

The sprayer 152 sprays liquid into the cleaning environment. The sprayer 152 is connected to the liquid solution channel 134 that is connected to the solvent tank 114 and/or the water tank 116. A pump on the chassis 110 can dispense solvent and/or water from the solvent tank 114 and/or the water tank 116. The liquid travels to the sprayer 152, which then has a nozzle for spraying the liquid into the cleaning environment. The sprayer 152 may include a plurality of nozzles, e.g., two disposed on either side of the cleaning head 140.

The cleaning head 140 ingests waste 170 as the autonomous vacuum 100 cleans using the sweeper roller 144 and the side brush roller 154 and sends the waste 170 to the waste bag 112. The waste bag 112 collects and filters waste 170 from the air to send filtered air 175 out of the autonomous vacuum 100 through the vacuum pump 120 as air exhaust 180. The autonomous vacuum 100 may also use solvent 160 combined with pressure from the cleaning head 140 to clean a variety of surface types. The autonomous vacuum 100 may dispense solvent 160 from the solvent tank 114 onto an area to remove dirt, such as dust, stains, and solid waste and/or clean up liquid waste. The autonomous vacuum 100 may also dispense solvent 160 into a separate solvent tray, which may be part of a charging station (e.g., docking station 190), to clean the roller 144 and the side brush roller 154.

In other embodiments, any of the components of the autonomous vacuum can be variably distributed among the chassis 110, the connection assembly 130, and the cleaning head 140.

Figure 2:
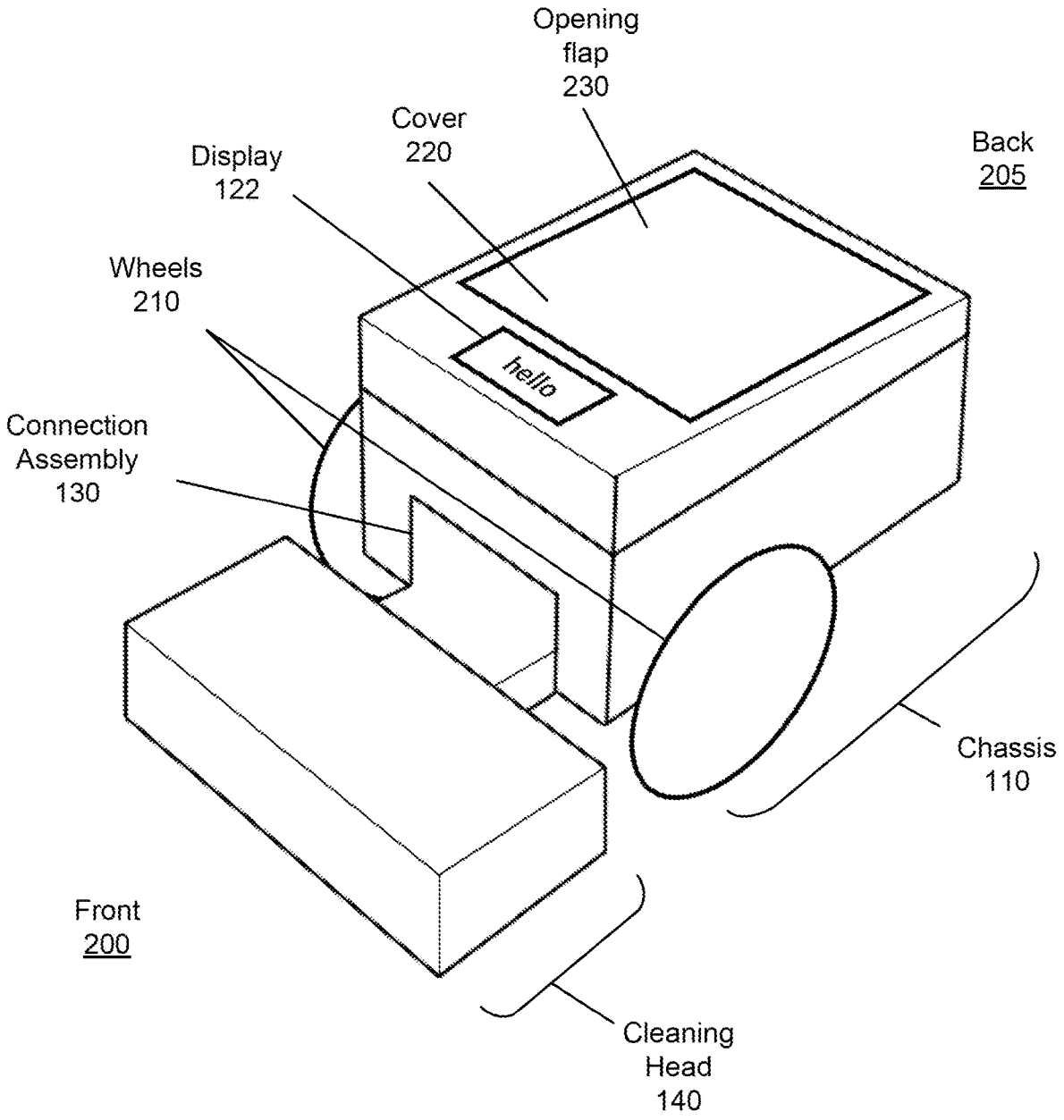
FIG. 2 illustrates a spatial arrangement of components of the autonomous vacuum, according to one example embodiment

FIG. 2 illustrates a spatial arrangement of components of the autonomous vacuum 100, according to one example embodiment. The autonomous vacuum 100 includes the cleaning head 140 (as described in relation to FIG. 1) at the front 200 and the chassis 110 at the back 205. The cleaning head 140 may be connected to the chassis 110 via the connection assembly 130 (e.g., a four-bar linkage system). The connection assembly 130 may be connected to one or more actuators of the actuator assembly 138 such that the actuators can control movement of the cleaning head 140 with the four-bar linkage system.

The chassis 110 includes the frame, a plurality of wheels 210, a cover 220, an opening flap 230, and a display 122. The cover 220 is an enclosed hollow structure that covers containers internal to the base that contain solvent and waste (e.g., in the waste bag 112). The opening flap 230 may be opened or closed by a user to access the containers (e.g., to add more solvent, remove the waste bag 112, or put in a new waste bag 112). The cover may also house a subset of the sensors of the sensor system 118 and the actuator assembly 138, which may be configured at a front of the cover 220 to connect to the cleaning head 140. The display 122 is embedded in the cover 220 of the autonomous vacuum 100 and may include physical interface buttons and a touch sensitive interface.

Figure 3:
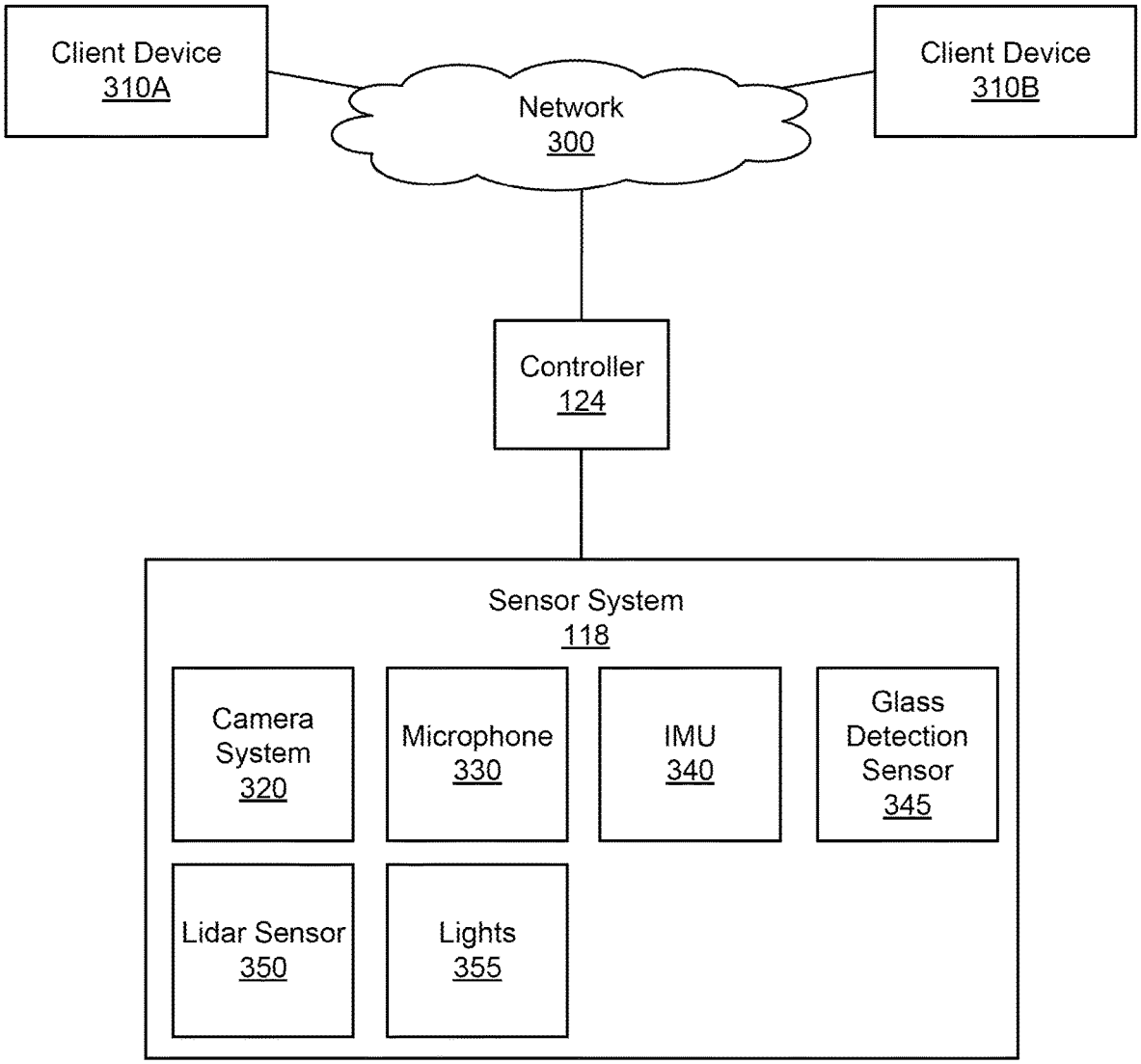
FIG. 3 is a block diagram of a sensor system of the autonomous vacuum, according to one example embodiment.

FIG. 3 is a block diagram of the sensor system 118 of the autonomous vacuum 100, according to one example embodiment. The sensor system 118 may receive sensor data from one or more cameras (video/visual), microphones 330 (audio), lidar sensors, infrared (IR) sensors, and/or inertial sensors that capture inertial data (e.g., environmental surrounding or environment sensor data) about an environment for cleaning. The sensor system 118 uses the sensor data to map the environment and determine and execute cleaning tasks to handle a variety of messes. The controller 124 manages operations of the sensor system 118 and its various components. The controller 124 may communicate with one or more client devices 310 via a network 300 to send sensor data, alert a user to messes, or receive cleaning tasks to add to a task list.

The network 300 may comprise any combination of local area and/or wide area networks, using wired and/or wireless communication systems. In one embodiment, the network 300 uses standard communications technologies and/or protocols. For example, the network 300 includes communication links using technologies such as Ethernet, 802.11 (WiFi), worldwide interoperability for microwave access (WiMAX), 3G, 4G, 5G, code division multiple access (CDMA), digital subscriber line (DSL), Bluetooth, Near Field Communication (NFC), Universal Serial Bus (USB), or any combination of protocols. In some embodiments, all or some of the communication links of the network 300 may be encrypted using any suitable technique or techniques.

The client device 310 is a computing device capable of receiving user input as well as transmitting and/or receiving data via the network 300. Though only two client devices 310 are shown in FIG. 3 (i.e., 310A and 310B), in some embodiments, more or fewer client devices 310 may be connected to the autonomous vacuum 100. In one embodiment, a client device 310 is a conventional computer system, such as a desktop or a laptop computer. Alternatively, a client device 310 may be a device having computer functionality, such as a personal digital assistant (PDA), a mobile telephone, a smartphone, a tablet, an Internet of Things (IoT) device, or another suitable device. A client device 310 is configured to communicate via the network 300. In one embodiment, a client device 310 executes an application allowing a user of the client device 310 to interact with the sensor system 118 to view sensor data, receive alerts, set cleaning settings, and add cleaning tasks to a task list for the autonomous vacuum 100 to complete, among other interactions. For example, a client device 310 executes a browser application with an application programming interface (API) that enables interactions between the client device 310 and the autonomous vacuum 100 via the network 300. In another embodiment, a client device 310 interacts with autonomous vacuum 100 through an application running on a native operating system of the client device 310, such as iOS® or ANDROID™.

In some embodiments, the sensor system 118 includes a camera system 320, microphone 330, inertial measurement device (IMU) 340, a glass detection sensor 345, a lidar sensor 350, and lights 355.

The camera system 320 comprises one or more cameras that capture visual data about the environment (e.g., in the form of images and/or video signals). In some embodiments, the camera system 320 includes an IMU (separate from the IMU 340 of the sensor system 118) for capturing visual-inertial data in conjunction with the cameras. The visual data captured by the camera system 320 may be used for image processing.

The microphone 330 captures audio data by converting sound into electrical signals that can be stored or processed by other components of the sensor system 118. The audio data may be processed to identify voice commands for controlling functions of the autonomous vacuum 100. In one embodiment, sensor system 118 uses more than one microphone 330, such as an array of microphones.

The IMU 340 captures inertial data describing the autonomous vacuum's 100 force, angular rate, and orientation. The IMU 340 may include one or more accelerometers, gyroscopes, and/or magnetometers. In some embodiments, the sensor system 118 employs multiple IMUs 340 to capture a range of inertial data that can be combined to determine a more precise measurement of the autonomous vacuum's 100 position in the environment.

The glass detection sensor 345 detects glass in the environment. Glass may be transparent material that may be stained, leaded, laminate or the like and may be part of furniture, flooring, or other objects in the environment (e.g., cups, mirrors, candlesticks, etc.). The glass detection sensor 345 may be an infrared sensor and/or an ultrasound sensor. In some embodiments, the glass detection sensor 345 is coupled with the camera system 320 to remove glare from the visual data when glass is detected. For example, the camera system 320 may have integrated polarizing filters that can be applied to the cameras of the camera system 320 to remove glare. In some embodiments, the glass sensor is a combination of an IR sensor and neural network that determines if an obstacle in the environment is transparent (e.g., glass) or opaque.

The lidar sensor 350 emits pulsed light into the environment and detects reflections of the pulsed light on objects (e.g., obstacles or obstructions) in the environment. Lidar data captured by the lidar sensor 350 may be used to determine a 3D representation of the environment.

The lights 355 are one or more illumination sources that may be used by the autonomous vacuum 100 to illuminate an area around the autonomous vacuum 100. In some embodiments, the lights may be LEDs, e.g., having a static color such as white or green, or changeable colors (such as green of operating, red for stopped and yellow indicating slowing down).

Figure 4:
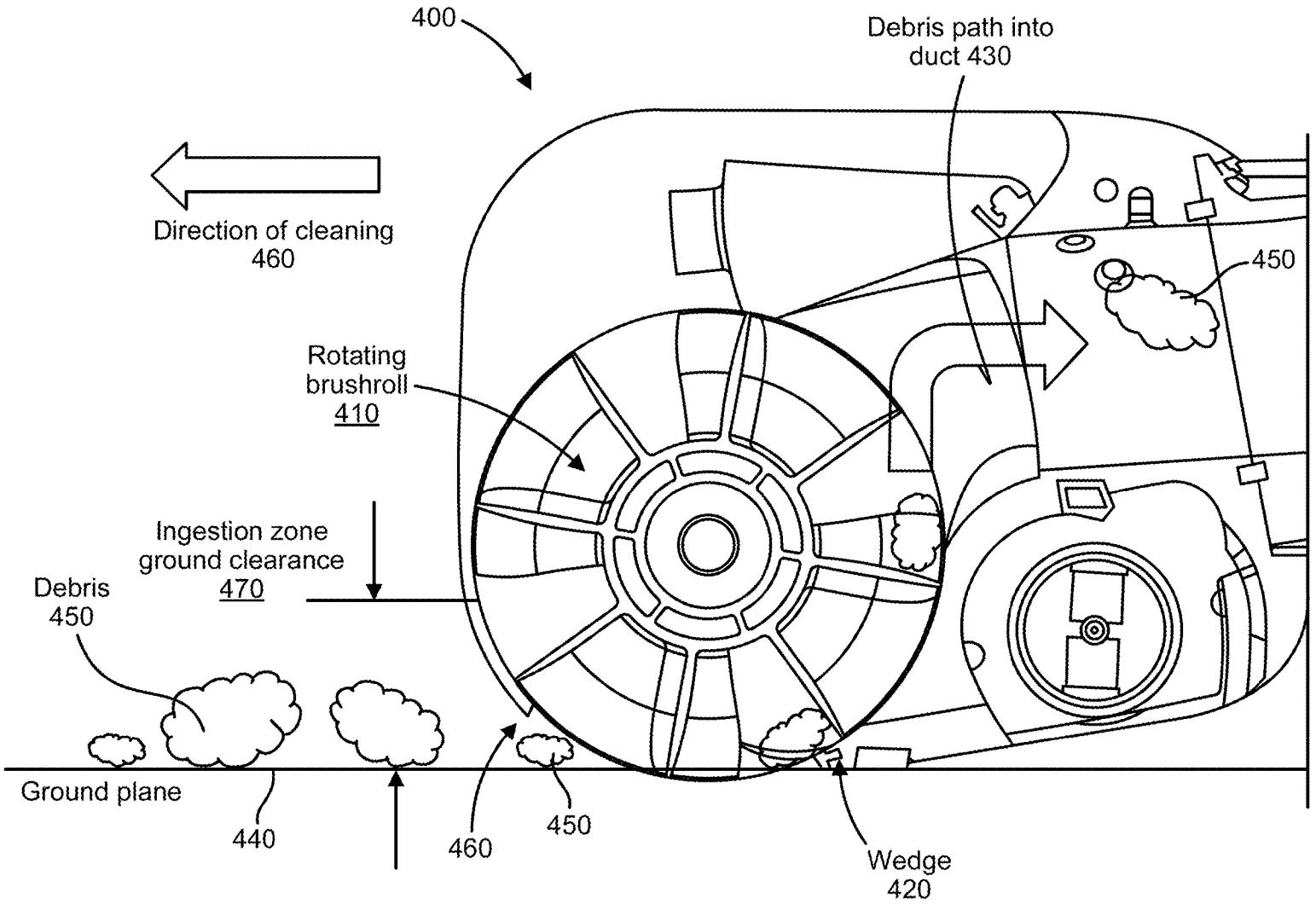
FIG. 4 depicts a debris ingestion area of a cleaning system, in accordance with one embodiment.

FIG. 4 depicts a debris ingestion area of a cleaning system, in accordance with one embodiment. The cleaning system may include an autonomous vacuum. The cleaning system includes a cleaning head 400, a brush roller 410, and a wedge 420. The brush roller 410 is described in greater detail with respect to FIGS. 6-27. In particular, a general structure of the brush roller 410 is described with respect to FIGS. 6-19 and a hair removal structure of the brush roller 410 and a process for removing hair from the brush roller is described with respect to FIGS. 20-27. The wedge 420 is described in greater detail with respect to FIGS. 28-34. Although not depicted, the cleaning head 400 may also include a side brush, which is described in greater detail with respect to FIGS. 35 and 43.

The cleaning head 400 travels in a direction 460 of cleaning along a ground plane 440, encountering the debris 450 from the environment. The debris 450 enters the cleaning head 400 at an ingestion opening 460 proximal to the brush roller 410. The ingestion opening 460 has a ground clearance 470 corresponding to a maximum height at which the debris 450 may be sized to enter the cleaning head 400. The outer diameter (e.g., as measured at the tips of the flaps) and the inner core diameter (e.g., as measured at the outer radius of the body of the inner core) of the brush roller 410 may correspond to a maximum vertical gap at which debris 450 (e.g., solid, non-malleable debris) may be sized to enter the cleaning head 400. The debris is migrated by a rotating brush roller 410 and transported through a pathway 430 to a container within the cleaning system for debris. Although this container is not depicted in FIG. 4, the container may be a component of the cleaning system described herein.

Figure 5:
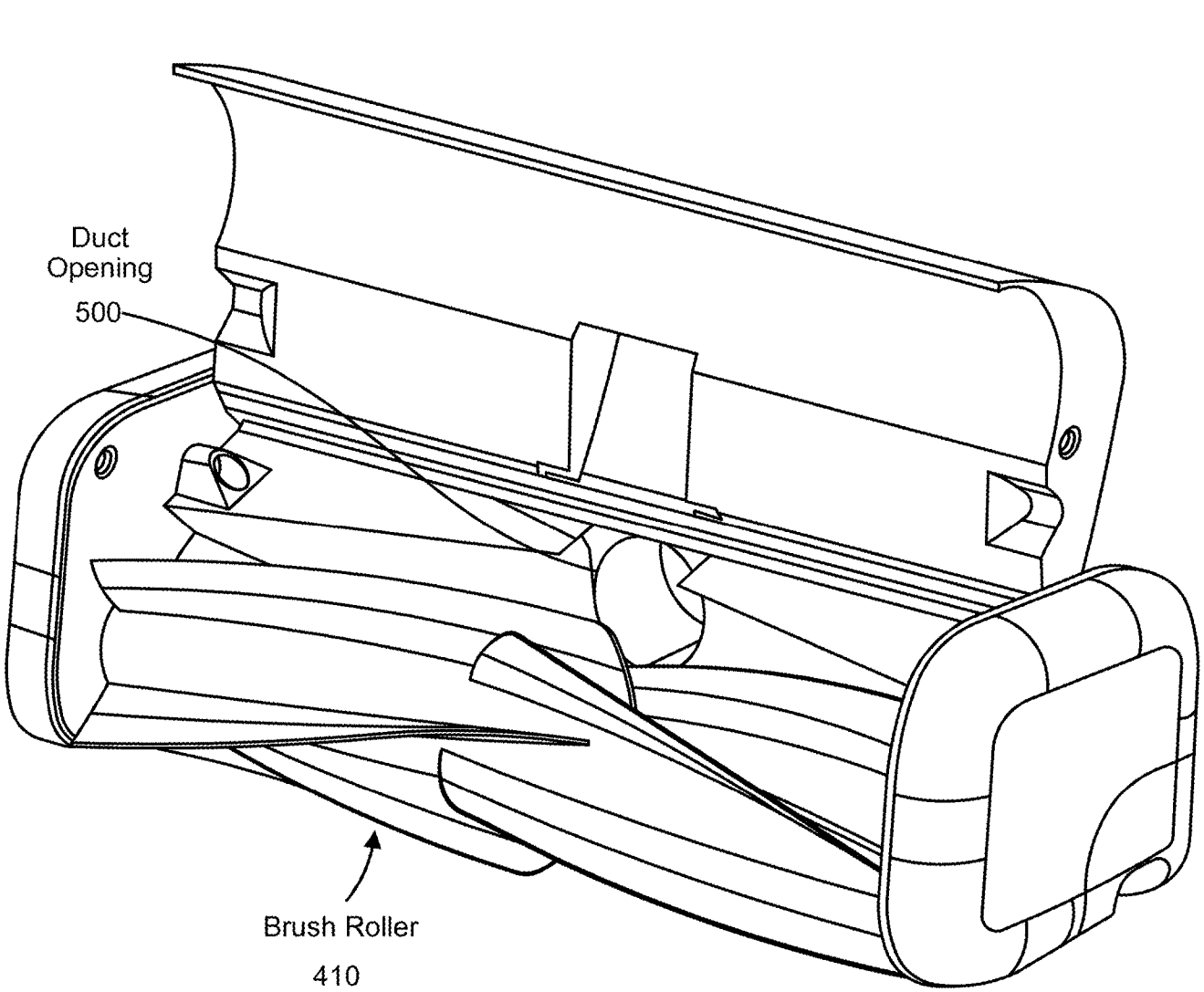
FIG. 5 depicts an isometric view of the cleaning head of FIG. 4, in accordance with one embodiment.

The cleaning head 400 may be coupled to a brush roller 410 that allows for movement of debris 450 through a pathway 430. Flaps of the brush roller 410 are configured to cause debris 450 to move towards an opening of the pathway 430. The brush roller 410 is configured to be unlocked from a cleaning orientation without requiring excessive force or disassembly by a user. The brush roller 410 is in a cleaning orientation when the brush roller is locked at two or more contact points between the brush roller and an inner surface of the cleaning head. For example, FIGS. 4 and 5 depict the brush roller 410 in a cleaning orientation.

Furthermore, the cleaning system allows for avoiding increased friction caused by the intake of fibrous debris that wraps around the brush roller 410. In conventional cleaning systems having brush rollers, fibrous debris wraps around the brush roller and causes increased friction at one or more points of contact between the rotating brush roller and a stationary surface of the cleaning system. In particular, fibrous debris can bind around a rotating location of the brush roller 410 and consequently, increase the likelihood that the brush roller 410 is unseated or the rotation of the brush roller 410 is jammed. The cleaning head 400 includes one or more guards configured to prevent fibrous debris from contacting stationary surfaces of the cleaning system and consequently, prevents the increase of friction at one or more points of contact with the stationary surfaces. The guards may also be referred to herein as "hair guards" or "fiber guards." Additionally, the brush roller 410 may include one or more buffer zones configured to receive and store fibrous debris that are prevented by the guards from contacting a stationary surface of the cleaning system.

Additionally, the cleaning head 400 and the brush roller 410 allow for removal of fibrous debris. For example, the cleaning head 400 and brush roller 410 are configured to enable fibrous debris to be suctioned from the one or more buffer zones into the pathway 430. The brush roller 410 can be unlocked from the cleaning orientation, enabling the fibrous debris at the one or more buffer zones to be exposed to the pathway 430 for removal of debris (e.g., into a compartment of the cleaning system for debris storage).

The wedge 420 of the cleaning head allows for debris to be led by the brush roller 410 into a duct opening (e.g., rather than becoming accumulated in a space within the cleaning head 400 contacting the surface to be cleaned). The wedge 420 seals a debris ingestion cavity of the cleaning head 400 (e.g., the space where the brush roller 410 operates to move debris into a duct opening) from a surface being cleaned. The wedge 420 has a leading edge that is pointed, where a leading edge is a frontmost portion of the cleaning system that contacts a surface to be cleaned. Conventional cleaning systems may have a leading edge that is prone to digging into carpets and angled improperly to slide over debris rather than encouraging debris from a surface to enter the duct opening of the cleaning head. Additionally, conventional cleaning systems may have wedges that cause debris to become accumulated and dragged against a surface as the cleaning system moves around an environment. To move this accumulated debris, conventional cleaning systems may exert a greater airflow and brush roller rotational speed, which both create loud noise, consume excessive power, and require costly motor systems. The wedge 420 is shaped similar to a plough to avoid this debris accumulation. Furthermore, the wedge 420 includes a strip of compliant material (e.g., fine bristles, foam strips, elastomeric structures, etc.) to reduce the likelihood of being damaged by coarsely textured floors (e.g., from carpets or small stones).

FIG. 5 depicts an isometric view of the cleaning head 400 of FIG. 4, in accordance with one embodiment. A top portion of the cleaning head 400 is depicted as lifted to show a clearer view of the brush roller 410 and a duct opening 500 at which the pathway 430 begins. During operation of the cleaning head 400 (i.e., when a suction motor of the cleaning system is active and the cleaning head is ingesting debris), the top portion of the cleaning head 400 may be closed to encourage debris to enter the duct opening 500. The brush roller 410 is depicted in FIG. 5 as being in a cleaning orientation where the brush roller 410 is locked within the cleaning head 400. For example, the two bases of the cylindrical brush roller 410 may contact opposite inner surfaces of the cleaning head 400. The two bases may be locked with the inner surfaces of the brush roller 410 through magnetic, mechanical, spring force assistance, or any suitable combination thereof.

Figure 6:
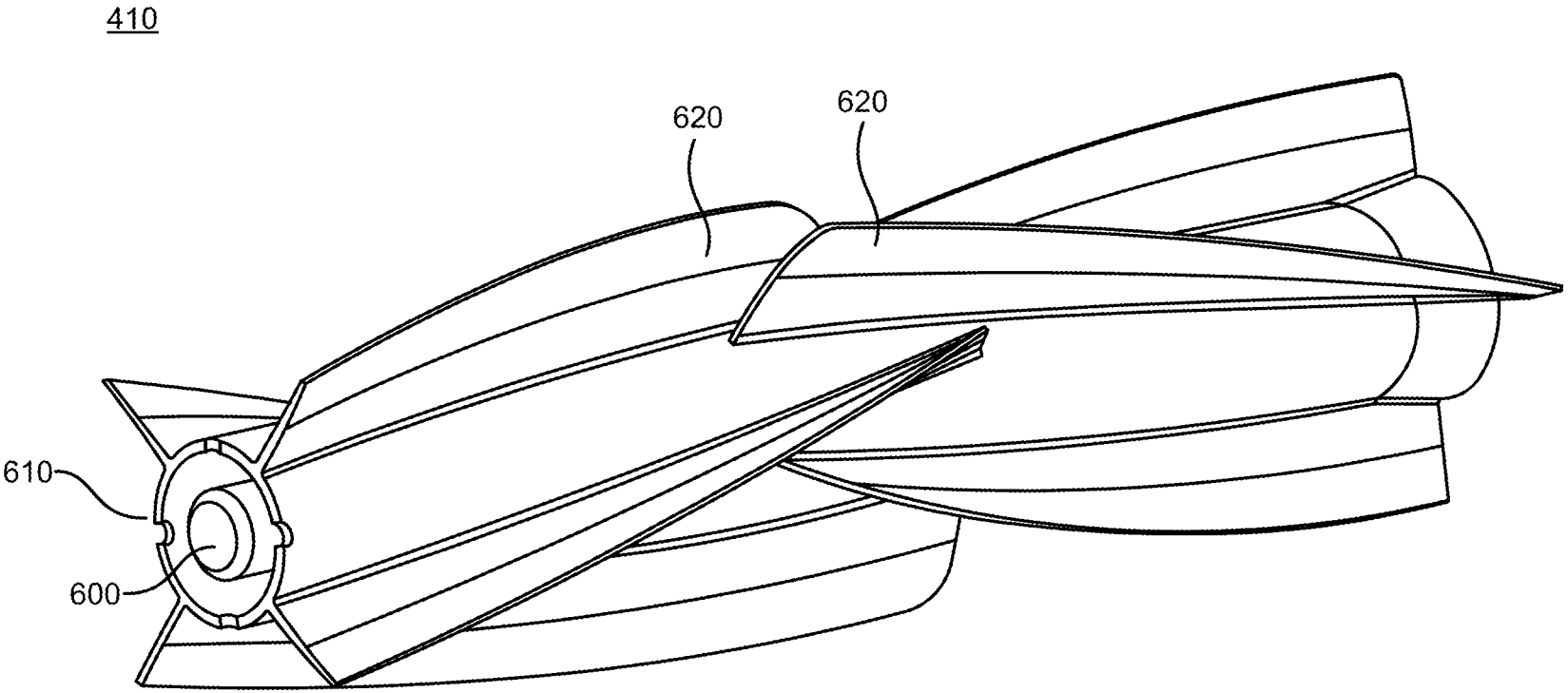
FIG. 6 depicts an isometric view of the brush roller of FIG. 4, in accordance with one embodiment.

FIG. 6 depicts an isometric view of the brush roller 410 of FIG. 4, in accordance with one embodiment. The brush roller 410 includes an inner core 600, an outer core 610, and flaps 620. The inner core 600 and the outer core 610 may both be cylindrical in shape. For example, the inner core 600 and the outer core 610 may include respective tubes. The inner core 600 may be concentric with the outer core 610 and located within the outer core 610.

A surface of the outer core 610 includes a length and a first end and a second end. The flaps 620 can include a first length and a second length. The first length aligns along an exterior surface of the outer core 610. For example, a flap 620 may couple at a first edge (e.g., leading edge) with the first end of the surface of the outer core 610 and a second edge (e.g., trailing edge) of the flap may couple approximately within a middle of the surface of the outer core 610. Further, a second edge of one flap 620 and a second edge of another flap 620 may overlap within a middle region of the outer surface of the outer core 610. Further, each flap 620 may be positioned so that the first edge of the flap 620 may be in an offset position from the second edge of the flap 620 thereby creating a wave pattern with the offsets. The second length of each flap is opposite the first length and extends outward so that during operation of the brush roller 410 the second length of a flap 620 may be close to a surface. The flap 620 may be a unitary piece extending from the surface of the outer 610. Alternatively, or additionally, the flap 620 may be a second piece securely coupled with the outer surface of the outer core (e.g., glued or molded). The second length of the flaps 620 on the brush roller 410 may direct debris towards the duct opening 500 as the cleaning system is in operation to clean an environment.

Figure 7:
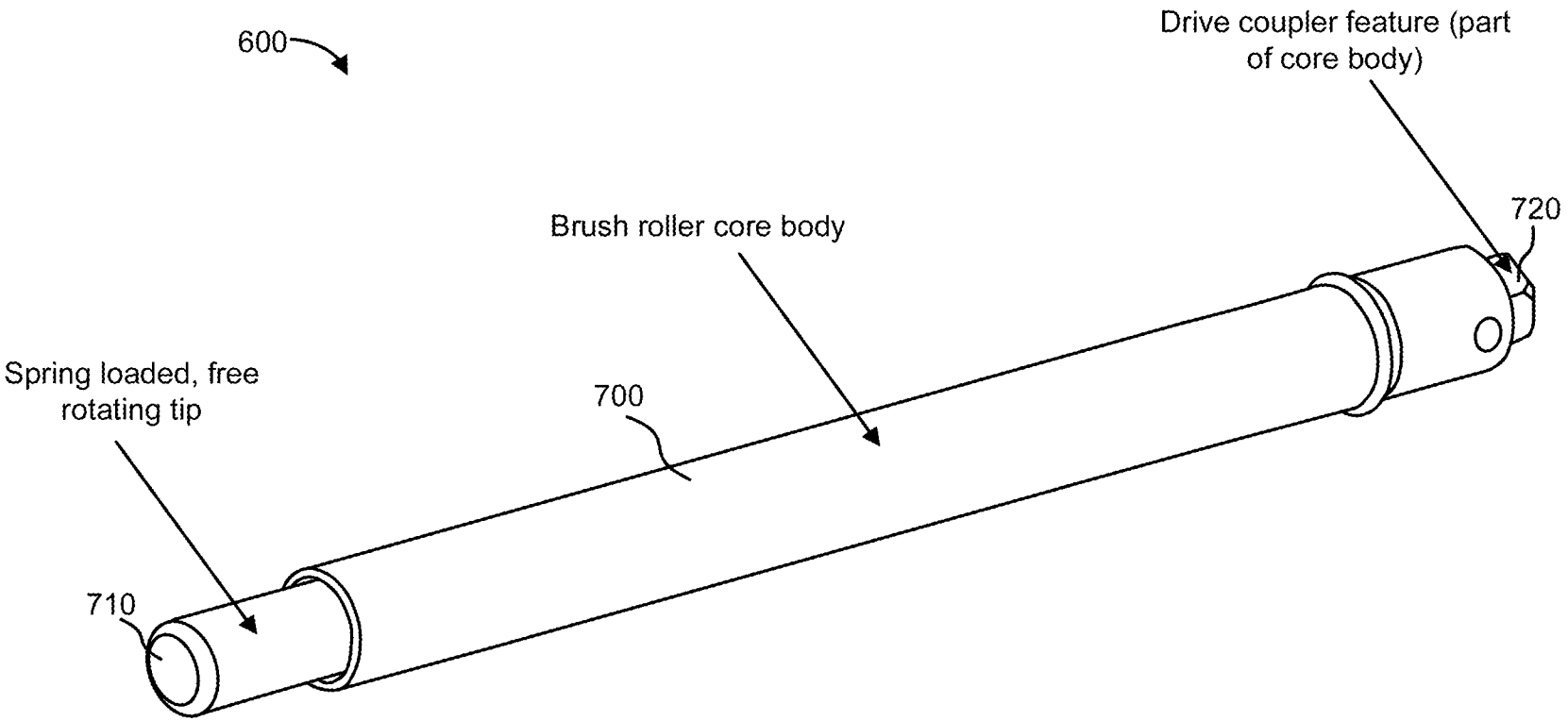
FIG. 7 depicts an inner core of a brush roller, in accordance with one embodiment.

FIG. 7 depicts an inner core 600 of the brush roller 410, in accordance with one embodiment. The inner core 600 includes a body 700 and has a first end and a second end. The body 700 of the inner core 600 is cylindrical. In some embodiments, the body 700 can be insertable within an interior of the outer core 610 and may secure the inner core 600 with the outer core 610. The first end of the inner core 600 may include a tip 710. The second end of the inner core 600 may include a drive coupler 720. The body 700 may have a radius greater than that of the tip 710. The tip 710 may be a spring-loaded, free rotating tip that is configured to fit inside the body 700 at least partially. The drive coupler 720 may be an extension of the body 700 (e.g., manufactured as a single component) or an attachment to the body 700. The tip 710 may also be referred to interchangeably as an "end tip."

The first and second ends of the inner core 600 may couple with respective structures of the cleaning head 400. For example, the tip 710 at the first end of the inner core 600 may couple with a recession in the inner surface of the cleaning head 400. A user can couple and/or decouple the tip 710 to the cleaning head 400. This coupling is further described with respect to FIG. 10. Additionally, the drive coupler 720 at the second end of the inner core 600 may couple with a drive pinion at the cleaning head 400. A user can couple and/or decouple the drive coupler 720 to the drive pinion. This coupling is further described with respect to FIGS. 9 and 24.

Figure 8:
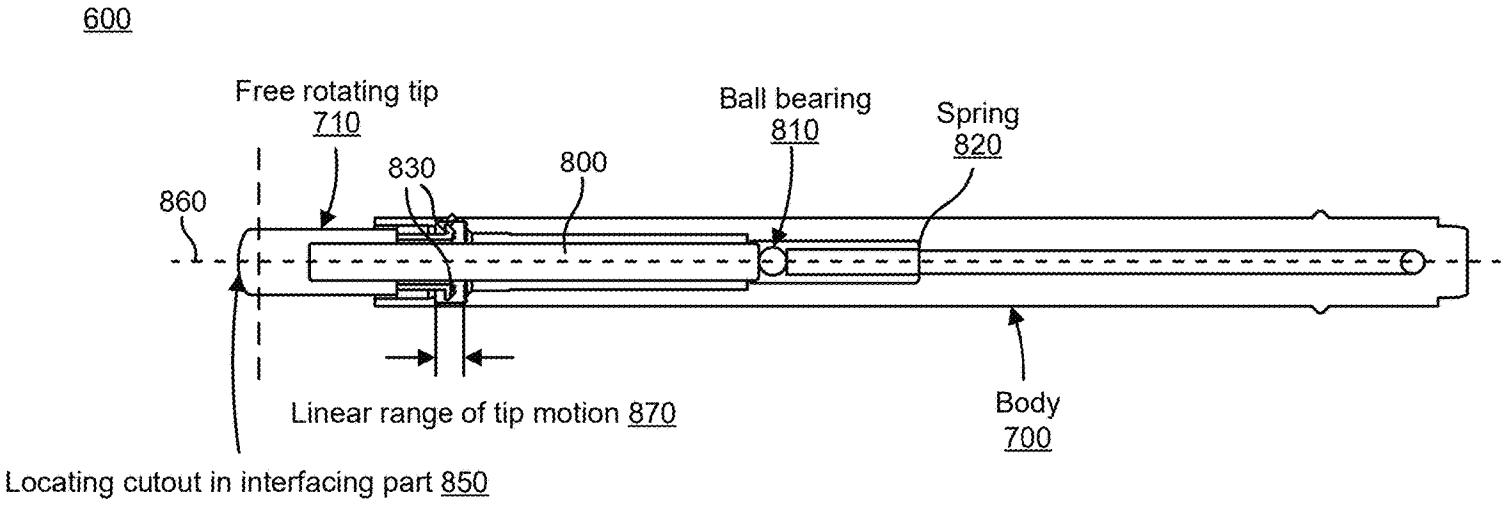
FIG. 8 depicts a cross section of the inner core of FIG. 6, in accordance with one embodiment.

FIG. 8 depicts a cross section of the inner core 600 of FIG. 6, in accordance with one embodiment. The inner core 600 is configured to at least partially house a pin 800, a ball bearing 810, a spring 820, and a locking mechanism 830. The pin 800, the ball bearing 810, the spring 820, and the tip 710 may be coaxial with the body 700 along a center axis 860. The ball bearing 810, the spring 820, and the locking mechanism 830 may be fully housed within the inner core 600. A first end of the pin 800 is coupled to the tip 710 and configured to contact the ball bearing 810. The pin 800 may be cylindrical in shape. The locking mechanism 830 may be attached towards an approximately center region of the pin 800. The inner surface of inner core 600 can include a recession enabling a linear motion of the pin 800 and the end tip 710 within a range 870 of 0.5 to 30 millimeters (mm). The linear motion may be parallel with the central axis of the inner core 600. When the brush roller 410 is positioned in a cleaning orientation, the end tip 710 may be compressed by an inner surface of the cleaning head 400 into the linear range 870 of motion such that the locking mechanism 830 does not rub against the inner surface of the body 700.

The ball bearing 810 may be configured to contact the spring 820. The ball bearing 810 may be located between the spring 820 and the pin 800. In alternative embodiments, a bearing spike may be used in place of the ball bearing 810. The ball bearing 810 can create a low-friction point contact with the pin 800. The ball bearing 810 may rotate with respect to the pin 800 along with other components of the brush roller 410 (e.g., the spring 820). In some embodiments, the pin 800 and the tip 710 may move independent of each other while the brush roller 410 is rotating due to force provided by a drive pinion. For example, the drive pinion may rotate the outer core 610, the flaps 620, the body 700 of the inner core 600, the spring 820 (due to a contact between the spring 820 and the inner surface of the body 700), and the ball bearing 810 (due to a contact between the ball bearing 810 and the spring 820). However, the force exerted by the drive pinion may not extend through the contact between the ball bearing 810 and the pin 800 such that the pin 800 can freely rotate with respect to the ball bearing 810 or the pin 800 may be stationary with respect to the ball bearing 810.

The spring 820 is configured to contact an inner surface of the inner core 600 (e.g., the inner core 600 includes a tube and the spring 820 contacts the inner surface of the tube). The spring 820 may be configured to be located proximal to the center of the inner core 600. Additionally, the spring 820 may be configured to be the innermost component housed in the inner core 600. The spring 820 may be a wire helix, a formed metal or plastic component, magnet pair, any suitable compressible element, or combination thereof. The spring 820 may provide adequate force so as to bias the spring 820 towards the outboard end of the linear range 870 when the brush roller 410 is not inserted between inner surfaces of the cleaning head 400. The spring 820 may be sufficiently flexible to reduce a force required for insertion (e.g., by a user) of the brush roller 410 in between the inner surfaces of the cleaning head 400.

One end of the tip 710 may include a locating cutout 850, where the locating cutout 850 is configured to interface with an inner surface of the cleaning head 400 to engage the tip 710 to the inner surface. The locating cutout 850 may be a rotationally locating cutout (e.g., the cutout 850 is structured to rotate about a center axis of the inner core 600 while the tip 710 and the pin 800 are coupled to the body 700 via the locking mechanism 830). For example, the locating cutout 850 fits into a recess in the inner surface of the cleaning head 400 such that the tip 710 is secured against the inner surface but for a sufficient force to pull the locating cut out 850 from its position against the inner surface. In some embodiments, the tip 710 may be secured against the inner surface such that the tip 710 may not be displaced horizontally or vertically but for the sufficient force, but may rotate about a center axis of the inner core 600 freely.

Figure 9:
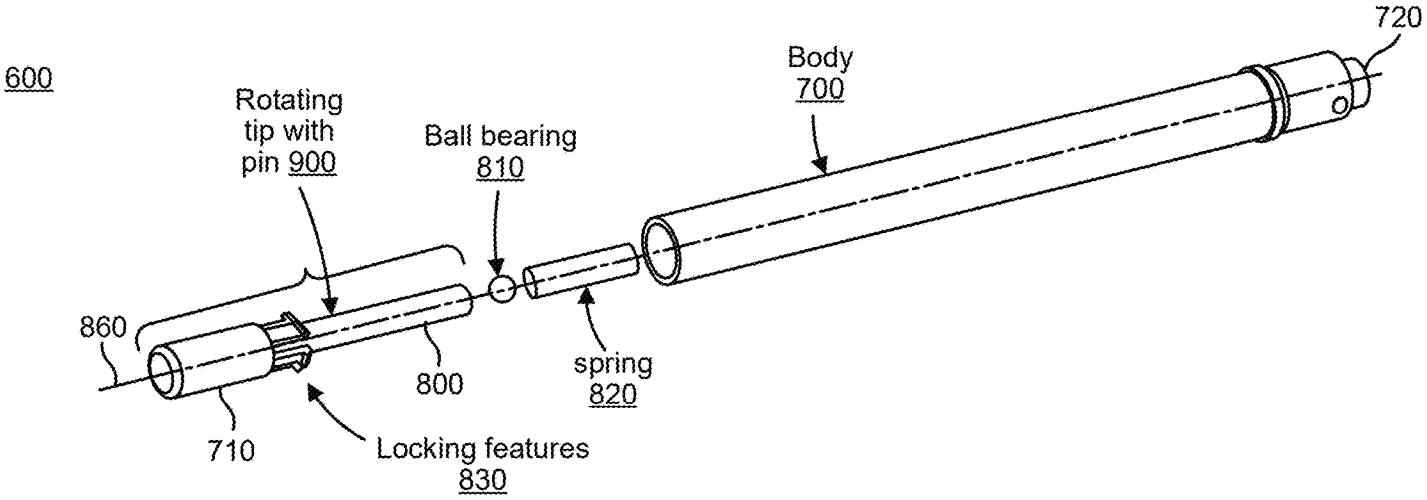
FIG. 9 depicts an exploded view of the inner core of FIG. 6, in accordance with one embodiment.

FIG. 9 depicts an exploded view of the inner core 600 of FIG. 6, in accordance with one embodiment. The tip 710 and the pin 800 may be connected to form a pin-tip assembly 900. In some embodiments, the assembly process of the inner core 600 includes the manufacture of the body 700, which includes a cavity into which the spring 820, the ball bearing 810, and the pin-tip assembly 900 are inserted. In some embodiments, the pin-tip assembly 900 may only contact the ball bearing 810, the body 700 (e.g., at the tip 710 and the locking mechanism 830), and when the brush roller 410 is in a cleaning orientation, an inner surface of the cleaning head 400. The drive coupler 720 may couple with a driving pinion of the cleaning head 400 and permit 2-20 degrees of misalignment from the center axis 860. The misalignment may be achieved through clearances, drafts and arcs, or by compliance of the materials of the drive coupler 720. The misalignment may facilitate removal and insertion of the brush roller 410 in an ingestion cavity of the cleaning head 400 (i.e., a space within the cleaning head 400 where debris is ingested).

Figure 10:
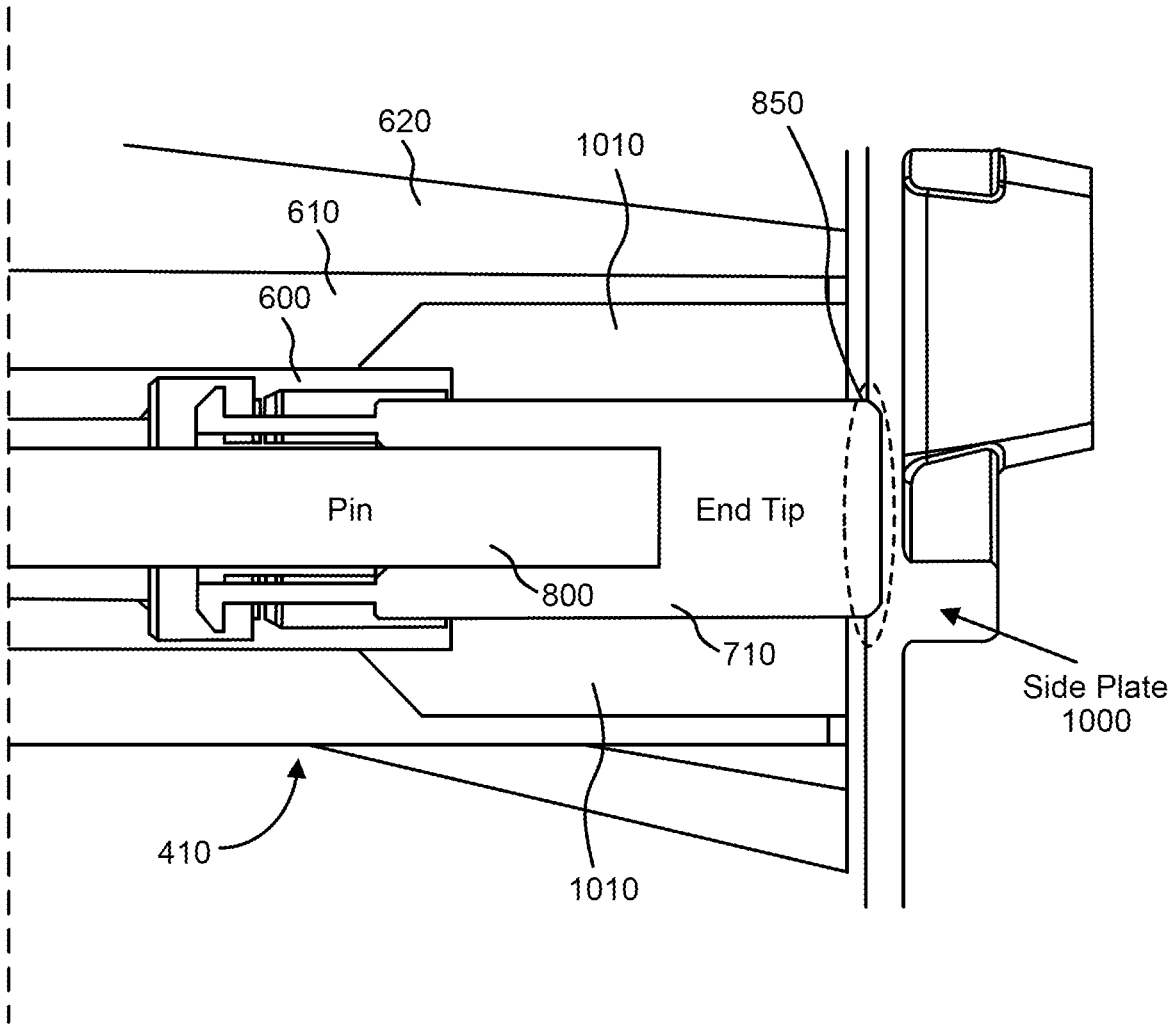
FIG. 10 depicts a contact between a locating cutout and a side plate, in accordance with one embodiment.

FIG. 10 depicts a contact between a locating cutout 850 and a side plate 1000, in accordance with one embodiment. The side plate 1000 may include a recess that is configured to couple with the locating cutout 850. The contact may be magnetic, spring force assisted, or a combination thereof. The side plate 1000 may be included in the cleaning head 400. The end tip 710 may be housed within the outer core 610. The inner surface of the outer core 610 may be recessed to enable one or more buffer zones 1010 at the brush roller 410. The one or more buffer zones 1010 may be shaped as a cylindrical toroid such that a buffer zone 1010 is located around the pin 800 and the end tip 710. The cylindrical toroid of the one or more buffer zones 1010 may be coaxial with the cylindrical shapes of the pin 800 and the end tip 710. The buffer zones 1010 may be used to receive and store fibrous debris that the cleaning head 400 intakes from the environment. The process of cleaning fibrous debris from the environment using the brush roller 410 is described further in the descriptions of FIGS. 20-27.

Figure 11:
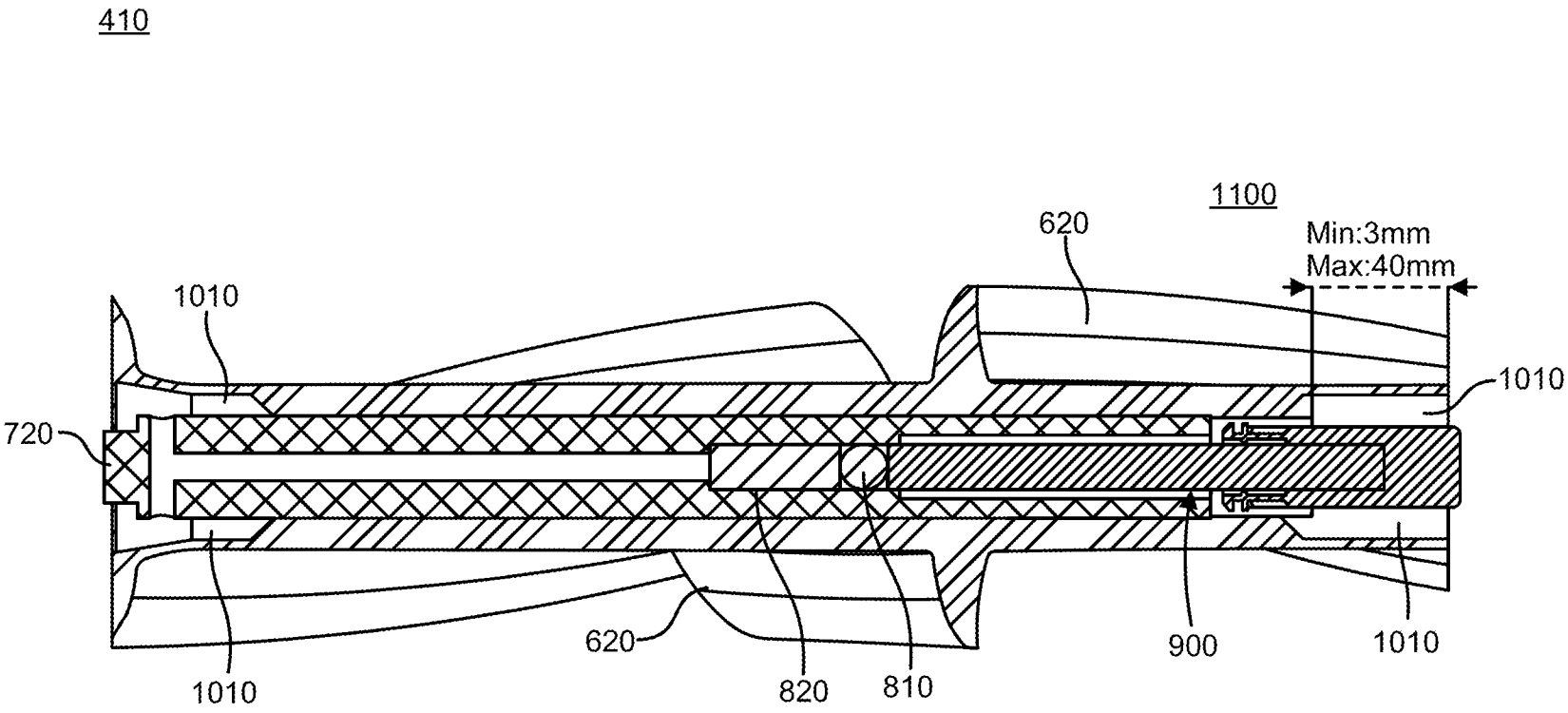
FIG. 11 depicts a cross section view of a brush roller, in accordance with one embodiment.

FIG. 11 depicts a cross section view of the brush roller 410, in accordance with one embodiment. The brush roller 410 may include the buffer zones 1010 at both ends. The drive coupler 720 may be located at a first end of the brush roller 410. The drive coupler 720 may contact a drive pinion, and force from the drive pinion may cause the body 700 of the brush roller 410 to rotate about a central axis of the brush roller 410. The spring 820 and the ball bearing 810 may similarly rotate due to force from the drive pinion. The length 1100 of the end tip 710 may be within a range of 3-40 mm. The buffer zone 1010 proximal to the end tip 710 may have a length equal to the length 1100. The buffer zones 1010 located at opposite ends of the brush roller 410 may be different lengths.

The pin-tip assembly 900 may be stationary or free-rotating relative to the rotating components of the brush roller 410 (e.g., the drive coupler 720, the body 700, the spring 820, the ball bearing 810, the outer core 610, and the flags 620). The pin-tip assembly 900 enables a reduced rotational friction when the brush roller 410 is in operation. As fibrous debris wraps around the rotating brush roller 410, the fibrous debris will wrap around a portion of the brush roller 410 with a smaller diameter. The end tip 710 has a smaller diameter than the diameter of the outer core 610. If the end tip 710 was also rotating, the fibrous debris would likely wrap and tighten around the end tip 710, causing an increase in friction. Alternatively, if the end tip 710 was rotating, the fibrous debris could also tighten into a small ball and get in between the end tip 710 and the side plate. In these instances, the fibrous debris may cause the brush roller to dislodge from the side plate and interrupt the autonomous vacuum's cleaning session. However, because the end tip 710 does not rotate, the end tip 710 does not provide a driving force for fibrous debris to tighten around the end tip 710. Thus, the stationary end tip 710 reduces friction during operation of the brush roller 410. Furthermore, the stationary end tip 710 reduces the likelihood of fibrous debris becoming caught in between the end tip 710 and the side plate 1000, which consequently reduces friction caused by fibrous debris at that point.

Figure 12:
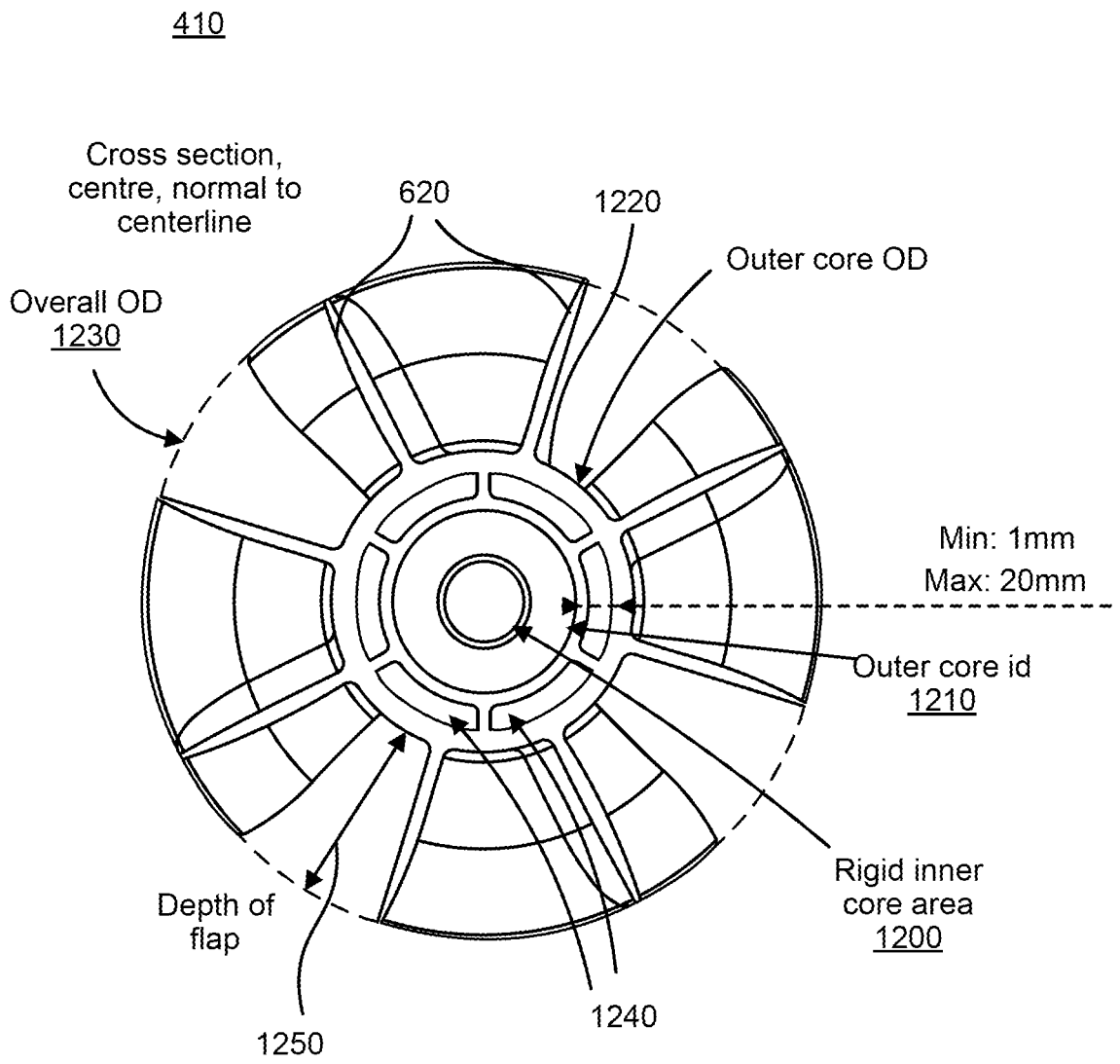
FIG. 12 depicts a cross sectional side view of a brush roller, in accordance with one embodiment.

FIG. 12 depicts a cross sectional side view of the brush roller 410, in accordance with one embodiment. The depicted cross section is taken at the center of the brush roller 410. The cross section shows an inner core area 1200, an outer core inner dimension 1210, an outer core outer dimension 1220, a brush roller overall outer dimension 1230, air pathways 1240, and flaps 620. The depicted cross section of the inner core area 1200 includes the cross section of the body 700 and the spring 820. In some embodiments, the nominal rigid core diameter is 23.6 mm. The innermost surface of the outer core 610 may have the outer core inner dimension 1210 and the outermost surface of the outer core 610 may have the outer core outer dimension 1220. The radial difference between the outer core inner dimension 1210 and the outer core outer dimension 1220 may be within the range of 2-30 mm.

The air pathways 1240 may be located in the area between the outer core inner dimension 1210 and the outer core outer dimension 1220. Although six air pathways 1240 are depicted, in alternative embodiments, there may be greater or fewer air pathways 1240. The air pathways 1240 may be cavities within the main body of the outer core 610, where the cavities run along the length of the outer core 610. The radius of the brush roller 410 at the outer core outer dimension 1220 may be within the range of 8-50 mm. The flaps 620 are connected to the outer core 610 at the outer surface (i.e., corresponding to the outer core outer dimension 1220). The length 1250 of the flaps 620 are within a range of 5-35 mm. Additional dimensions of the flaps 620 are described with respect to FIG. 19. The dimensions of the overall outer dimension 1230 of the brush roller may be 13-85 mm.

Figure 13:
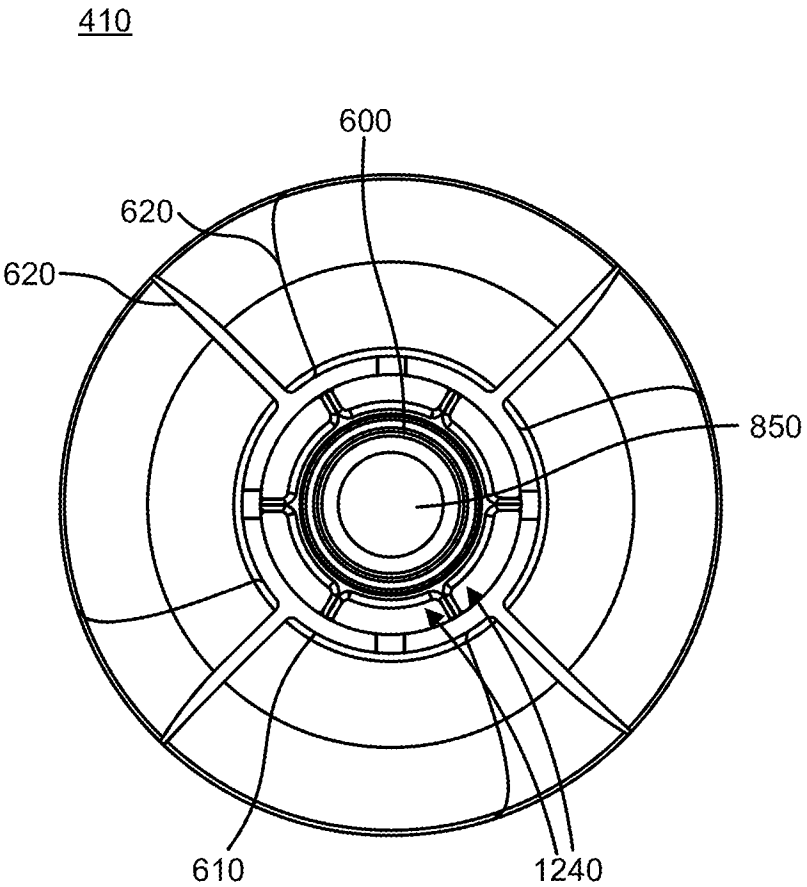
FIG. 13 depicts a side view of a brush roller from the side including a locating cutout, in accordance with one embodiment.

FIG. 13 depicts a side view of the brush roller 410 from the side including the locating cutout 850, in accordance with one embodiment. The side view depicts the inner core 600, the locating cutout 850 at the surface of the end tip 710, the outer core 610, the air pathways 1240 within the outer core 610, and the flaps 620.

Figure 14:
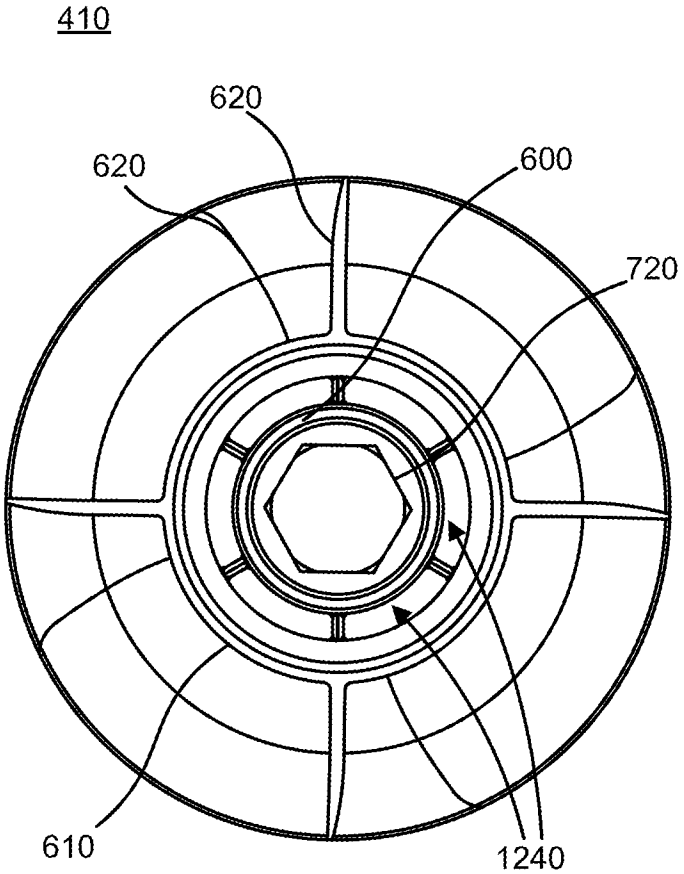
FIG. 14 depicts a side view of a brush roller from the side including a drive coupler, in accordance with one embodiment.

FIG. 14 depicts a side view of the brush roller 410 from the side including the drive coupler 720, in accordance with one embodiment. The side view depicts the inner core 600, the drive coupler 720 at the surface of the body 700 of the inner core 600, the outer core 610, the air pathways 1240 within the outer core 610, and the flaps 620. The drive coupler 720 may have a hexagonal or other suitable coupling interface to couple with a drive pinion.

Figure 15:
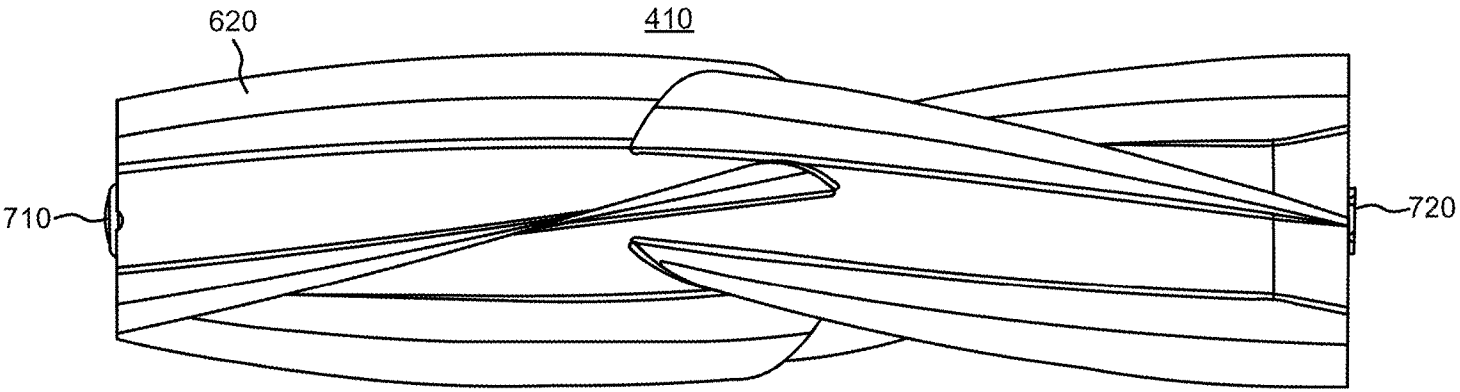
FIG. 15 depicts a front view of a brush roller, in accordance with one embodiment.
Figure 16:
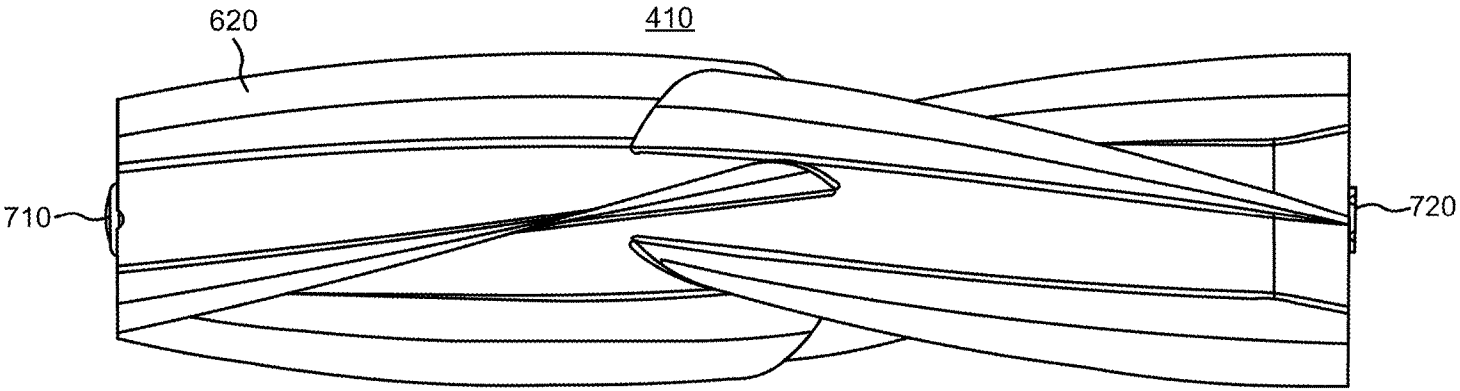
FIG. 16 depicts a top view of a brush roller, in accordance with one embodiment.

FIG. 15 depicts a front view of the brush roller 410, in accordance with one embodiment. FIG. 16 depicts a top view of the brush roller 410, in accordance with one embodiment. Due to the symmetrical shapes of the cylindrical inner core 600 and outer core 610 and the repetitive configuration of the flaps 620 at the outer surface of the outer core 610, the front view of FIG. 15 may be identical to the top view of FIG. 16. The flaps 620 are configured to direct debris towards the center of the brush roller 410. For example, the flaps 620 may be connected in a pattern similar to a chevron or herringbone pattern, which causes debris to converge from the outer edges of the pattern towards the arrow-like tip formed by the pattern. The configuration of the flaps 620 is described further with respect to FIG. 17.

Figure 17:
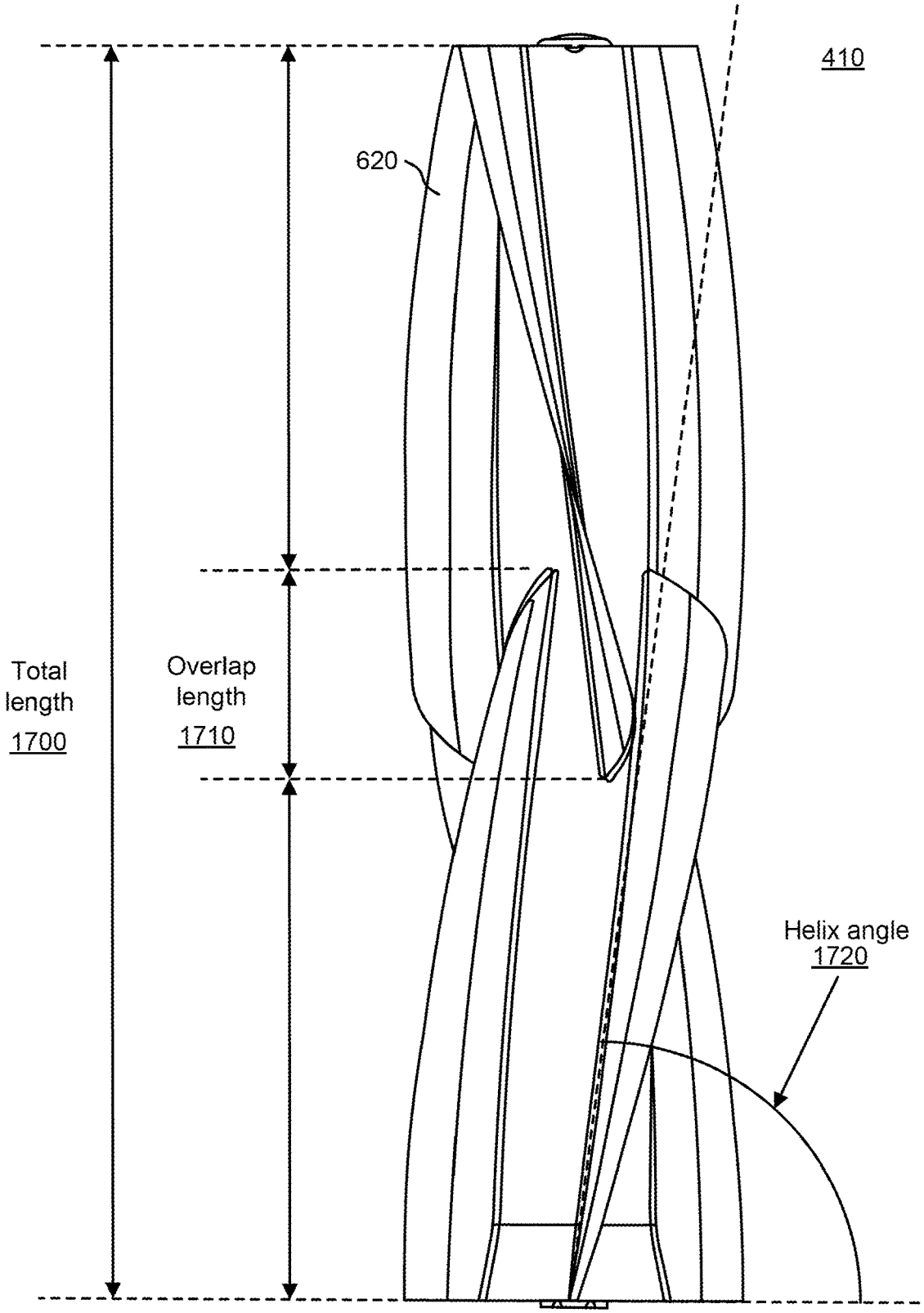
FIG. 17 depicts flaps of a brush roller, in accordance with one embodiment.

FIG. 17 depicts the flaps 620 of the brush roller 410, in accordance with one embodiment. The brush roller 410 may have within 2-12 flaps connected to the outer surface of the outer core 610. The flaps 620 may span a total length 1700 of the brush roller 410. That is, a combined length of two or more of the flaps 620 can extend along a total length of the outer core 610. The total length may be within 50-500 mm. For example, as depicted in FIG. 17, there is at least one flap located at any given cylindrical surface at the outer core 610 (e.g., any given cross section orthogonal to the length of the brush roller 410 bisects at least one flap). In some embodiments, the flaps 620 may span less than the total length of the brush roller 410 (e.g., cylindrical surfaces of the outer core 610 near the bases of the brush roller 410 do not have flaps protruding from them or a cylindrical surface of the outer core 610 near the center of the brush roller 410 does not have flaps protruding from it).

The flaps 620 may interleave with each other towards the center of the brush roller 410. The flaps 620 may interleave with an overlap length 1710 within 5-50 mm. In some embodiments, the flaps 620 may be formed along the length of the outer surface of the outer core 610 without overlapping (e.g., the flaps 620 form a pattern closer in appearance to a chevron pattern than a herringbone pattern). The flaps 620 may be positioned at a helix angle 1720 such that the flaps 620 are not positioned straight along the length of the outer core 610. Although the term "helix angle" is used to refer to the spiral appearance of the flaps 620, the flaps 620 may not necessarily form a true helix (i.e., they may take the form of parabolas, splines, or other suitable arcs for causing debris to move towards the center of the brush roller 410 in response to contacting the flaps 620). The helix angle 1720 may be an angle between one edge of a flap 620 and a base of the outer core 610. The flaps 620 may taper with a helix angle 1720 of within 1-60 degrees. The flaps 620 may be made of an elastomer. The properties of the elastomer may include one or more of a hardness within Shore A 40-80, a Bayshore rebound resilience within 5-50%, an elongation, and a tear strength within 75-250 kilonewtons (kN) per meter (m).

Figure 18:
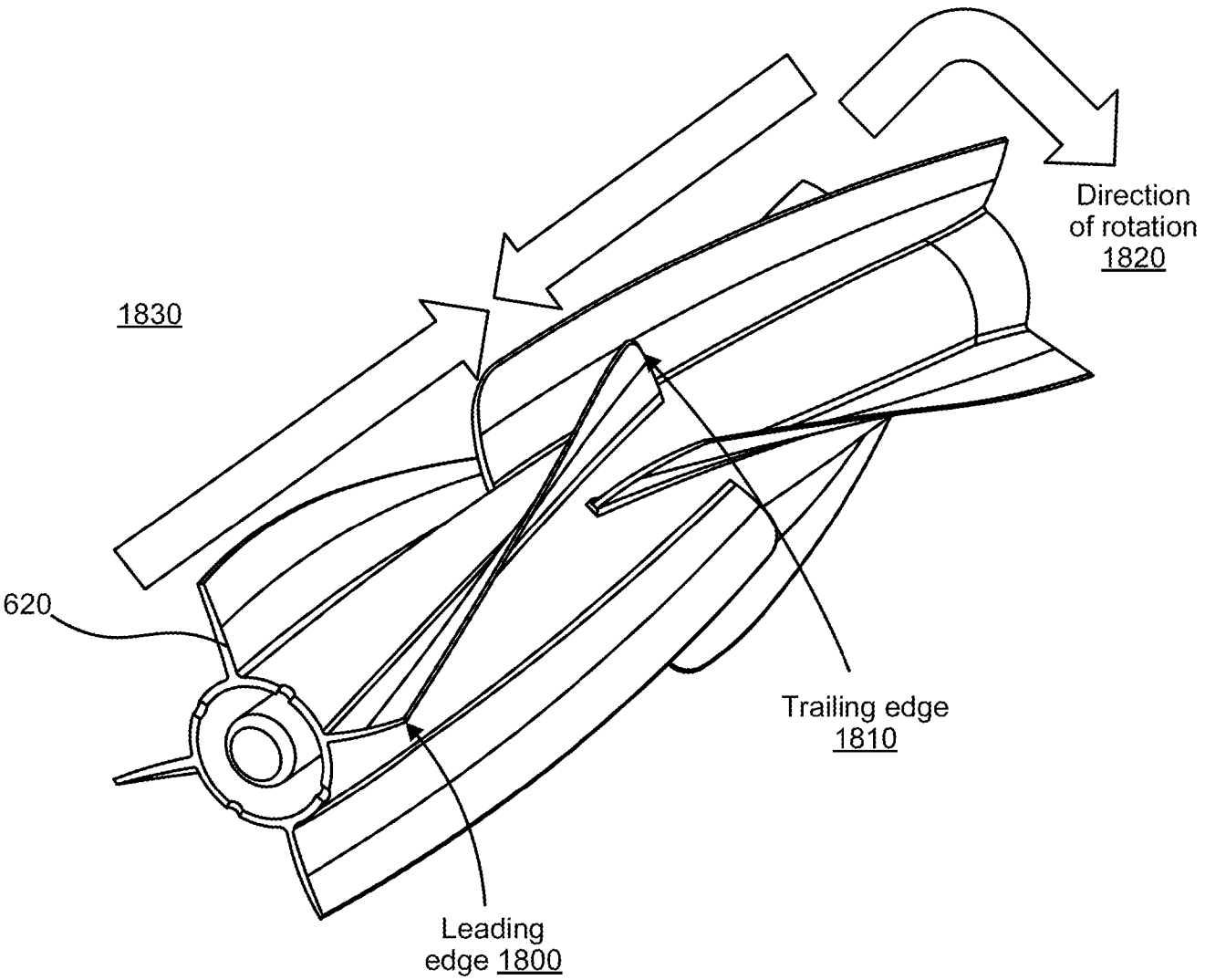
FIG. 18 depicts directions of debris flow during rotation of a brush roller, in accordance with one embodiment.

FIG. 18 depicts directions of debris flow during rotation of the brush roller 410, in accordance with one embodiment. The flaps 620 include a leading edge 1800 and a trailing edge 1810. The trailing edge 1810 may be proximal to the center of the outer core 610. The outer core 610 may include bases at opposite ends of the outer core 610. Each leading edge 1800 may form an angle (e.g., the helix angle 1720) within 1-60 degrees with one of the bases of the outer core 610. During operation of the cleaning system, the brush roller 410 may rotate in a direction of rotation 1820 (e.g., rotating clockwise from the side view in FIG. 13). As the brush roller 410 rotates in the direction of rotation 1820, the flaps 620 may cause debris entering the cleaning head 400 to move in an axial direction 1830 towards the center of the brush roller 410. The debris flowing in the axial direction 1830 may be suctioned into the duct opening 500.

Figure 19:
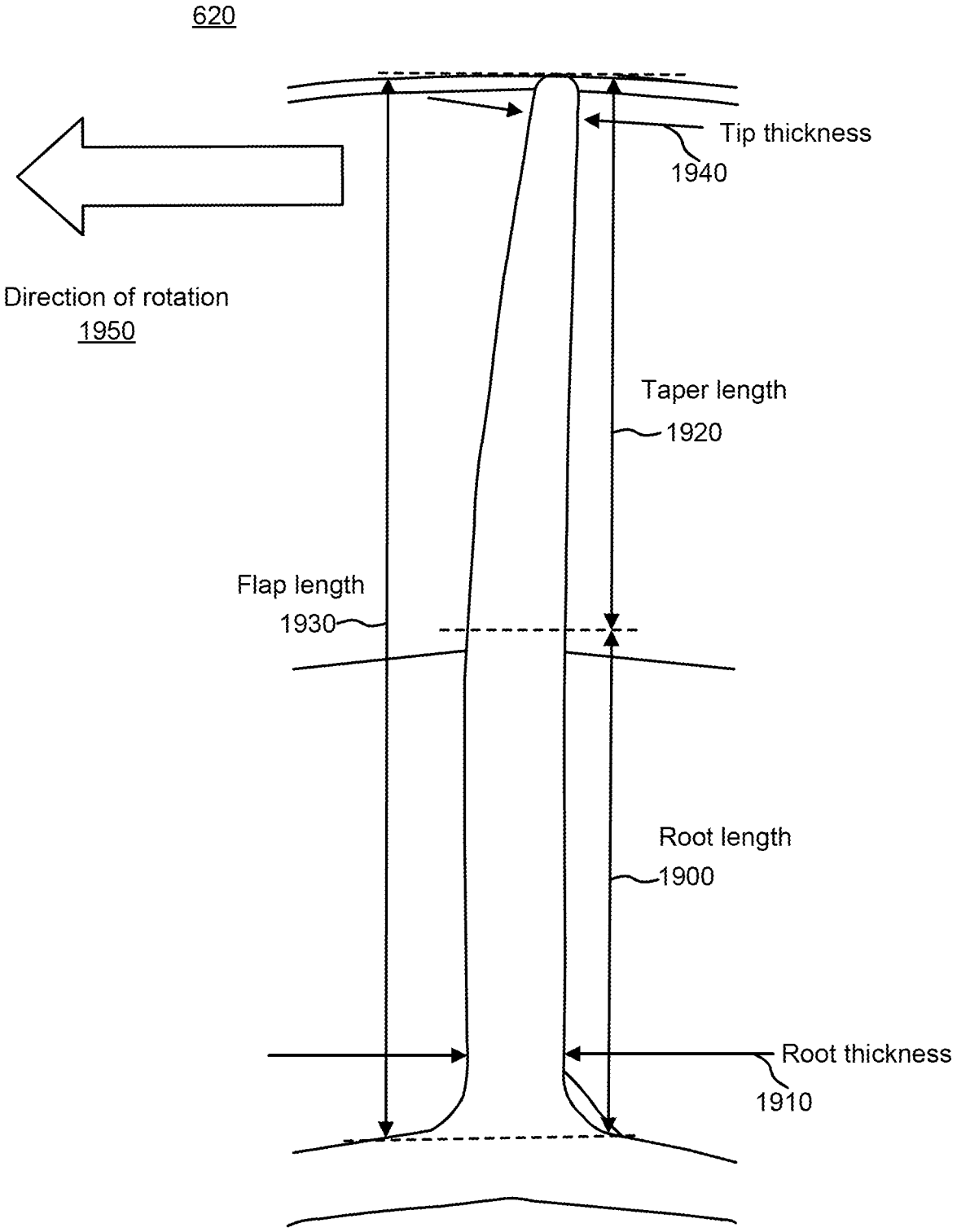
FIG. 19 depicts a flap of a brush roller, in accordance with one embodiment.

FIG. 19 depicts a flap 620 of the brush roller 410, in accordance with one embodiment. The flap 620 may have a flap length 1930 within the range of 5-35 mm. The flap 620 may include a root section and a tapered section. The tapered section may include a tip. The root section may have a uniform thickness. The tapered section may have a tapered thickness. A ratio between the uniform thickness of the root section and a height of the flap 620 may be within 1:5 to 1:25. A ratio of the tip thickness 1940 to the root thickness 1910 may be within the range of 1:1 to 1:5. This ratio may be designed to cause the ends of the tips to be less stiff than the root, which reduces the noise of the flaps 620 as they strike the ground. The taper may be inclined in either direction with respect to the direction of rotation. During operation of the brush roller 410, the flap 620 may move in a direction 1950 of rotation. The ratio of root length 1900 to taper length 1920 may be anywhere between 1:2 to 2:1. In some embodiments, the flaps 620 may have dimensions to encourage stiffness (i.e., the flaps may not waver or undulate along their length).

Properties of the flaps 620 described with respect to FIGS. 17-19 enable the brush roller 410 to be enduring, quiet under operation, capable of ingesting debris at least as large as the flap length, and capable of resisting fibrous debris wrapping around the outer core 610 (e.g., the shape of the flaps 620 causes the fibrous debris to be directed towards the edges of the brush roller 410 and into the buffer zones 1010).

Figure 20:
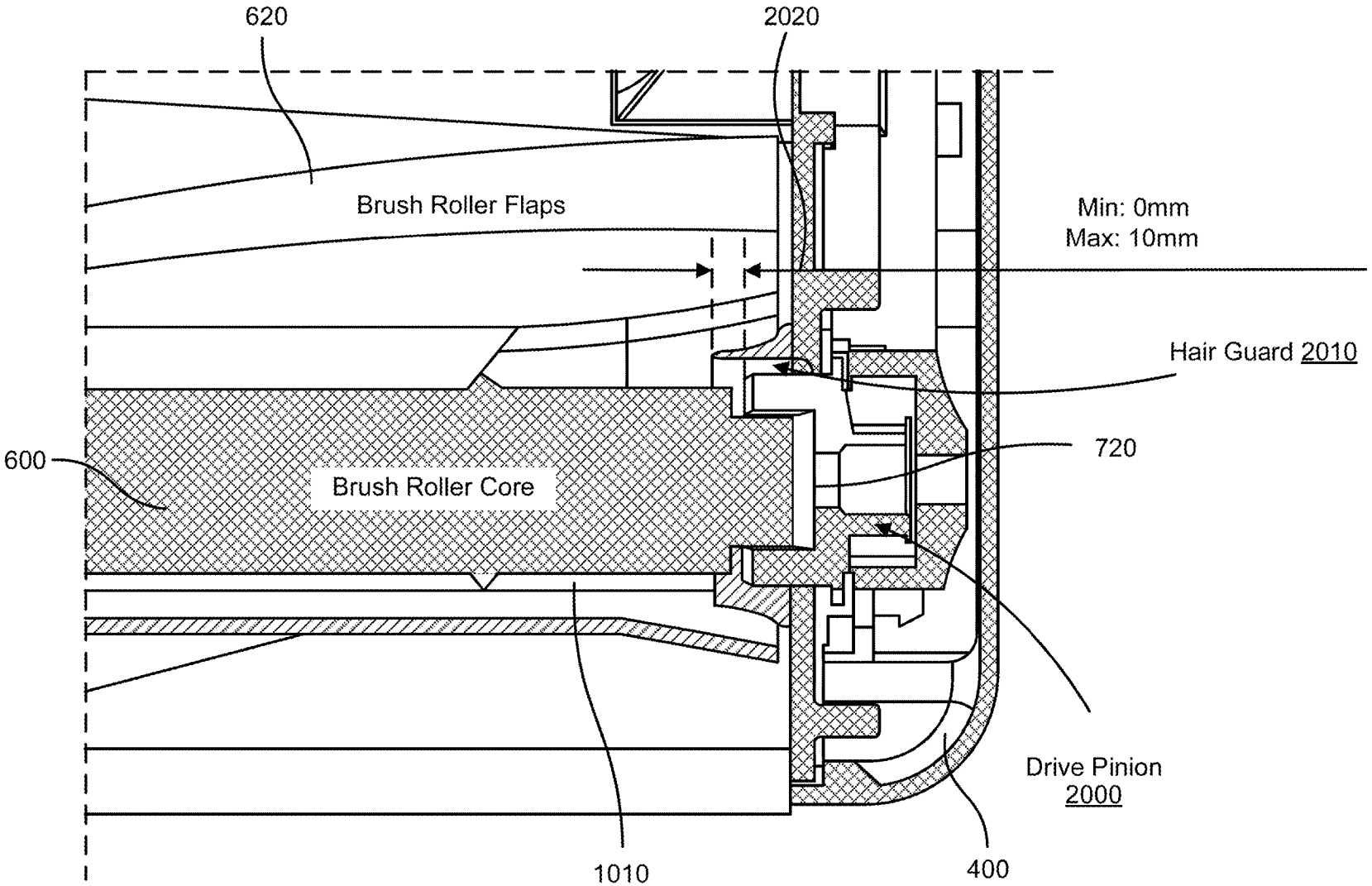
FIG. 20 depicts a cross section view of a portion of a brush roller coupled to a cleaning head, in accordance with one embodiment.

FIG. 20 depicts a cross section view of a portion of the brush roller 410 coupled to the cleaning head 400, in accordance with one embodiment. As the cleaning system operates, debris is collected into the cleaning head 400 and may travel into the buffer zones 2100. For example, the cleaning head 400 receives fibrous debris (e.g., hair) and causes the fibrous debris to migrate to the ends of the brush roller 410 (e.g., in either direction from the center of the brush roller 410 towards either of the buffer zones 2100 at the bases of the brush roller 410). In some embodiments, during operation of the cleaning system, fibrous debris may wrap itself around the brush roller 410 (e.g., rather than travel through the ingestion zone of the cleaning head 400 and into the duct opening 500). Fibrous debris may wrap itself around the brush roller 410 at the hair wrap zone 2200 after the fibrous debris enters through the ingestion zone. As the brush roller 410 rotates, the rotating force and the tendency of fibrous debris to wrap itself around smaller diameters may cause the fibrous debris to migrate towards either ends of the brush roller 410, which may have smaller diameters relative to other areas of the brush roller 410 (e.g., due to the flaps 620 which extend the diameter of the outer core 610 to the tips of the flaps 620). The fibrous debris may enter the buffer zones 1010 after migrating away from the hair wrap zone 2200.

As fibrous debris migrates into the buffer zone 1010 proximal to the drive coupler 720, a guard 2010 may prevent fibrous debris from wrapping around a drive pinion 2000. The drive pinion 2000 may be a component of the cleaning head 400. A distance 2020 between a surface of the guard 2010 and a surface of the drive pinion 2000 is within 0-10 mm. This surface of the guard 2010 may be the surface proximal to the center of the brush roller 410 and orthogonal to the length of the brush roller 410 when the brush roller 410 is in a cleaning orientation. This surface of the drive pinion 2000 may be parallel to this surface of the guard 2010. The guard 2010 may couple with the body 700 of the inner core 600 (e.g., coupling such that a gap between the guard 2010 and the body 700 is minimized to reduce the likelihood of fibrous debris entering between their surfaces). In some embodiments, the guard 2010 is located at an end of the brush roller 410 having the free rotating or stationary tip 710.

Figure 21:
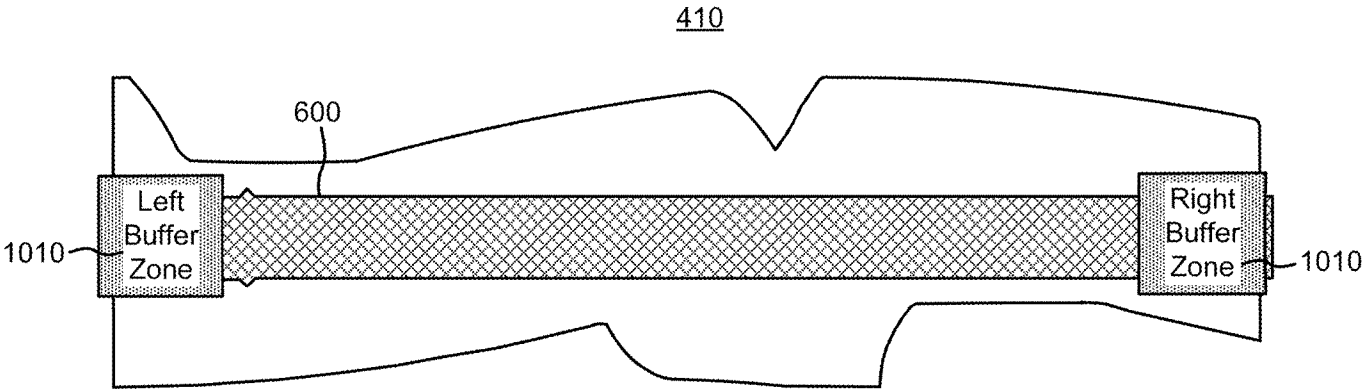
FIG. 21 depicts buffer zones in a cross section of a brush roller, in accordance with one embodiment.
Figure 22:
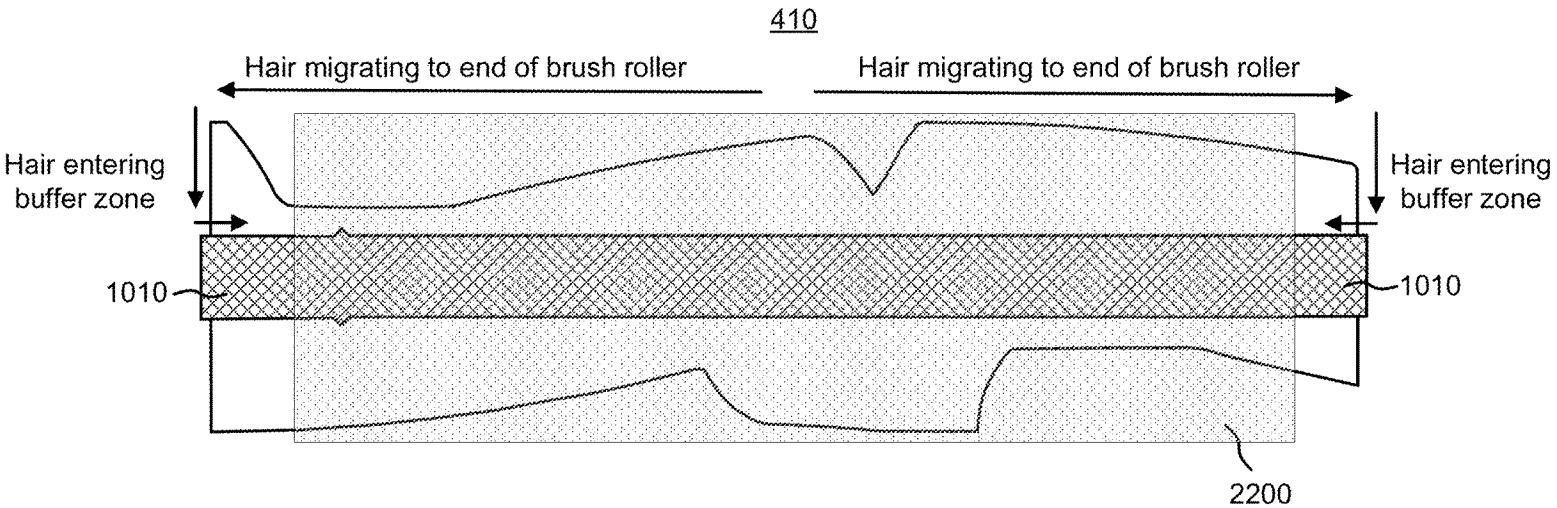
FIG. 22 depicts directions in which fibrous debris may travel towards buffer zones, in accordance with one embodiment.

FIG. 21 depicts the buffer zones 1010 in a cross section of the brush roller 410, in accordance with one embodiment. The buffer zones 1010 are located on opposite ends of the brush roller 410. Fibrous debris received through an ingestion zone of the cleaning head 400 may be stored in the buffer zones 1010. FIG. 22 depicts directions in which fibrous debris may travel towards the buffer zones 1010 (e.g., during nominal cleaning operations), in accordance with one embodiment. Fibrous debris may travel away from the center of the brush roller 410 and towards one of the buffer zones 1010.

Figure 23:
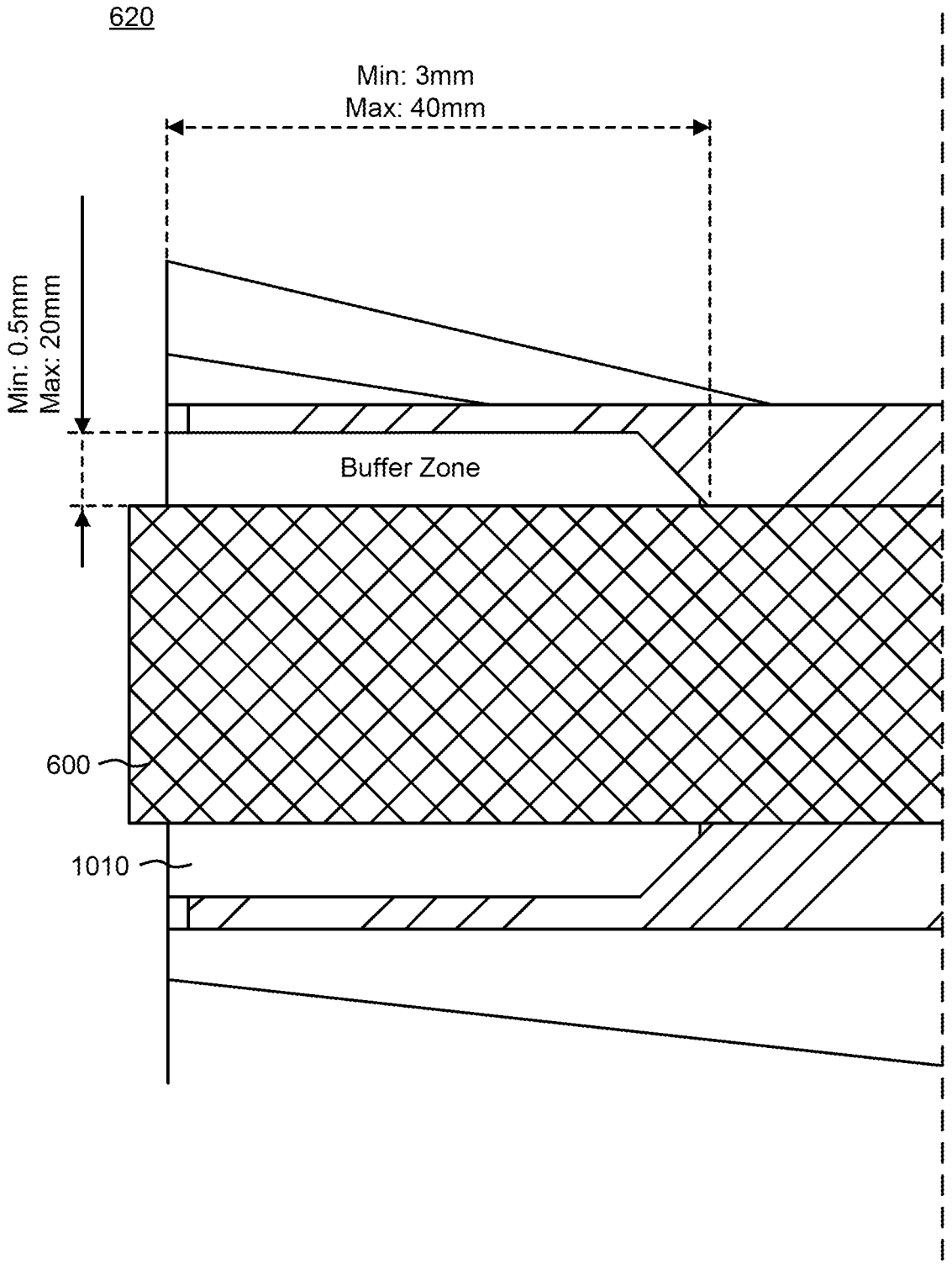
FIG. 23 depicts a buffer zone of a brush roller, in accordance with one embodiment.

FIG. 23 depicts a buffer zone 1010 of a brush roller 410, in accordance with one embodiment. The buffer zone 1010 is configured to receive fibrous debris as the brush roller 410 is in operation. The buffer zone 1010 may be a cavity within the outer core 610 in the shape of a cylindrical toroid. The inner core 600 may be coaxial with the cylindrical toroid shape of the buffer zone 1010. The buffer zone 1010 may have a length within 3-40 mm. The difference between the inner and outer diameters of the cylindrical toroid may be within 0.5-20 mm. Although FIG. 23 depicts a single buffer zone 1010, the brush roller 410 may have multiple buffer zones 1010 having the same functions and dimensions.

Figure 24:
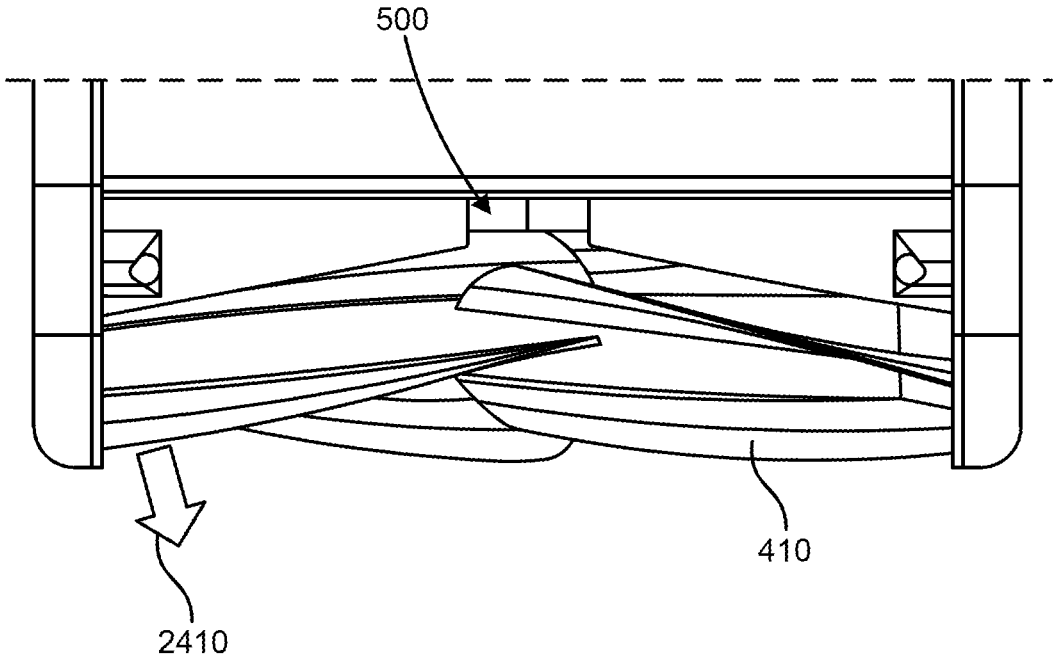
FIG. 24 depicts an unlocked configuration and a removed configuration of a brush roller, in accordance with some embodiments.
Figure 24:
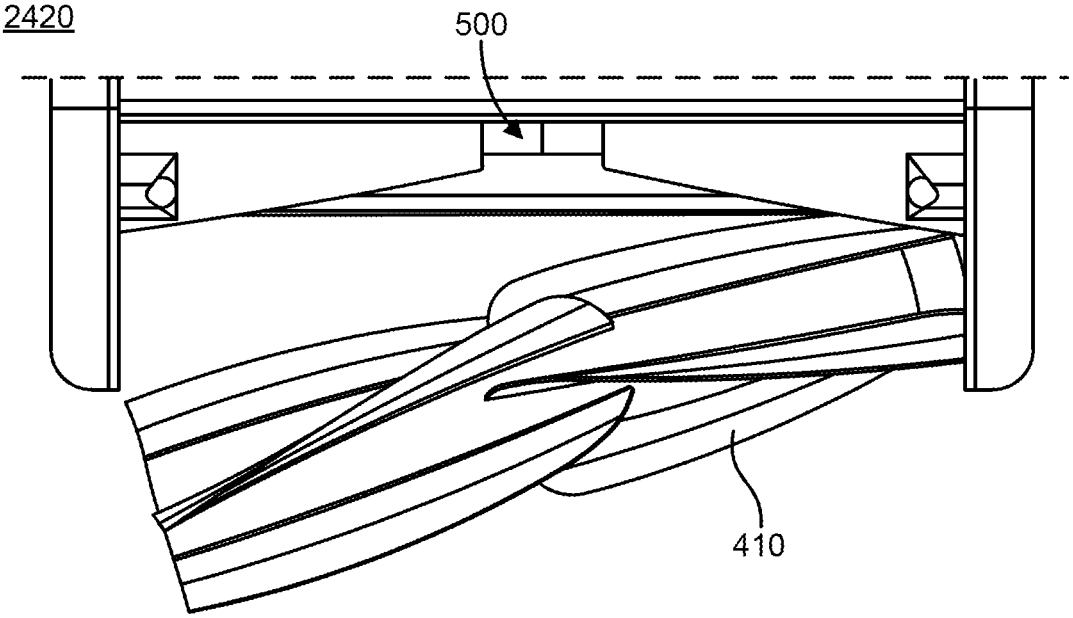

FIG. 24 depicts a locked configuration 2400 and removed configuration 2420 of the brush roller 410, in accordance with some embodiments. The locked configuration 2400 may also be referred to as an "engaged configuration" or "cleaning orientation." As the brush roller 410 operates to clean an environment, fibrous debris may accumulate within one or more buffer zones 1010 of the brush roller 410. The rotational friction may increase as the fibrous debris accumulates, despite there being a relatively lesser rotational friction than had the fibrous debris not been collected into the buffer zones 1010.

A controller of the cleaning system may be coupled to the brush roller 410, where the controller is configured to monitor a motor current draw needed to power the brush roller 410. The controller may determine whether the motor current draw exceeds a threshold current draw. In response to determining that the motor current draw exceeds a threshold current, the controller may generate a notification that the accumulated fibrous debris should be removed from the one or more buffer zones 1010. The notification may comprise a light (e.g., turning on an LED at the cleaning head 400), a sound, a message (e.g., a short message service (SMS) text to a user's phone), any suitable notification for informing a user of the status of a buffer zone 1010, or a combination thereof. In some embodiments, in response to determining that the motor current draw exceeds a threshold current, the controller may cause the motor to pause or stop executing (e.g., until the fibrous debris has been emptied and the motor current draw no longer exceeds the threshold current).

To remove fibrous debris from the buffer zone 1010, a user may unlock the brush roller 410 from the cleaning orientation. The contact between the cutout 850 at the brush roller 410 and the inner surface of the cleaning head 400 may be broken by the user. For example, the contact may be maintained by a spring force from the spring 820 against the ball bearing 810 and subsequently, against the pin-tip assembly 900 that contacts the inner surface of the cleaning head 400. The user applies a force to pull the brush roller 410 in the direction 2410 such that the contact at the cutout 850 is broken. Once this contact is broken and/or after the drive coupler 720 of the brush roller 410 has also been uncoupled from the drive pinion 2000, the brush roller 410 may be in the removed configuration 2420.

Figure 25:
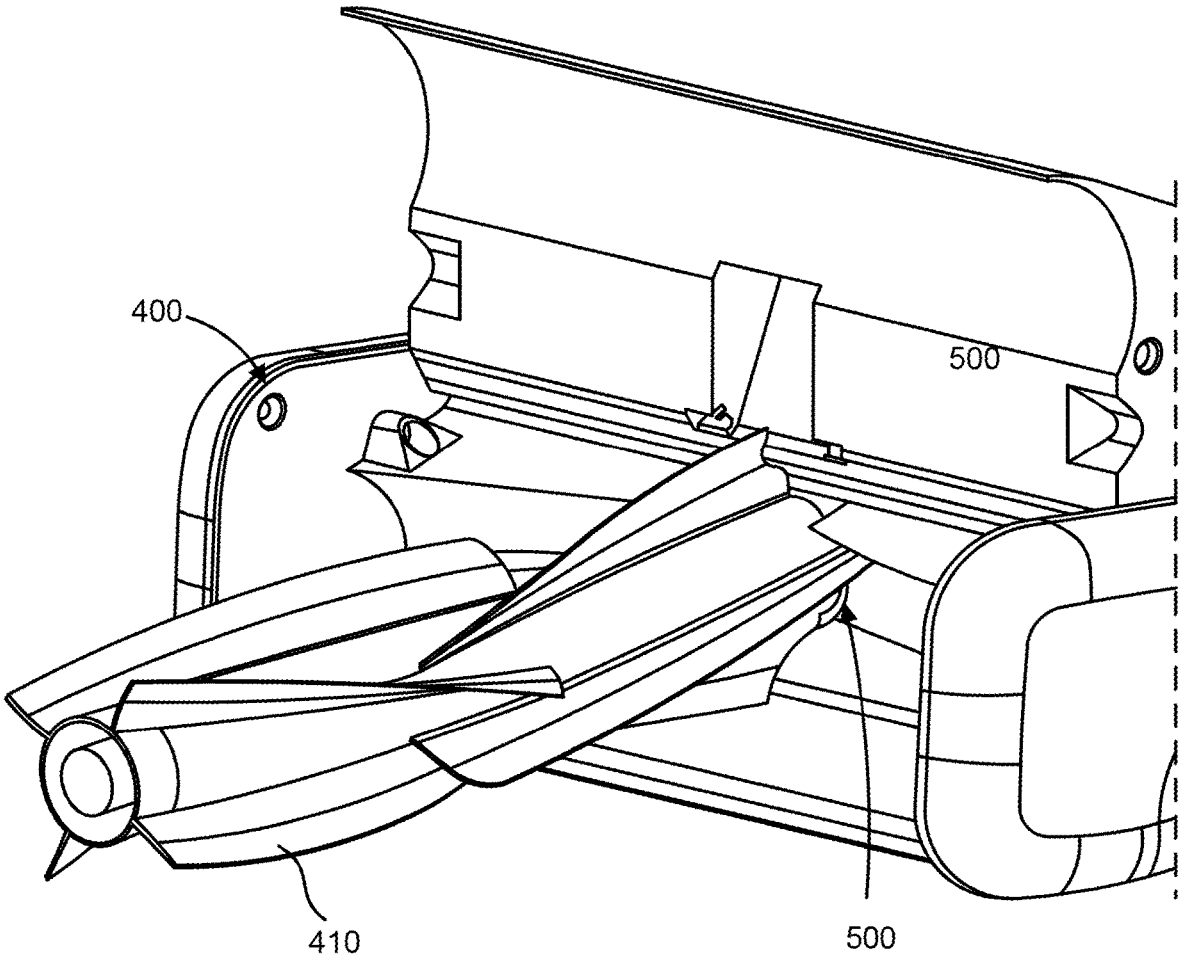
FIG. 25 depicts a brush roller in an orientation to remove fibrous debris from a buffer zone, in accordance with one embodiment.

FIG. 25 depicts a brush roller 410 in an orientation to remove fibrous debris from a buffer zone, in accordance with one embodiment. After the brush roller 410 has been unlocked from the cleaning orientation, the brush roller 410 may be placed in a buffer zone suction orientation. In the buffer zone suction orientation, the center axis of the brush roller 410 is substantially aligned with the center of the duct valve opening 500. In one example, substantially aligned may refer to an offset in distance from the center of the duct valve opening of +/−10% the radius of the duct valve opening. For example, a user may unlock the brush roller 410 from the cleaning orientation and position the brush roller 410 in the buffer zone suction orientation. In some embodiments, a top portion of the cleaning head 400 is configured to open to receive the brush roller 410 at the buffer zone suction orientation. The embodiments depicted in FIGS. 25 and 26 show a top portion of the cleaning head 400 opened.

Figure 26:
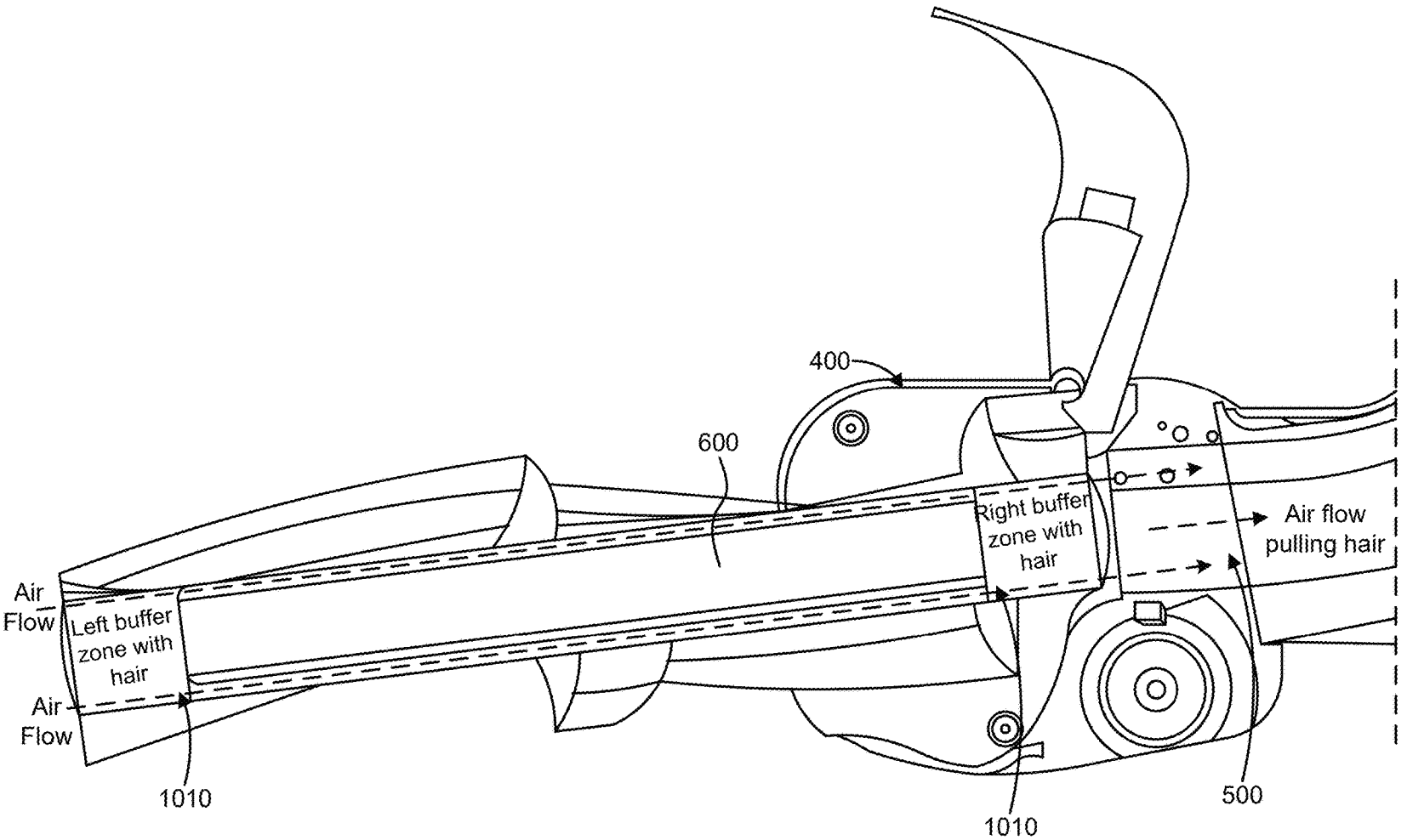
FIG. 26 a cross section view of a brush roller in a configuration for removing debris (e.g., hair) from a buffer zone, in accordance with one embodiment.

FIG. 26 a cross section view of a brush roller in a configuration for removing debris (e.g., hair) from a buffer zone 2100, in accordance with one embodiment. The cleaning system may operate the suction through the path 430 through the duct opening 500 to suction debris at a buffer zone 2100 that is proximate to the duct opening 500.

In response to the brush roller 410 positioned in the buffer zone suction orientation, the cleaning system may suction debris from a buffer zone proximate to the duct opening 500 through the path 430 and into a container for debris. The cleaning system causes air to flow through the air pathways 1300, and the air flow, suction, or a combination thereof causes the debris in the buffer zone proximate to the duct opening 500 to be suctioned into the duct opening 500. After debris has been suctioned from one of the buffer zones 2100, the brush roller 410 can be rotated so that another one of the buffer zones 2100 may be positioned proximate to the duct opening 500 and debris may be suctioned from the other buffer zone. For example, a user may rotate the brush roller 410 approximately one hundred eighty degrees and position the other buffer zone proximate to the duct opening 500. Similarly, air flow through the air pathways 1300 may assist in moving the debris from the other buffer zone through the path 430.

Figure 27:
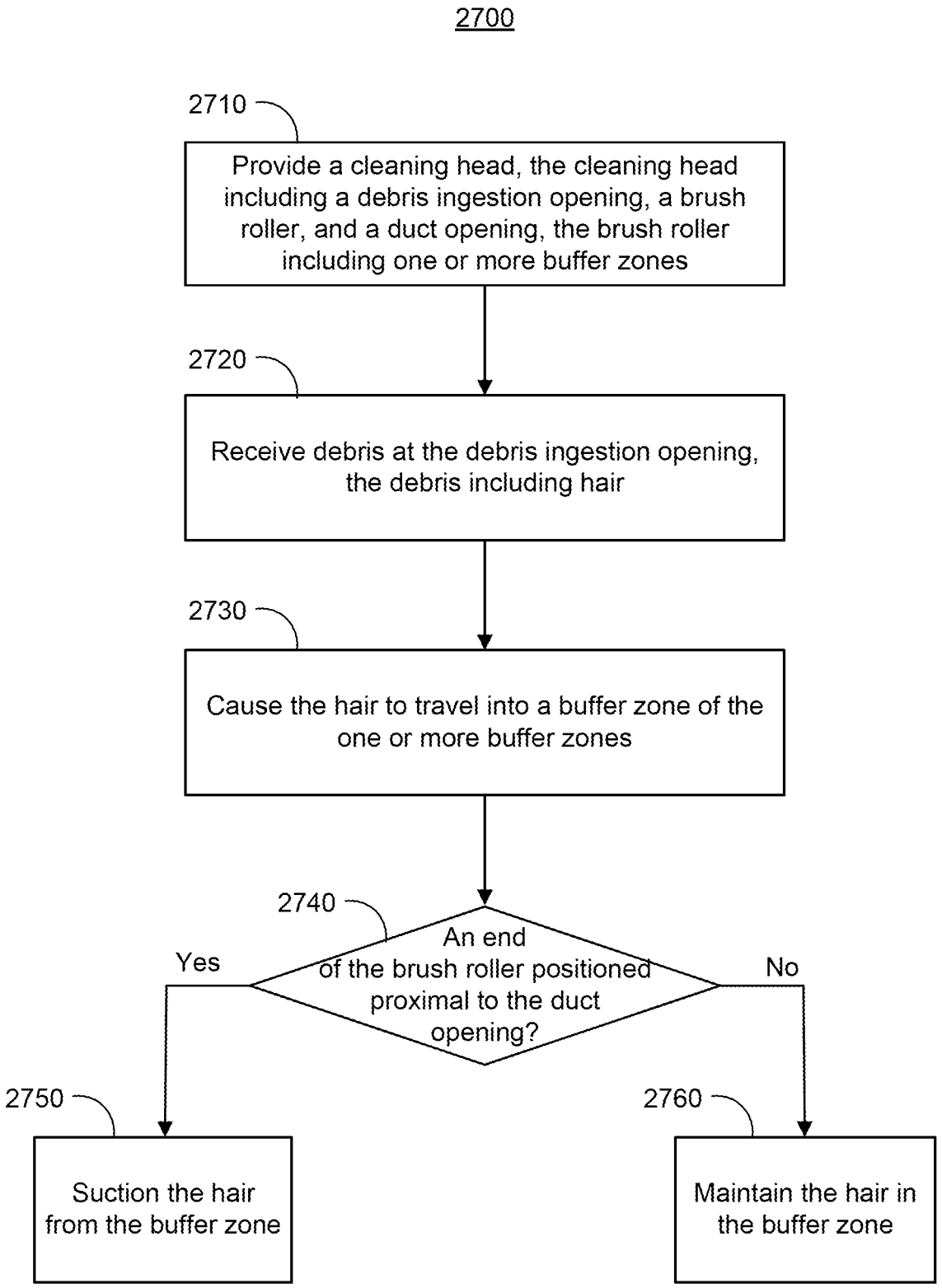
FIG. 27 depicts a process for cleaning fibrous debris from an environment, in accordance with one embodiment.

FIG. 27 depicts a process 2700 for cleaning fibrous debris from an environment, in accordance with one embodiment. In particular, the process 2700 uses buffer zones of the brush roller described herein to temporarily store fibrous debris for disposal, reducing potential friction from the fibrous debris being wrapped around the brush roller and causing resistance to the rotational force of the brush roller. The process 2700 may be performed by the cleaning system described herein. The process 2700 may include additional, fewer, or different operations than shown in FIG. 27.

The cleaning system provides 2710 a cleaning head. The cleaning head includes a debris ingestion opening (e.g., the ingestion opening 460 of FIG. 4), a brush roller (e.g., the brush roller 410 of FIG. 4), and a duct opening (e.g., the duct opening 500 of FIG. 5). The brush roller 410 includes one or more buffer zones (e.g., the buffer zones 1010 of FIG. 10).

The cleaning system receives 2720 debris at the debris ingestion opening. The debris may include fibrous debris like hair. For example, the cleaning system travels through a dining room and food and hair on the floor are ingested into the ingestion opening 460 and moved by the brush roller 410. The ingestion opening 460 may have an ingestion zone ground clearance 470 sufficiently tall and/or wide to receive large debris such as food scraps. The larger debris may be brushed by the brush roller 410 into the duct opening 500. Fibrous debris may be wrapped around the brush roller 410 as the brush roller 410 continues to rotate while cleaning the dining room.

The cleaning system causes 2730 the hair to travel into a buffer zone of the one or more buffer zones. Following the previous example, the hairs that have wrapped around the brush roller 410 may migrate away from the center of the brush roller 410 and towards the one or more buffer zones 1010 (e.g., as depicted in FIG. 22). The hairs may continue to migrate into the buffer zones 1010 because of a natural tendency to want to wrap around objects with smaller radii (e.g., the inner core 600 has a smaller radius than the outer core 610 in combination with the flaps 620). Additionally, a guard (e.g., the guard 2010) may prevent the hair from wrapping around a drive pinion or the contact between a drive coupler and the drive pinion. The guard 2010 may also cause the hair to migrate into a buffer zone 1010 instead of wrapping around a drive pinion.

The cleaning system may suction 2750 the hair from the buffer zone or maintain 2760 the hair in the buffer zone depending on the condition 2740 of the brush roller's position. In particular, the condition 2740 may be that an end of the brush roller is positioned proximal to the duct opening. For example, a user may apply force to disengage the cutout 850 from its contact with an inner surface of the cleaning head 400 and rotate the brush roller 410 such that an end of the brush roller 410 is positioned proximal to the duct opening 500. In response to this condition 2740 that the brush roller is positioned proximal to the duct opening, the cleaning system suctions 2750 hair from the buffer zone that is proximal to the duct opening. Alternatively, the condition 2740 may be that the end of the brush roller is not positioned proximal to the duct opening. For example, the brush roller may be in a cleaning orientation or the brush roller may be in a transitional orientation between the cleaning orientation and a buffer zone suction orientation, where a buffer zone is not yet proximal to a duct opening for debris in the buffer zone to be suctioned through the duct opening.

Figure 28:
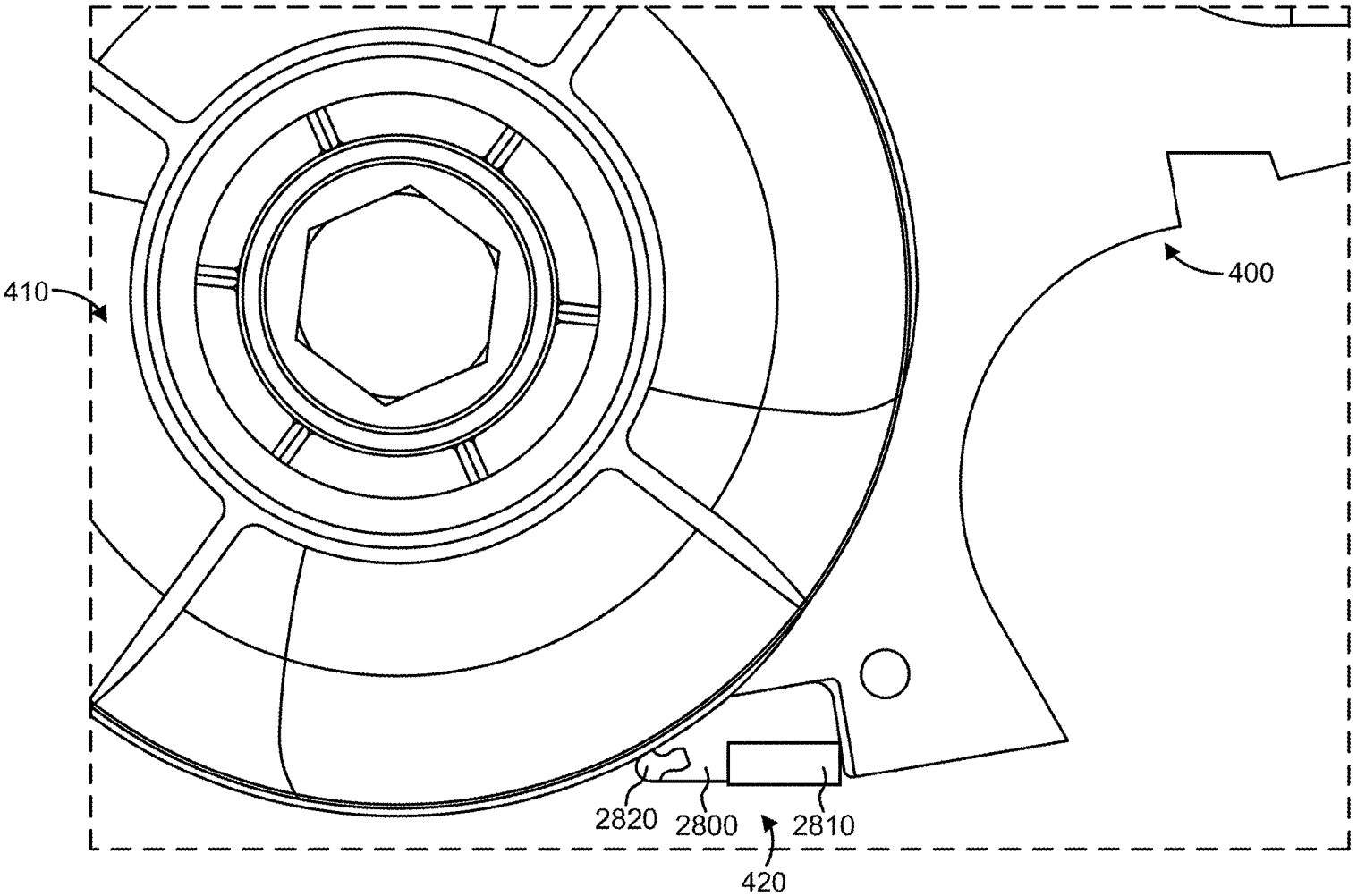
FIG. 28 depicts a wedge within a cleaning system, in accordance with one embodiment.

FIG. 28 depicts a wedge 420 within a cleaning system, in accordance with one embodiment. The wedge 420 includes a main body 2800, a strip 2810, and a tip 2820. The wedge 420 may be coupled to the cleaning head 400. The wedge 420 may contact debris that is moved by the brush roller 410. The wedge 420 may serve as a seal between a cavity of the cleaning head 400 in which the brush roller 410 rotates and a floor of the environment in which the cleaning system is cleaning. The sealing function aids in the cleaning system's movement of debris from a surface using airflow into a duct opening (e.g., the duct opening 500). The wedge 420 can serve as a "leading edge" due to the wedge 420 being the first part of the cleaning head 400 that contacts a surface as the cleaning head 400 moves forward. The "leading edge" in the context of the wedge 420 is distinct from the "leading edge" in the context of the flaps 620. References to particular "leading edges" may be inferred from the context in which the terms are used. The wedge 420 may contact the surface closer than portions of the cleaning head 400 contact the surface.

The cleaning system may ingest large debris (e.g., on the order of 20-30 mm in width, length, diameter, etc.). The ingestion opening 460 may have a minimum height within 20-30 mm to ingest the large debris. Accordingly, the front face of the cleaning head 400 (i.e., the side at the front of the cleaning head 400 as the head moves forward) may be away from the floor by at least the minimum height and consequently, debris may not contact the front face as it is ingested into the cleaning head 400. The wedge 420 of the cleaning head 400 thus can become the surface along which debris is moved up and into the duct opening 500. The surface of the wedge 420 may be configured to trace the path of the flaps 620 of the brush roller 410. For example, the surface of the wedge 420 may be curved such that a vertical cross section (i.e., perpendicular to the base of the wedge 420 that is configured to contact a surface to be cleaned) may resemble an arc that is tangential to the floor. This is depicted in FIG. 28 by the surface of the wedge 420 that is closest to the brush roller 410 and aligns with the circular region in which the flaps 620 of the brush roller 410 travel. The wedge 420 may be coupled to the cleaning head 400 such that the arced surface of the wedge 420 forms a continuous arc with a surface of the cleaning head 400 to which it is proximal.

Figure 29:
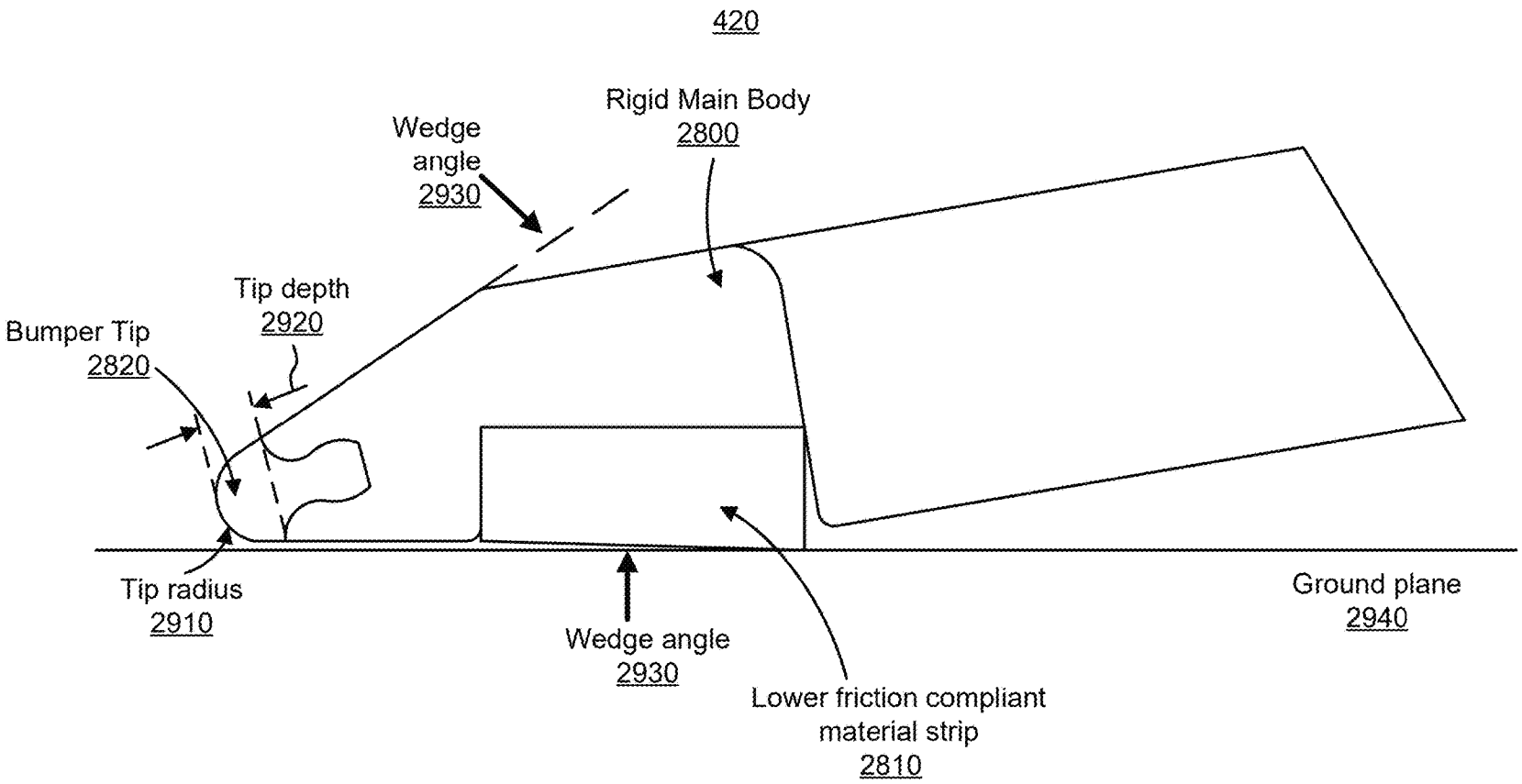
FIG. 29 depicts a wedge, in accordance with one embodiment.

FIG. 29 depicts a wedge 420, in accordance with one embodiment. The base of the wedge 420 can move along a ground plane 2940, which may be a surface of an environment to be cleaned. The wedge 420 can be attached to the base of the cleaning head 400. The base of the wedge 420 may be coplanar or substantially coplanar with the ground plane 2940 (e.g., within 1-2 mm from the ground plane 2940). The main body 2800 is coupled to the strip 2810 and the tip 2820. The wedge 420 may be composed of an elastomeric material. In some embodiments, the main body 2800 is composed of a rigid material.

The strip 2810 of the wedge 420 may be composed of an arrangement of fine bristles, foam or sponge strips, elastomeric structure, inflated structure, other passive spring-damper like materials, or a combination thereof. The material of the strip 2810 may be configured to conform to floor textures, reducing the sliding friction and scuffing of the cleaning head 400 against the ground plane 2940. The material of the strip 2810 may be compliant over a Z-Compliance distance in the range of 0.5-55 mm. The tip 2820 may be coupled to the main body 2800 such that the surfaces are continuous. The tip 2820 may have radii 2910 or similar arced features within a range of 0.15-3 mm. The tip depth 2920 may be within a range of 1-8 mm. The tip 2820 may be attached to the main body 2800 by mechanical coupling, chemical or molecular bonding, or a combination thereof. The tip 2820 may be made of an elastomeric material with hardness in the range Shore A 40-80. A wedge angle 2930 may be within 5-60 degrees.

Figure 30:
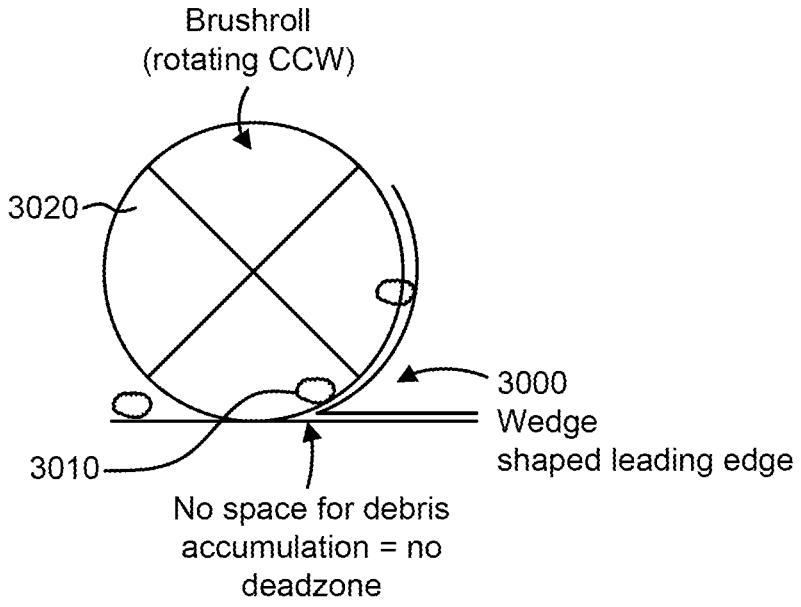
FIG. 30 depicts movement of debris against a wedge-shaped leading edge, in accordance with one embodiment.
Figure 31:
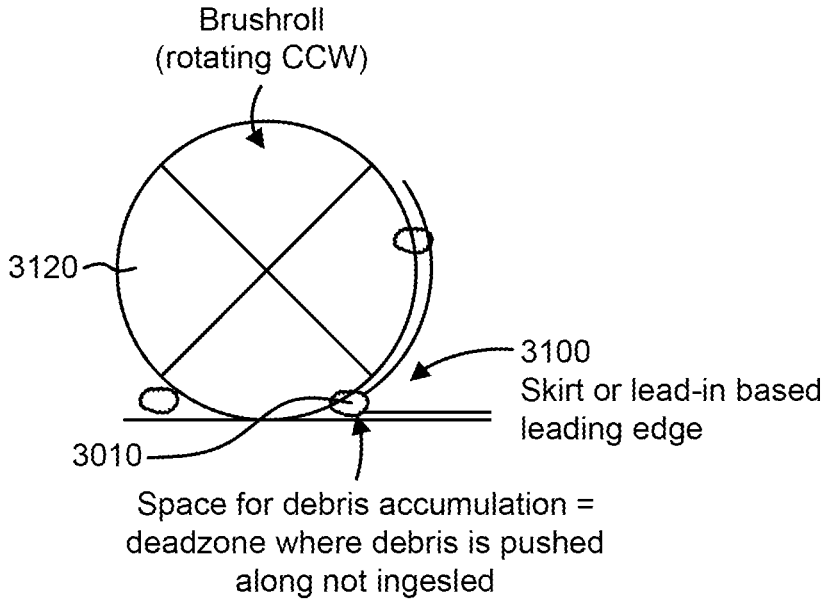
FIG. 31 depicts accumulation of debris against a skirted leading edge, in accordance with one embodiment.

FIG. 30 depicts movement of debris against a wedge-shaped leading edge 3000, in accordance with one embodiment. Debris 3010 may be moved by a brush roller 3020 against the wedge-shaped leading edge 3000. The brush roller 3020 may move counterclockwise as depicted in the orientation in FIG. 30. The wedge shape occupies a space that may otherwise be a space for debris accumulation. This space for debris accumulation is shown in FIG. 31. The wedge-shaped leading edge 3000 may be a component of the wedge 420.

FIG. 31 depicts accumulation of debris against a skirted leading edge 3100, in accordance with one embodiment. Debris 3010 may be moved by a brush roller 3120 towards the skirted leading edge 3100, but the skirted leading edge 3100 allows for a space for debris 3010 to accumulate. In this space, debris is pushed along the ground of the environment to be cleaned rather than ingested into a duct opening (e.g., the duct opening 500). For example, the debris may be pushed along the ground such that the debris accumulates at the base of the cleaning head near the edge rather than be ingested into the duct opening. The brush roller 3120 may move counterclockwise as depicted in the orientation in FIG. 31.

Figure 32:
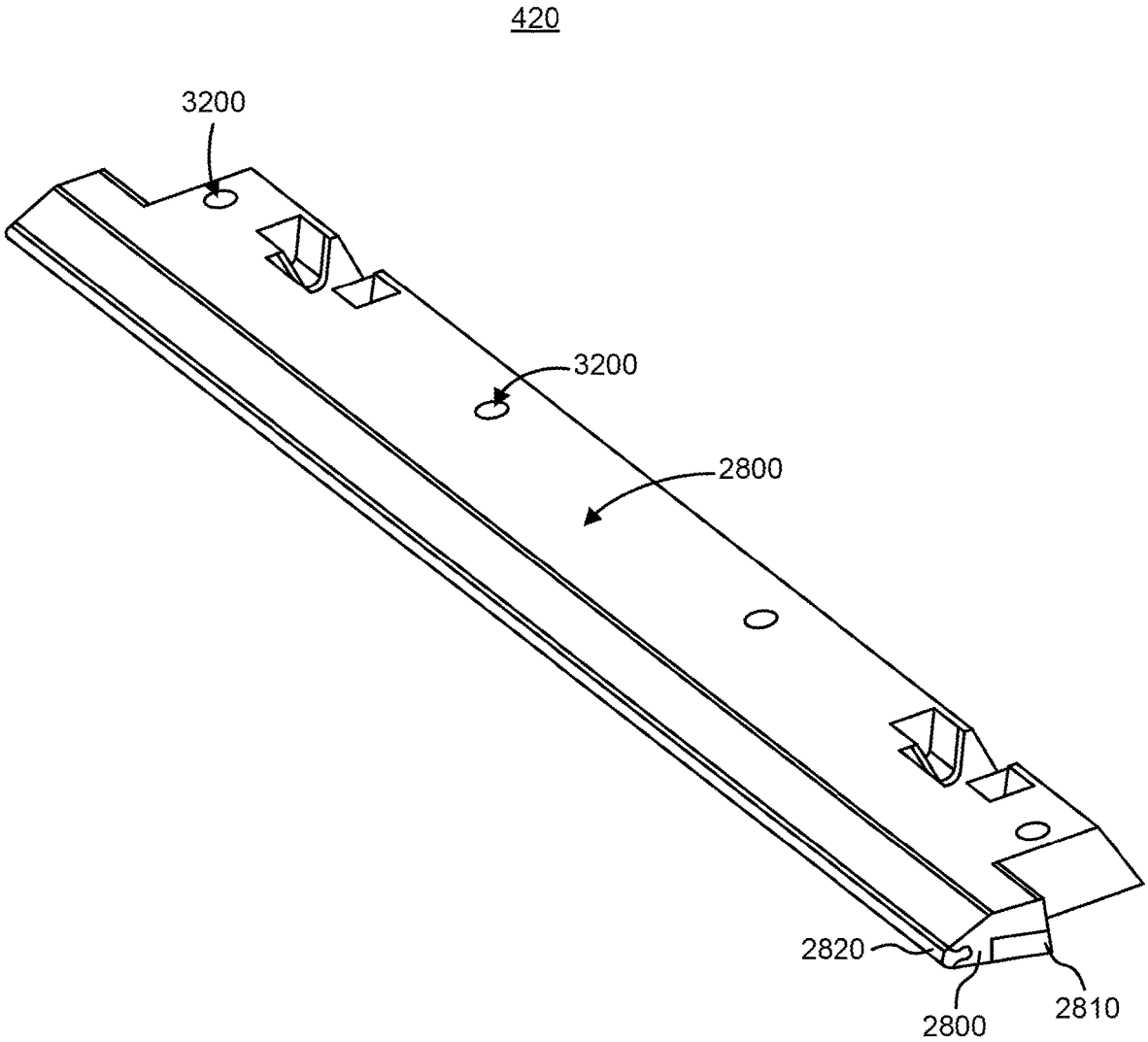
FIG. 32 depicts an isometric view of a wedge, in accordance with one embodiment.
Figure 33:
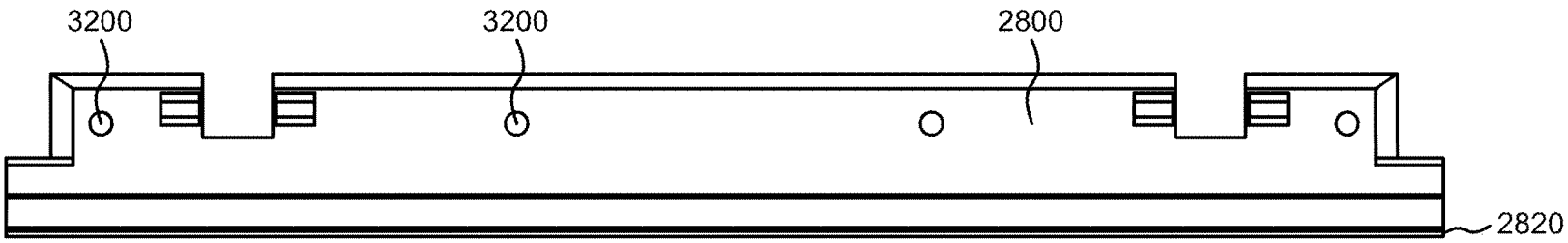
FIG. 33 depicts a top view of a wedge, in accordance with one embodiment.
Figure 34:
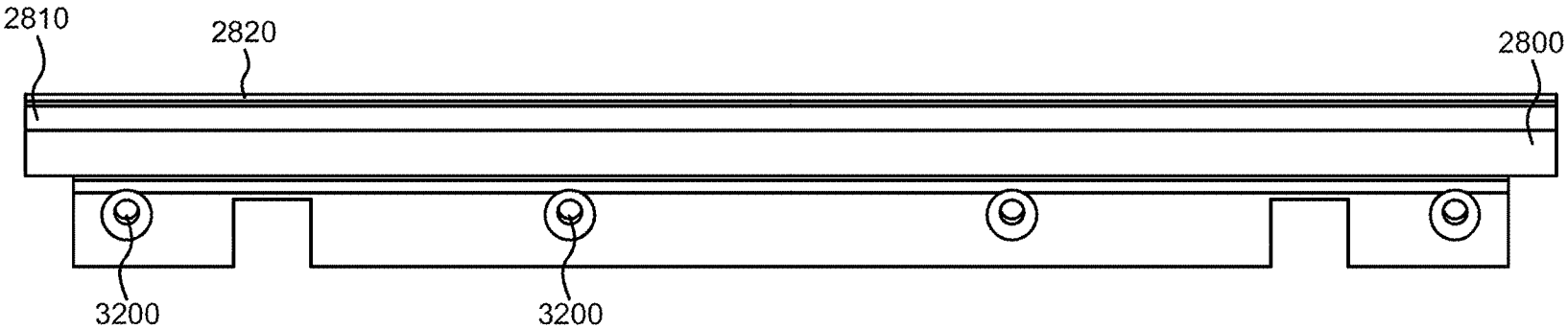
FIG. 34 depicts a bottom view of a wedge, in accordance with one embodiment.

FIG. 32 depicts an isometric view of the wedge 420, in accordance with one embodiment. FIG. 33 depicts a top view of the wedge 420, in accordance with one embodiment. FIG. 34 depicts a bottom view of the wedge 420, in accordance with one embodiment. The wedge 420 includes the main body 2800, the strip 2810, the tip 2820, and attachment elements 3200. The attachment elements 3200 attach the wedge 420 to the cleaning head 400. The attachment elements 3200 may be mechanical, chemical, magnetic, any suitable attachment mechanism, or a combination thereof.

Figure 35B:
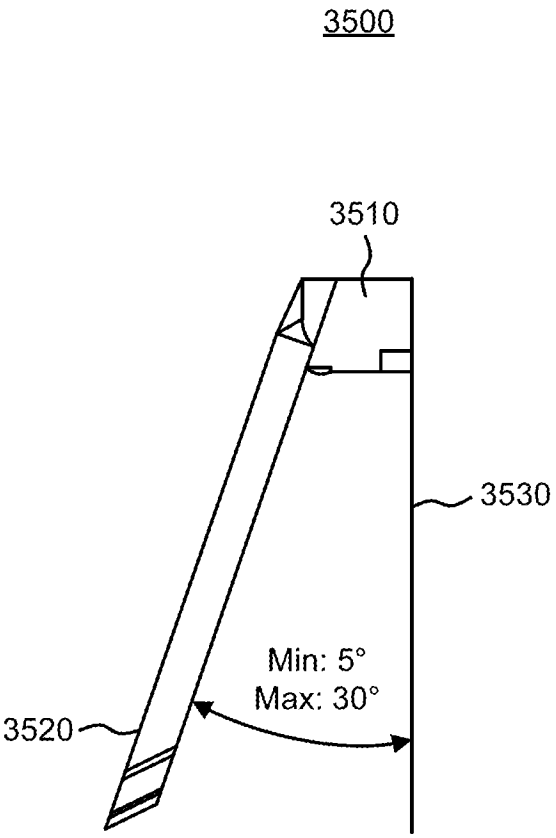
FIGS. 35A and 35B depict a side brush of a cleaning system, in accordance with one embodiment.
Figure 35A:
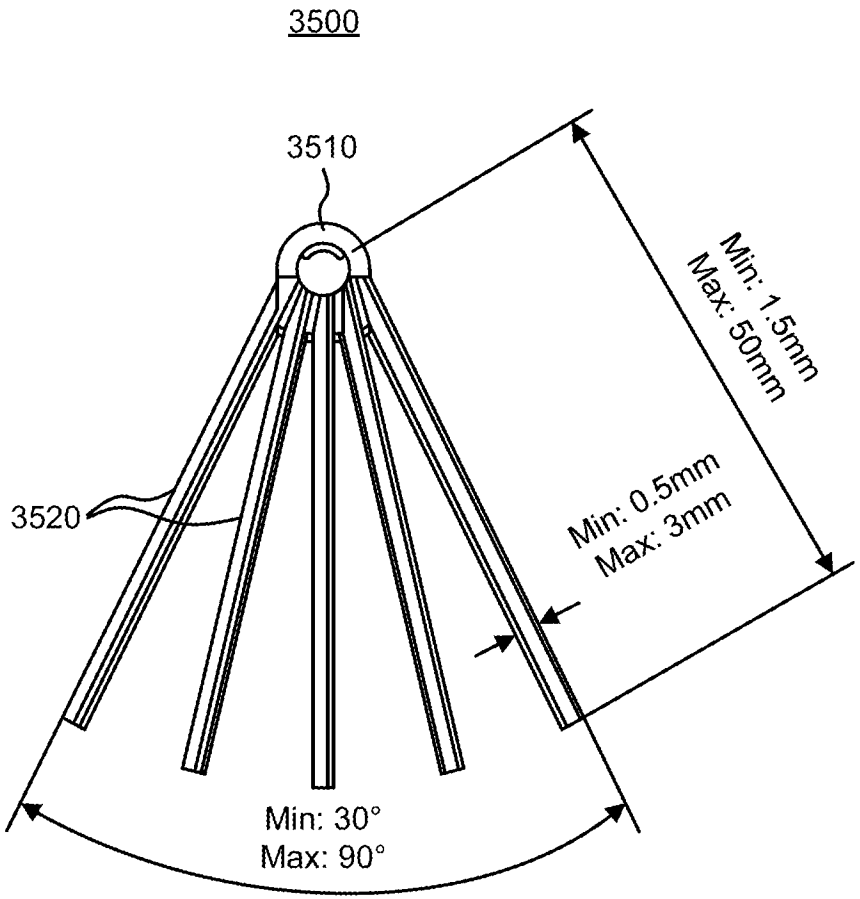

FIGS. 35A and 35B depict a side brush 3500 of the cleaning system, in accordance with one embodiment. FIG. 35A shows a front view of the side brush 3500 and FIG. 35B shows a side view of the side brush 3500. The side brush 3500 includes a base 3510 and whiskers 3520. The whiskers 3520 can be attached via the base 3510 to a surface 3530 of the cleaning head or any outer surface of the cleaning system. The attachment at the base 3510 includes a rotational mechanism configured to enable the whiskers 3520 to rotate about the base 3510. The whiskers 3520 may be arranged within a 30-90 degrees range, and the whiskers 3520 may remain in that arrangement (i.e., a consistent angular difference between consecutive whiskers) as the whiskers 3520 are rotated. For example, three whiskers may be positioned with a 45-degree, 45-degree, and 270-degree difference between consecutive whiskers, where this angular difference may be maintained as the whiskers 3520 rotate. Each of the whiskers 3520 may have a thickness within a range of 0.5-3 mm. The whiskers 3520 may have a length within a range of 15-50 mm. The whiskers 3520 may have an angular deviation from horizontal of 5-30 degrees. The whiskers 3520 may be composed of a plastic material suitable to minimize hair wrap and noise when moving within its rotational range. The side brush 3500 may include 3-7 whiskers.

A controller of the cleaning system may be coupled to the side brush 3500 to control the operation of the side brush 3500 (e.g., speed of whisker movement, duration of movement, etc.). The cleaning system may clean walls or other vertical surfaces using the side brush 3500. The controller may determine to activate and/or change a parameter of whisker movement (e.g., speed, duration, etc.) based on the distance between the side brush 3500 at a target vertical surface. This wall-following process is described further with respect to the description of FIG. 43.

Figure 38B:
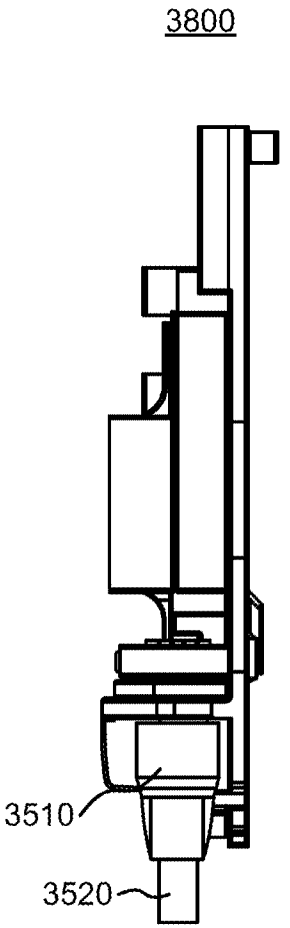
FIGS. 38A and 38B depicts a cleaning head configured to perform a homing technique for a side brush through a ratcheting tooth, in accordance with one embodiment.
Figure 38A:
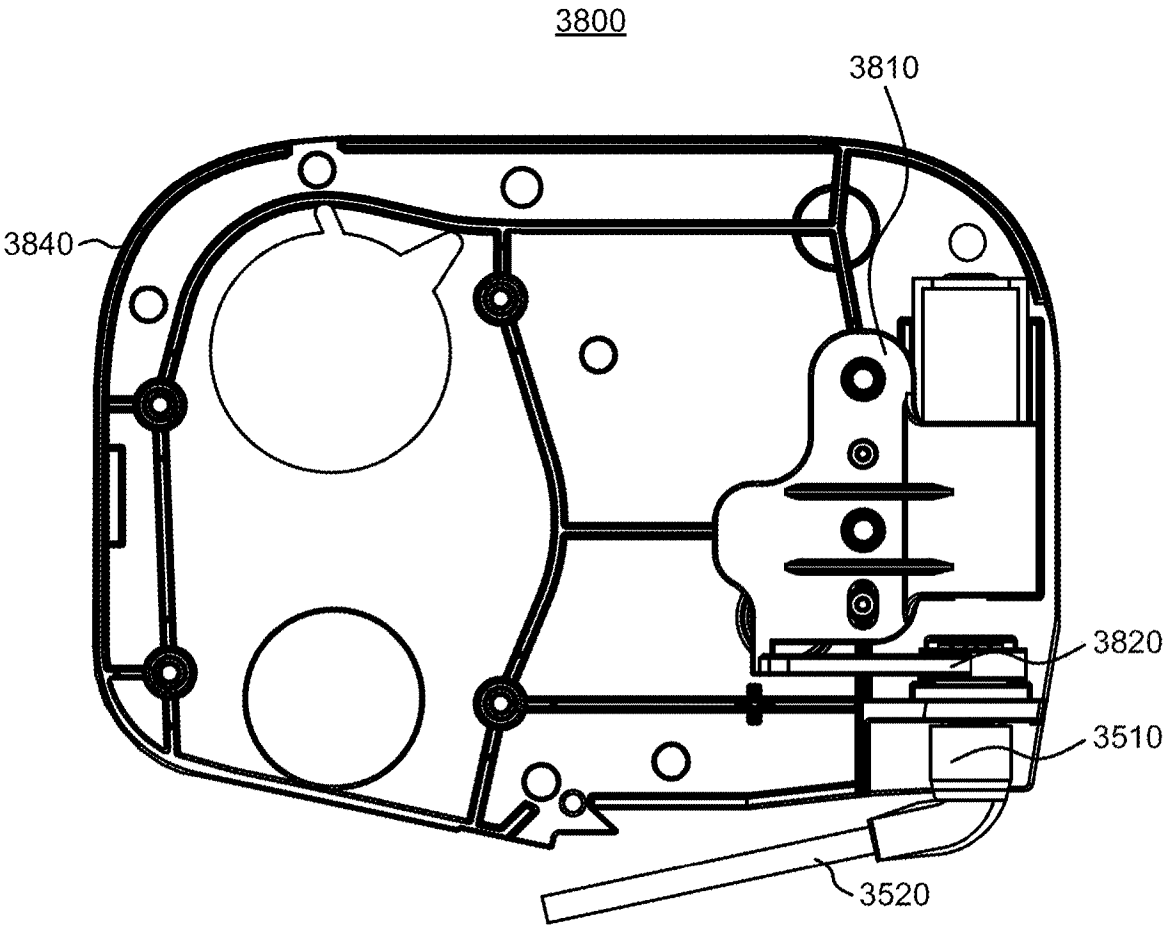
Figure 39:
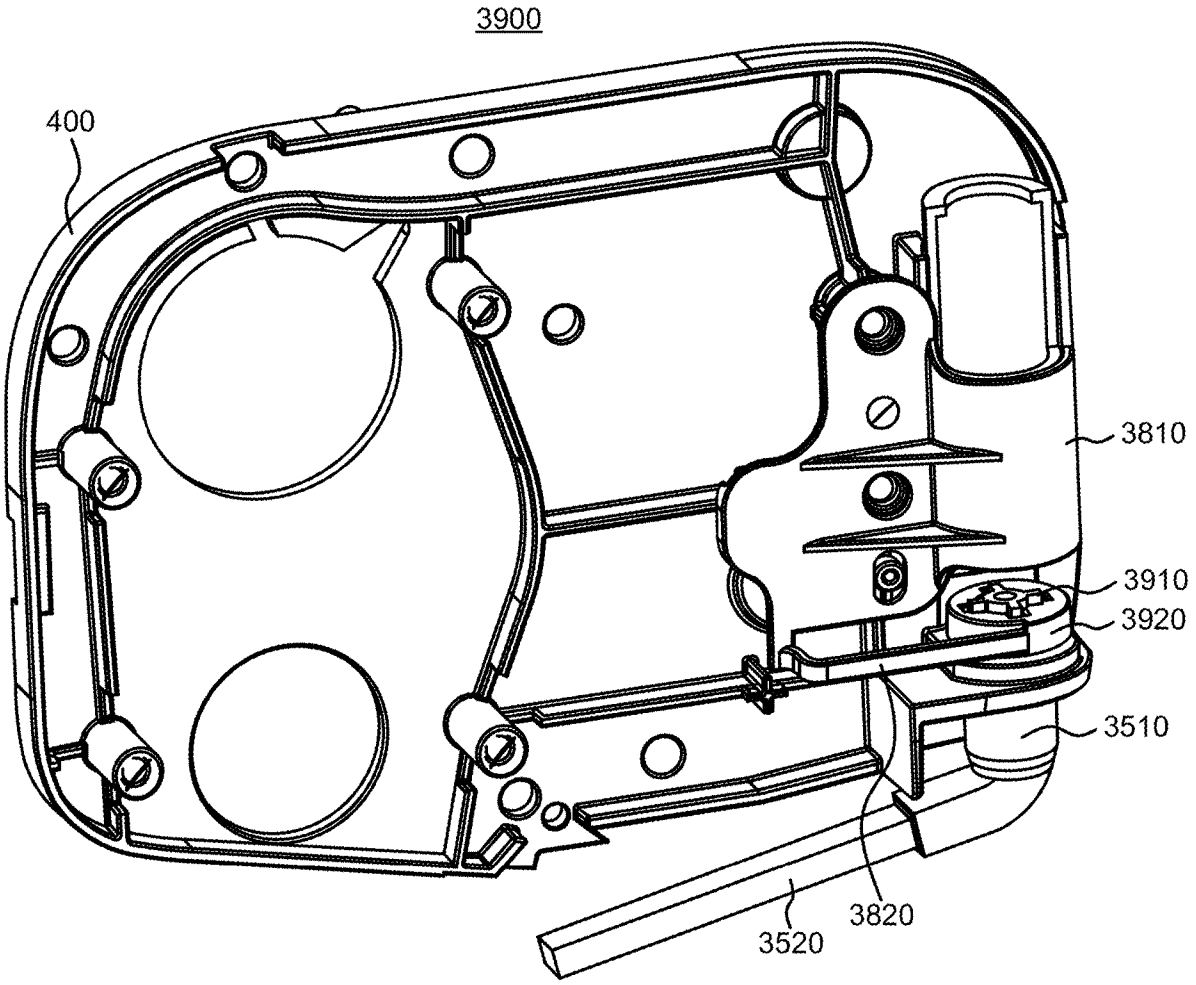
FIG. 39 depicts an isometric view of the cleaning head of FIGS. 38A and 38B, in accordance with one embodiment.

The controller may determine to position the side brush 3500 in an active orientation or a concealed orientation. The controller may execute a homing process to position the side brush 3500 from an active orientation to a concealed orientation. In some embodiments, when the cleaning system determines to stop cleaning operations, the controller may execute a homing process to conceal the side brush 3500. In one embodiment of a homing process, the side brush 3500 may be located proximal to a peg, or tooth, that the side brush 3500 may contact during rotation. When moving in a first direction (e.g., counterclockwise), the whiskers 3520 may rotate past the tooth and when moving in a second direction (e.g., clockwise), the whiskers 3520 may stall against the tooth (e.g., the whiskers 3520 may stall if the rotational force is not sufficient). The tooth may be ramped. One example of a tooth used in a homing process is depicted in FIGS. 36A-B and 37A-B. In another embodiment of a homing process, the side brush 3500 may be coupled to a driving pinion and driven coupler, where a ratcheted tooth can contact the driven coupler to cause a motor powering the side brush 3500 to stall. One example of a ratcheting tooth for this homing process is depicted in FIGS. 38A-B and 39.

The controller may instruct the whiskers 3520 to rotate in the second direction at a high duty setting (e.g., a rotation per minute (RPM) frequency that is sufficient for the whiskers 3520 not to be stalled against the peg). The controller may then instruct the whiskers 3520 to rotate in the second direction at a slower RPM and iteratively slow the RPM until there is sufficient force for the whiskers 3520 to rotate but will stall once the whiskers contact the peg. In some embodiments, the duration of the homing process (e.g., beginning from the controller instructing rotation in the second direction at a high duty setting until the whiskers are stalled by the peg) is approximately one second.

Figure 36B:
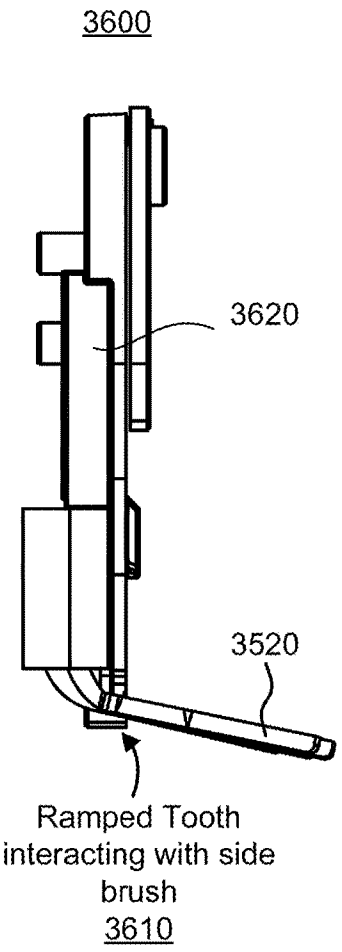
FIGS. 36A and 36B depict a side brush coupled to an internal surface of a cleaning head, in accordance with one embodiment.
Figure 36A:
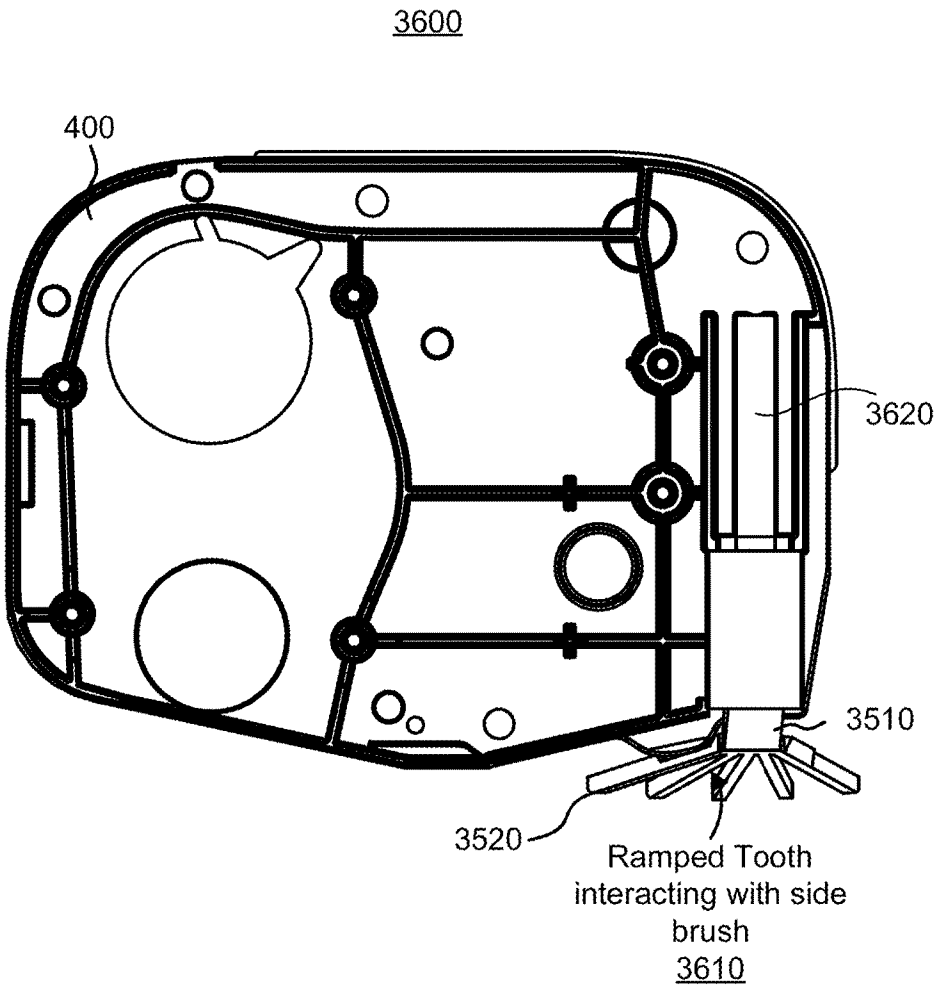

FIGS. 36A and 36B depict a side brush 3520 coupled to an internal surface of a cleaning head 400, in accordance with one embodiment. FIG. 36A depicts a front view of a portion 3600 of the cleaning head 400 from an interior surface of the cleaning head 400. FIG. 36B depicts a side view of the portion 3600 of the cleaning head 400. The portion 3600 of the cleaning head 400 includes the base 3510 and whiskers 3520 of a side brush. A motor driving the whiskers 3520 may be coupled to a motor clamp 3620. The motor clamp 3620 may house the motor and secure a position of the motor (e.g., during operation of the motor to rotate the whiskers 3520). The motor clamp 3620 may be oriented such that the motor clamp 3620 is parallel to a vertical surface that the whiskers 3520 are cleaning. The motor clamp 3620 may be cylindrical, rectangular, or any suitable shape for housing a motor for rotating the whiskers 3520. One end of the motor clamp 3620 may be coupled to the base 3510.

A ramped tooth 3610 may be structured to contact the whiskers 3520. The structure of the ramped tooth 3610 is described in additional detail with respect to FIGS. 37A and 37B, which show similar views as FIGS. 36A and 36B without the whiskers 3520 and the base 3510 to obstruct the view of the ramped tooth 3610. The ramped tooth 3610 may stall the motion of the whiskers 3520 in response to the whiskers 3520 rotating in one direction (e.g., clockwise) such that the whiskers 3520 rotation slows to a stop. In response to the whiskers 3520 rotating in another direction (e.g., counterclockwise), the ramped tooth 3610 may cause relatively less impact to the rotation of the whiskers 3520 such that the whiskers 3520 do not slow to a stop.

Figure 37B:
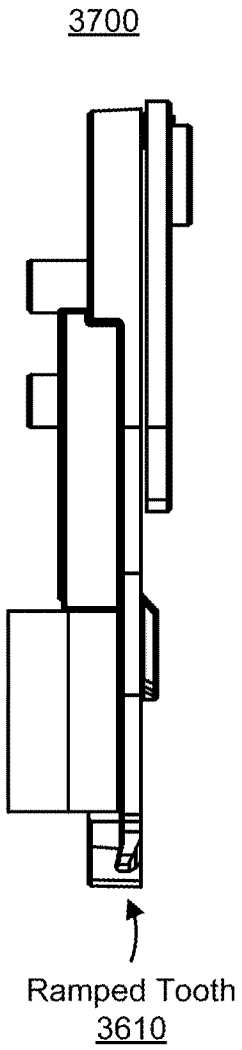
FIGS. 37A and 37B depict a ramped tooth structured to contact a side brush, in accordance with one embodiment.
Figure 37A:
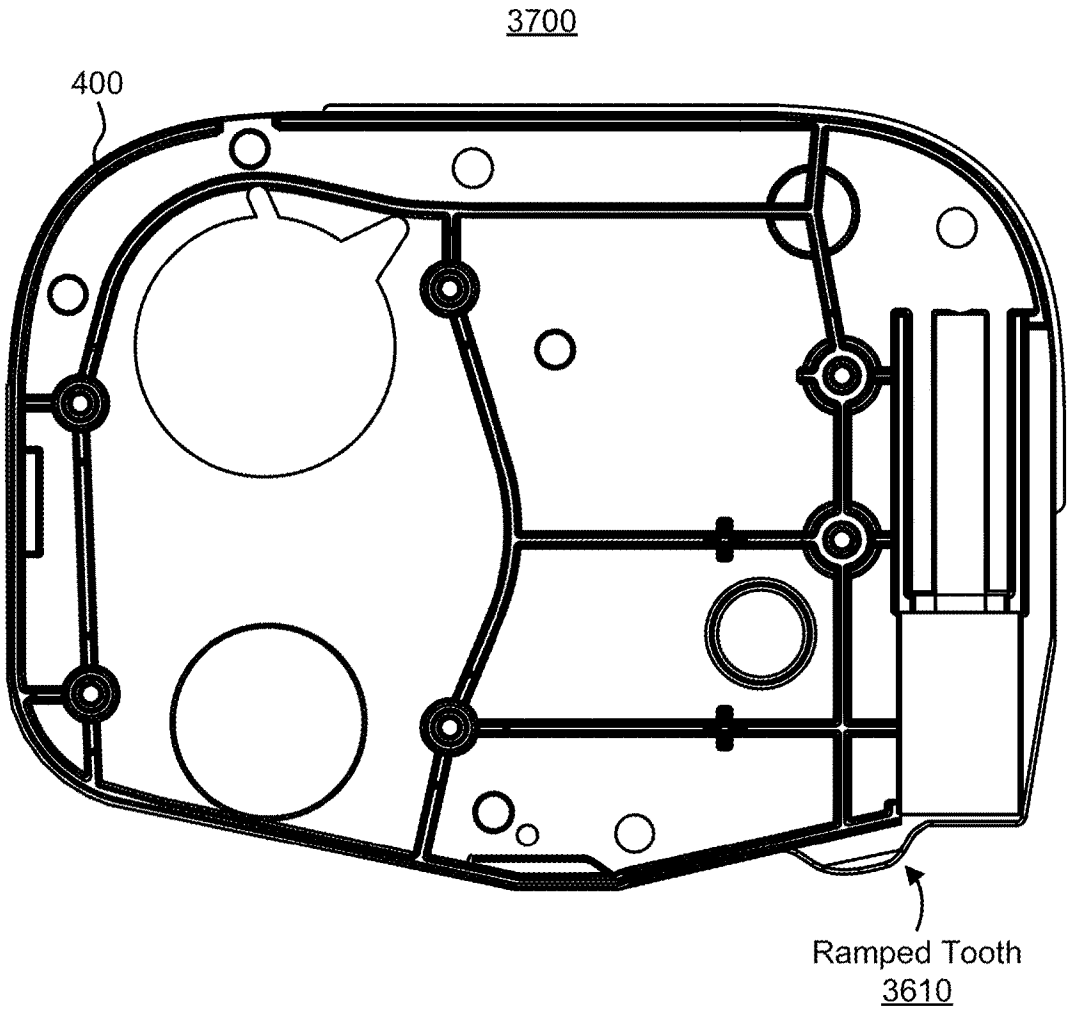

FIGS. 37A and 37B depict a ramped tooth structured to contact a side brush, in accordance with one embodiment. FIG. 37A depicts a front view of a portion 3700 of the cleaning head 400 from an interior surface of the cleaning head 400. FIG. 37B depicts a side view of the portion 3700 of the cleaning head 400. The portion 3700 of the cleaning head 400 does not include the base 3510 and the whiskers 3520 to depict the ramped tooth 3610 with added clarity. The ramped tooth 3610 may be coupled to the cleaning head 400 and located on the cleaning head 400 proximal to the whiskers 3520 (e.g., within a distance away from the base 3510 that is substantially equal to or less than the length of a whisker of the whiskers 3520). The ramped tooth 3610 may be composed of polycarbonate/acrylonitrile butadiene styrene (PC/ABS), spring steel, aluminum, or any suitable material that offers compliance and high fatigue life (e.g., millions of cycles). The ramped tooth 3610 may be ramped in a direction extending away from the inner surface of the cleaning head 400 and towards the whiskers 3520. The ramped tooth 3610 may taper in width as the ramped tooth 3610 extends from the cleaning head 400 and towards the whiskers 3520.

FIGS. 38A and 38B depicts a cleaning head 3840 configured to perform a homing technique for the whiskers 3520 through a ratcheting tooth 3820, in accordance with one embodiment. FIG. 38A depicts a front view of a portion 3800 of the cleaning head 3840 from an interior surface of the cleaning head 3840. FIG. 38B depicts a side view of the portion 3800 of the cleaning head 3840. The cleaning head 3840 may be similar in structure and function to the cleaning head 400. The cleaning head 3840 may be coupled to a motor clamp 3810 at an interior surface of the cleaning head 3840. The motor clamp 3810 and ratcheting tooth 3820 are further described with respect to FIG. 40. A motor may be housed in a sleeve (e.g., a cylindrical sleeve) that is secured in position by the motor clamp 3810. The motor may drive a driving pinion, which is described with respect to FIG. 41. The ratcheting tooth 3820 is structured to contact a driven coupler, which is described with respect to FIG. 42.

FIG. 39 depicts an isometric view 3900 of the cleaning head 3840 of FIGS. 38A and 38B, in accordance with one embodiment. A controller of the cleaning system described herein may perform a homing technique for the whiskers 3520 using the ratcheting tooth 3820. In one embodiment, the motor or a portion of the motor (e.g., a motor shaft) driving the whiskers 3520 slides in a cylindrical sleeve. The motor or portion of the motor may be coupled to a driving pinion 3910. The driving pinion 3910 may transfer torque to a driven coupler 3920, which is in turn rotationally coupled to the whiskers 3520. The ratcheted tooth 3820 may be composed of polycarbonate/acrylonitrile butadiene styrene (PC/ABS), spring steel, aluminum, or any suitable material that offers compliance and high fatigue life (e.g., millions of cycles). One advantage of structing the motor to be indirectly coupled to the driven coupler 3920 is to increase the manufacturing variability resilience of the cleaning system. For example, manufacturing variability may cause radial misalignment between the rotation axis of the driven coupler 3920 and the driving pinion 3910, and the indirect coupling of the motor with the driven couple 3920 may prevent the worsening of this radial misalignment.

As the driving pinion 3910 rotates, the ratcheting tooth 3820 may contact the driven coupler 3920. In response to the whiskers 3520 rotating in a first direction (e.g., counter-clockwise), the ratcheting tooth 3820 may slide over a ramped feature on the driven coupler 3920 (i.e., in a manner that does not cause the motor to stall due to a force by the ratcheting tooth 3820 against the driven coupler 3920). In response to the whiskers 3520 rotating in a second direction (e.g., clockwise), the driven coupler 3920 may push against the driven coupler 3920 (e.g., at a ramp feature of the driven coupler 3920) and in turn, cause the motor to stall. The controller may then cause the motor to be turned off. The controller may, in response to the motor turning off, cause the side brush to be moved to a hidden position (e.g., in a location that the whiskers of the side brush are not visible to a user looking towards the external surface of the cleaning head 3840).

Figure 40:
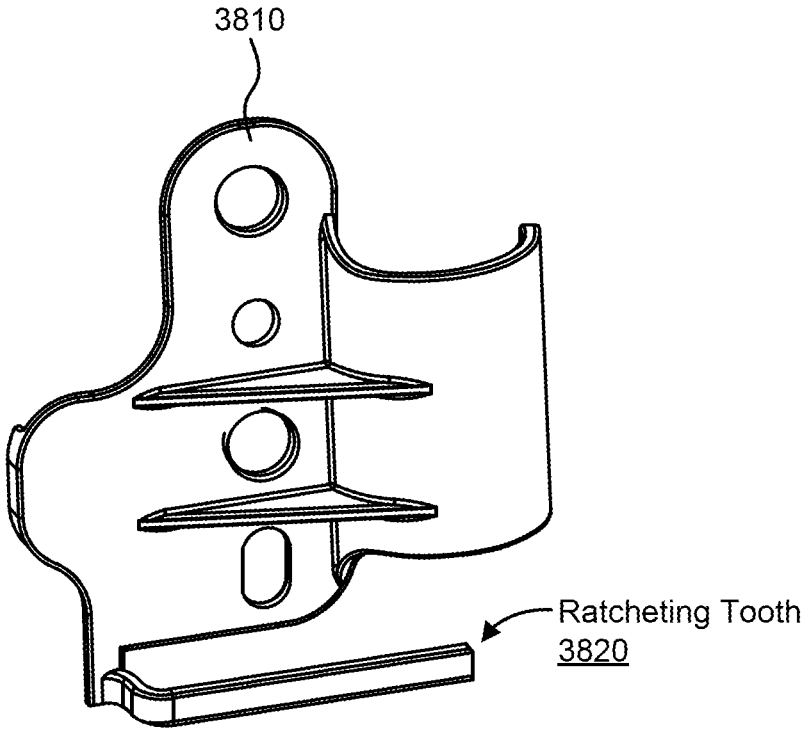
FIG. 40 depicts a motor clamp with a ratcheting tooth used in performing a side brush homing technique, in accordance with one embodiment.

FIG. 40 depicts a motor clamp 3810 with a ratcheting tooth 3820 used in performing a side brush homing technique, in accordance with one embodiment. The motor clamp 3810 may be structured to house a cylindrical sleeve which in turn, houses a motor or a portion of a motor that rotates a side brush. The motor clamp 3810 may include a main body that is coupled to the cylindrical sleeve housing and the ratcheting tooth 3820. The main body of the motor clamp 3810 may include one or more attachment elements (e.g., holes for screws) to attach the motor clamp 3810 to the interior surface of a cleaning head. The motor clamp 3810 may be coupled to the ratcheting tooth 3820 at one end of the motor clamp 3810 and the ratcheting tooth 3820 may be oriented to be substantially perpendicular with the orientation of the portion of the motor clamp 3810 structured to house the cylindrical sleeve. An end of the ratcheting tooth 3820 that is distal to the main body of the motor clamp 3810 may be structured to contact the driven coupler 3920 (e.g., as depicted in FIGS. 38A and 39).

Figure 41:
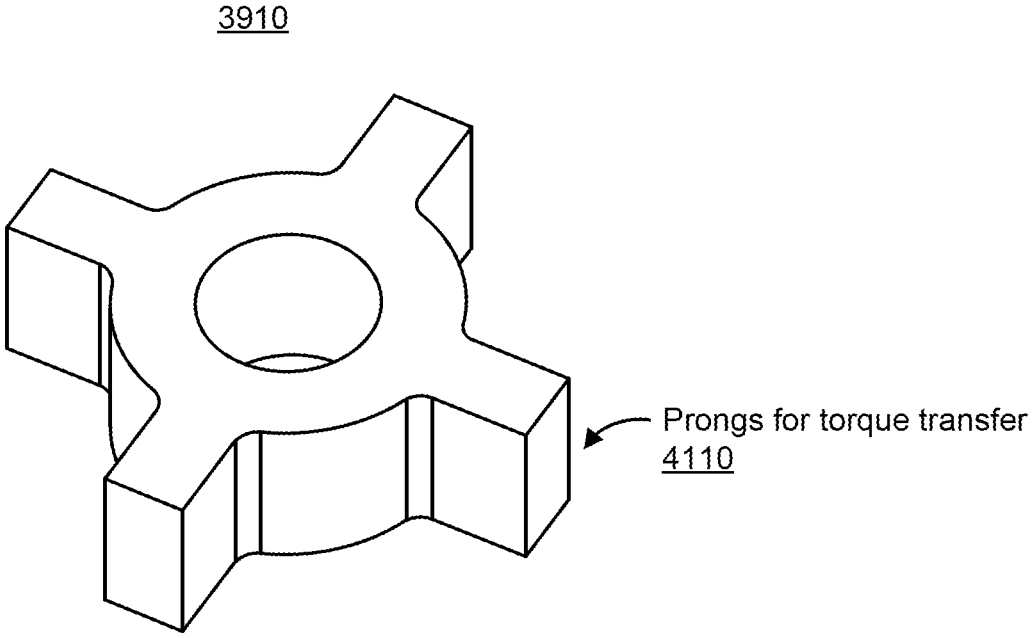
FIG. 41 depicts a driving pinion used in performing a side brush homing technique, in accordance with one embodiment.

FIG. 41 depicts a driving pinion 3910 used in performing a side brush homing technique, in accordance with one embodiment. The driving pinion 3910 may include prongs 4110 for torque transfer to the driven coupler 3920. Although four prongs 4110 are depicted, varying embodiments of the driving pinion 3910 may have fewer or greater number of prongs.

Figure 42:
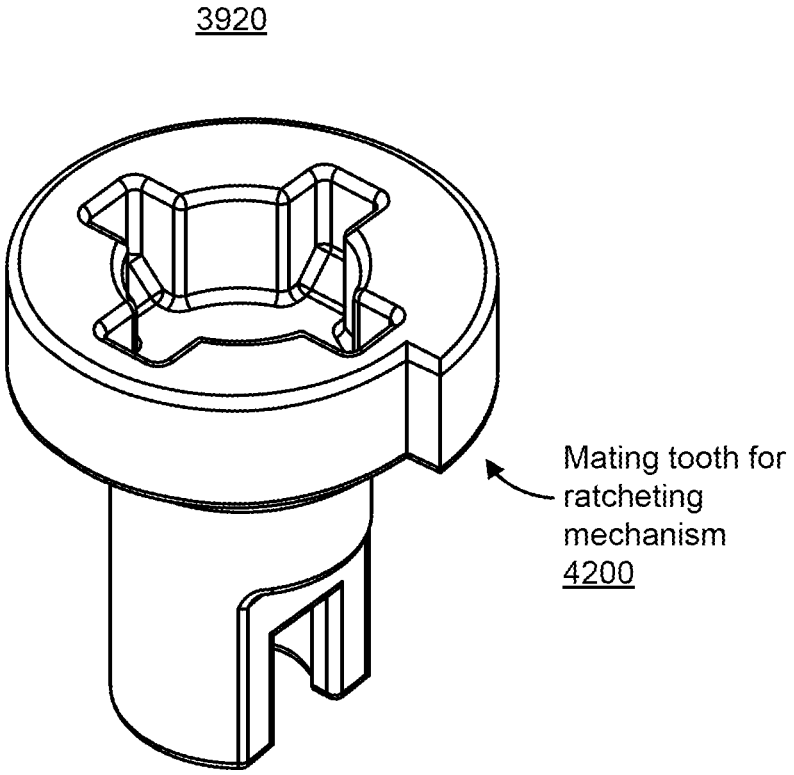
FIG. 42 depicts a driven coupler used in performing a side brush homing technique, in accordance with one embodiment.

FIG. 42 depicts a driven coupler 3920 used in performing a side brush homing technique, in accordance with one embodiment. The driven coupler 3920 includes a mating tooth 4200 that couples with the ratcheting tooth 3820. The mating tooth 4200 may also be referred to as a "ramped feature." The driven coupler 3920 may include a main body that couples to the base 3510 and a head that receives the driving pinion 3910. The mating tooth 4200 may be located at an external surface of the head. The head may be shaped like a cylinder with an increasing radial thickness that is a maximum thickness at the mating tooth 4200. The head may include an area for receiving the driving pinion 3910, where the area is structured to receive a number of prongs 4110 of the driving pinion 3910. Although the area depicted in FIG. 42 is structured to receive four prongs, the driven coupler 3920 may receive a driving pinion 3910 with greater or fewer number of prongs.

Figure 43:
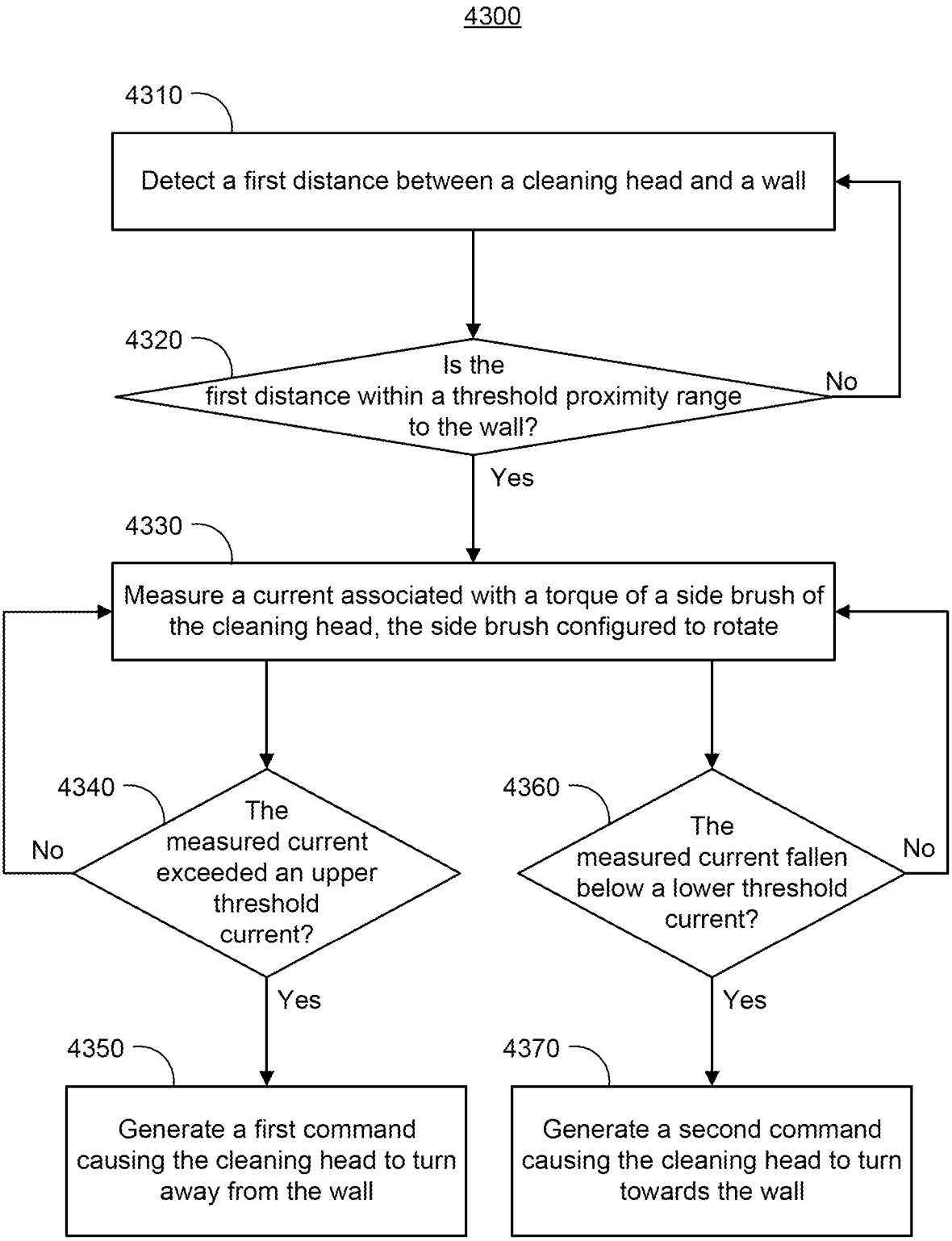
FIG. 43 depicts a process for operating a side brush against a wall, in accordance with one embodiment.

FIG. 43 depicts a process 4300 for operating a side brush against a wall, in accordance with one embodiment. The process 4300 may be referred to as a "wall-following process." In particular, the process 4300 uses a measured current at a rotating side brush to determine motor controls for modifying a distance between the side brush and a wall. The process 4300 may be performed by the cleaning system described herein (e.g., a controller of the cleaning system). The process 4300 may include additional, fewer, or different operations than shown in FIG. 43.

The cleaning system detects 4310 a first distance between a cleaning head and a wall. A controller of the cleaning system may use laser-based sensors to detect 4310 the first distance between the cleaning head 400 and a wall of an environment in which the cleaning head 400 is ingesting debris. The cleaning system may use one or more cameras, which may be onboard the motorized robot as it moves around the environment, stationary within the environment (e.g., coupled to a wall), or a combination thereof. The controller may receive image data from one or more cameras to detect the wall and determine the first distance.

The cleaning system determines 4320 whether the first distance is within a threshold proximity range to the wall. The controller of the cleaning system may compare the first distance to the threshold proximity range to determine 4320 whether the first distance is within the threshold proximity range. The threshold proximity range may be within 0.1-0.5 meters.

The cleaning system measures 4330 a current associated with a torque of a side brush. The side brush is configured to rotate about a base (e.g., the base 3510 depicted in FIGS. 35A and 35B). The controller of the cleaning system may measure a current draw (e.g., amperes) associated with a force from a motor rotating the side brush 3500.

The cleaning system determines 4340 whether the measured current has exceeded an upper threshold current and determines 4360 whether the measured current has fallen below a lower threshold current. Example current values may range from 22-28 mA while the autonomous vacuum is in a no-load condition (e.g., no resistance is applied from contact between the side brush 3500 and a surface) and 90-100 mA while the autonomous vacuum is in a fully engaged condition (e.g., resistance occurs from contact between the side brush 3500 and a surface). In response to determining 4340 that the measured current has not exceeded an upper threshold current and determining 4360 that the measured current has not fallen below a lower threshold current, the cleaning system continues to measure 4330 the current associated with the side brush torque.

In response to determining 4340 that the measured current has exceeded the upper threshold current, the cleaning system generates 4350 a first command causing the cleaning head to turn away from the wall. In some embodiments, in response to determining 4340 that the measured current has exceeded the upper threshold current, the cleaning system navigates the cleaning head away from the wall. In response to determining 4360 that the measured current has fallen below the lower threshold current, the cleaning system generates 4370 a second command causing the cleaning head to turn towards the wall. In some embodiments, in response to determining 4340 that the measured current has fallen below the lower threshold current, the cleaning system navigates the cleaning head towards the wall.

BENEFITS AND ADDITIONAL CONSIDERATIONS

The cleaning system described here includes a brush roller that reduces the friction from ingesting fibrous debris relative to conventional brush rollers. Buffer zones at the brush roller also collect fibrous debris as the structure of the brush roller directs the fibrous debris towards the buffer zones. In this way, the fibrous debris is less likely to wrap around the brush roller and cause friction during rotation of the brush roller. The brush roller also reduces friction at rotating portions of the brush roller by including a guard to prevent fibrous debris from contacting the rotating drive pinion. Another aspect of the brush roller that reduces friction is the pin-tip assembly that may be stationary or free-rotating relative to other components of the brush roller. Fibrous debris is likely to be wrapped around the rotating portions of the brush roller and less likely to wrap around the stationary or free-rotating pin-tip assembly. This reduces friction caused by fibrous debris at the pin-tip assembly.

Furthermore, the brush roller is detachable to facilitate removal of fibrous debris from the buffer zones. The buffer zones can be positioned at a duct opening to have the fibrous debris suctioned from the buffer zones with minimal or no contact by a user, which may be more sanitary for operation than conventional brush rollers where users must manually grab fibrous debris away from the brush rollers. The brush roller is configured to be unlocked from a position contacting the inner surface of a cleaning head of the cleaning system without requiring application of excessive force or complex disassembly steps to be followed by a user. The brush roller may be unlocked without turning over the robot vacuum (e.g., without inverting the vacuum so that the brush roller is facing upwards).

The cleaning system also includes a side brush that uses a torque-based technique for following a vertical surface (e.g., a wall) to clean the vertical surface. By measuring a current draw associated with a torque from the rotating side brush and determining, based on the measured current draw, to navigate the wheels of the cleaning system towards or away from the vertical surface, the cleaning system can follow the vertical surface with the side brush with greater precision as compared to conventional cleaning systems which may only use laser-based sensors.

The cleaning system further includes a wedge that serves as a seal between a debris ingestion cavity of the cleaning system's cleaning head and the environment. The wedge is structured to reduce the likelihood of debris accumulating in a space between the wedge and the brush roller. Wedges of conventional cleaning systems may cause debris to accumulate there (e.g., a skirted leading edge). Furthermore, the wedge may include a strip that is structured to conform to floor textures, reducing the sliding friction and scuffing of the cleaning head against the surface being cleaned.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Some portions of this description describe the embodiments of the invention in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Where values are described as "approximate" or "substantially" (or their derivatives), such values should be construed as accurate +/−10% unless another meaning is apparent from the context. From example, "approximately ten" should be understood to mean "in a range from nine to eleven."

Terms referencing orientation such as "top" and "bottom" are used for convenience and should not require orientation of the components described herein (e.g., orientation of the cleaning head).

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the disclosed subject matter. It is therefore intended that the scope be limited not by this detailed description, but rather by any claims that issue on an application based hereon. Accordingly, the disclosure of the embodiments are intended to be illustrative, but not limiting, of the scope, which is set forth in the following claims.

What is claimed is:

1. A brush roller comprising:

an outer core comprising a first tube;

an inner core concentric with the outer core and structured within the outer core, the inner core comprising a second tube, wherein the inner core is structured to house:

a spring within an inner surface of the second tube, and a ball bearing to contact the spring; and wherein the inner core is structured to house at least part of:

a pin to contact the ball bearing at a first side of the pin, and an end tip comprising a locking mechanism, the end tip connected to the pin at a second side of the pin, the locking mechanism to secure the end tip to the inner surface of the second tube, wherein the pin and the end tip are connected such that the pin and the end tip are stationary during rotation of the ball bearing and inner core; and a plurality of flaps connected to the outer core.

2. The brush roller of claim 1, wherein the plurality of flaps comprise an elastomer having one or more of:

a hardness within Shore A 40 to 80;

a Bayshore rebound resilience within 5% to 50%;

an elongation at break within 50% to 900%; and a tear strength within 75 to 250 kilonewtons (kN) per meter (m).

3. The brush roller of claim 1, wherein a combined length of two or more of the plurality of flaps extend along a total length of the outer core.

4. The brush roller of claim 1, wherein a first flap of the plurality of flaps overlaps with a second flap of the plurality of flaps by an overlapping length of 5 to 50 millimeters (mm).

5. The brush roller of claim 1, wherein each flap of the plurality of flaps comprises a trailing edge and a leading edge, the trailing edge proximal to the center of the outer core.

6. The brush roller of claim 5, wherein the outer core comprises bases at opposite ends of the outer core, each leading edge forms an angle within 1 to 60 degrees with one of bases of the outer core.

7. The brush roller of claim 1, wherein a flap of the plurality of flaps has a length within 5 to 35 millimeters.

8. The brush roller of claim 1, wherein a flap of the plurality of flaps comprises a root section and a tapered section, wherein the root section has a uniform thickness, and wherein the tapered section has a tapered thickness.

9. The brush roller of claim 8, wherein a ratio between the uniform thickness of the root section and a height of the flap is within 1:5 to 1:25.

10. The brush roller of claim 1, wherein the inner surface of the inner core comprises a recession enabling a linear motion of the pin and the end tip within a range of 0.5 to 30 mm, the linear motion parallel with the central axis of the inner core.

11. The brush roller of claim 1, wherein an outer radius of the outer core is within 8 to 50 mm and a total length of the outer core is within 50 to 500 mm.

12. The brush roller of claim 1, wherein the outer core further comprises a plurality of air pathways configured to enable airflow along a length of the outer core.

13. The brush roller of claim 1, wherein the brush roller further comprises one or more buffer zones, each buffer zone comprising a toroidal cavity configured to receive and store hair, the toroidal cavity located between an inner surface of the first tube and an outer surface of the second tube.

14. The brush roller of claim 1, wherein the inner core further comprises a drive coupler configured to couple to a drive pinion, wherein the drive pinion is attached to a cleaning head configured to house the brush roller.

15. A cleaning system comprising:

a debris ingestion opening, a brush roller configured to receive debris from the debris ingestion opening, the brush roller comprising:

an outer core comprising a first tube;

an inner core concentric with the outer core and configured to be located within the outer core, the inner core comprising a second tube, wherein the inner core is configured to house:

a spring configured to contact an inner surface of the second tube, and a ball bearing configured to contact the spring; and wherein the inner core is configured to house at least part of:

a pin configured to contact the ball bearing at a first side of the pin, and an end tip comprising a locking mechanism, the end tip connected to the pin at a second side of the pin, the locking mechanism configured to secure the end tip to the inner surface of the second tube, wherein the pin and the end tip are connected such that the pin and the end tip are stationary during rotation of the ball bearing and inner core;

a plurality of flaps connected to the outer core, and one or more buffer zones, each buffer zone comprising a toroidal cavity configured to receive and store hair, the toroidal cavity located between an inner surface of the first tube and an outer surface of the second tube, and a duct opening configured to receive debris moved by the brush roller, the debris including hair that is directed into a buffer zone of the one or more buffer zones within the duct opening, the buffer zone located proximal to an end of the brush roller, the brush roller positioned proximal to the duct opening for suction of the hair from the buffer zone.

16. The cleaning system of claim 15, wherein the plurality of flaps comprise an elastomer having one or more of:

a hardness within Shore A 40 to 80;

a Bayshore rebound resilience within 5% to 50%;

an elongation at break within 50% to 900%; and a tear strength within 75 to 250 kilonewtons (kN) per meter (m).

17. The cleaning system of claim 15, wherein the inner surface of the inner core comprises a recession enabling a linear motion of the pin and the end tip within a range of 0.5 to 30 mm, the linear motion parallel with the central axis of the inner core.

18. A brush roller comprising:

an outer core comprising a first tube;

an inner core concentric with the outer core and structured within the outer core, the inner core comprising a second tube, wherein the inner core is structured to house:

a spring within an inner surface of the second tube, and a ball bearing to contact the spring; and wherein the inner core is structured to house at least part of:

a pin to contact the ball bearing, and an end tip connected to the pin; and a plurality of flaps connected to the outer core, wherein a flap of the plurality of flaps:

has a length within 5 to 35 millimeters, comprises a root section and a tapered section, wherein the root section has a uniform thickness, and wherein the tapered section has a tapered thickness, and comprises an elastomer having one or more of:

a hardness within Shore A 40 to 80;

a Bayshore rebound resilience within 5% to 50%;

an elongation at break within 50% to 900%; and a tear strength within 75 to 250 kN/m.

19. The brush roller of claim 18, wherein the outer core further comprises a plurality of air pathways configured to enable airflow along a length of the outer core.

20. The brush roller of claim 18, wherein the brush roller further comprises one or more buffer zones, each buffer zone comprising a toroidal cavity configured to receive and store hair, the toroidal cavity located between an inner surface of the first tube and an outer surface of the second tube.

* * * * *